US006873816B2

(12) United States Patent
Akashi et al.

(10) Patent No.: US 6,873,816 B2
(45) Date of Patent: Mar. 29, 2005

(54) DEVELOPING ASSEMBLY, PROCESS CARTRIDGE AND IMAGE-FORMING METHOD

(75) Inventors: Yasutaka Akashi, Kanagawa (JP); Yasuhide Goseki, Kanagawa (JP); Masayoshi Shimamura, Kanagawa (JP); Kenji Fujishima, Kanagawa (JP); Kazunori Saiki, Kanagawa (JP); Satoshi Otake, Shizuoka (JP); Naoki Okamoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/219,242

(22) Filed: Aug. 16, 2002

(65) Prior Publication Data

US 2003/0123909 A1 Jul. 3, 2003

(30) Foreign Application Priority Data

Aug. 20, 2001 (JP) ..... 2001-248675

(51) Int. Cl.[7] ..... G03G 15/08
(52) U.S. Cl. ..... 399/286
(58) Field of Search ..... 399/286, 279, 399/280, 281, 282, 284, 285, 274, 276, 275; 430/12.2, 108.6, 110.4, 111.41

(56) References Cited

U.S. PATENT DOCUMENTS 2,297,691 A 10/1942 Carlson ..... 95/5
3,666,363 A 5/1972 Tanaka et al.
4,071,361 A 1/1978 Marushima ..... 96/1.4
4,380,966 A 4/1983 Isaka et al. ..... 118/651
4,664,504 A 5/1987 Oda et al.
4,769,676 A 9/1988 Mukai et al.
4,851,960 A 7/1989 Nakamura et al. ..... 361/225
4,870,461 A 9/1989 Watanabe et al.

(Continued)

FOREIGN PATENT DOCUMENTS

CN 1210283 A 3/1999
JP 36-10231 7/1936

(Continued)

*Primary Examiner*—Hoang Ngo
(74) *Attorney, Agent, or Firm*—Fitzpatrick, Cella, Harper & Scinto

(57) ABSTRACT

A developing assembly is disclosed having at least a developer container, a developer-carrying member and a developer layer thickness regulation member, wherein the developer is composed mainly of toner particles containing at least a binder resin and a colorant, and conductive fine particles, and the developer-carrying member has a substrate and a surface layer formed on the substrate of a non-magnetic metal, an alloy or a metallic compound. This developing assembly causes no sleeve ghost, enables electrostatic latent images to be faithfully developed, causes no fading phenomenon, and enables high-density images to be formed in every environment. Also disclosed are a process cartridge having the developing assembly and the latent-image-bearing member integrally set as one unit detachably mountable on the main body of an image-forming apparatus, and an image-forming method making use of the features of this developing assembly.

18 Claims, 6 Drawing Sheets

U.S. PATENT DOCUMENTS

| | | | | |
|---|---|---|---|---|
| 5,175,070 | A | 12/1992 | Tanikawa et al. | 430/122 |
| 5,175,586 | A | 12/1992 | Goseki et al. | |
| 5,202,731 | A | 4/1993 | Tanikawa et al. | |
| 5,274,426 | A | 12/1993 | Goseki et al. | |
| 5,282,007 | A | 1/1994 | Oshiumi | |
| 5,283,618 | A | 2/1994 | Hosoya et al. | |
| 5,432,037 | A | 7/1995 | Nishikiori | 430/126 |
| 5,480,755 | A | 1/1996 | Uchiyama et al. | 430/106.6 |
| 5,618,647 | A | 4/1997 | Kukimoto et al. | 430/106.6 |
| 5,721,433 | A | 2/1998 | Kosaka | 250/573 |
| 5,849,453 | A | 12/1998 | Mikuriya et al. | 430/125 |
| 5,885,743 | A | 3/1999 | Takayanagi et al. | 430/110 |
| 5,912,101 | A | 6/1999 | Karaki et al. | 430/110 |
| 5,976,755 | A | 11/1999 | Yoshida et al. | 430/126 |
| 6,060,202 | A | 5/2000 | Ogawa et al. | 430/111 |
| 6,077,635 | A | 6/2000 | Okado et al. | 430/45 |
| 6,081,681 | A | 6/2000 | Nagase et al. | 399/174 |
| 6,104,903 | A | 8/2000 | Hara et al. | 399/265 |
| 6,115,575 | A | 9/2000 | Kinoshita et al. | 399/286 |
| 6,122,473 | A | 9/2000 | Goseki et al. | 399/286 |
| 6,128,456 | A | 10/2000 | Chigono et al. | 399/176 |
| 6,178,306 | B1 * | 1/2001 | Mizoguchi et al. | 399/276 |
| 6,391,511 | B1 | 5/2002 | Okamoto et al. | 430/120 |

FOREIGN PATENT DOCUMENTS

| | | |
|---|---|---|
| JP | 42-23910 | 11/1942 |
| JP | 43-24748 | 10/1943 |
| JP | 54-79043 | 6/1979 |
| JP | 55-26526 | 2/1980 |
| JP | 56-13945 | 4/1981 |
| JP | 56-142540 | 11/1981 |
| JP | 57-66455 | 4/1982 |
| JP | 57-116372 | 7/1982 |
| JP | 57-151952 | 9/1982 |
| JP | 58-11974 | 1/1983 |
| JP | 59-53856 | 3/1984 |
| JP | 59-61842 | 4/1984 |
| JP | 59-133573 | 7/1984 |
| JP | 59-168458 | 9/1984 |
| JP | 60-69660 | 4/1985 |
| JP | 61-141452 | 6/1986 |
| JP | 61-249059 | 11/1986 |
| JP | 61-275864 | 12/1986 |
| JP | 62-203182 | 9/1987 |
| JP | 62-258742 | 11/1987 |
| JP | 63-133179 | 6/1988 |
| JP | 63-149669 | 6/1988 |
| JP | 64-20587 | 1/1989 |
| JP | 1-131586 | 5/1989 |
| JP | 2-120865 | 5/1990 |
| JP | 2-302772 | 12/1990 |
| JP | 4-9860 | 1/1992 |
| JP | 4-264453 | 9/1992 |
| JP | 5-2287 | 1/1993 |
| JP | 5-2289 | 1/1993 |
| JP | 5-53482 | 3/1993 |
| JP | 5-61383 | 3/1993 |
| JP | 5-66608 | 3/1993 |
| JP | 5-150539 | 6/1993 |
| JP | 5-346682 | 12/1993 |
| JP | 7-99442 | 10/1995 |
| JP | 9-146293 | 6/1997 |
| JP | 10-83096 | 3/1998 |
| JP | 10-307421 | 11/1998 |
| JP | 10-307455 | 11/1998 |
| JP | 10-307456 | 11/1998 |
| JP | 10-307457 | 11/1998 |
| JP | 10-307458 | 11/1998 |
| JP | 2862827 | 12/1998 |
| JP | 11-15206 | 1/1999 |
| JP | 11-95479 | 4/1999 |
| JP | 11-174731 | 7/1999 |
| JP | 11-194530 | 7/1999 |
| JP | 11-202557 | 7/1999 |

* cited by examiner

DEVELOPING ASSEMBLY, PROCESS CARTRIDGE AND IMAGE-FORMING METHOD

BACKGROUND OF THE INVENTION

1. Field of the Invention

This invention relates to a developing assembly, a process cartridge and an image-forming method which are usable in recording processes utilizing electrophotography or electrostatic recording.

2. Related Background Art

Electrophotographic processes are disclosed in U.S. Pat. No. 2,297,691, Japanese Patent Publication No. 42-23910 (U.S. Pat. No. 3,666,363), Japanese Patent Publication No. 43-24748 (U.S. Pat. No. 4,071,361) and so forth. In general, copies or prints are obtained by forming an electrostatic latent image on an electrostatic latent image bearing member (photosensitive member) by various means utilizing a photoconductive material, subsequently developing the electrostatic latent image by the use of a developer (hereinafter often referred to as simply "toner") to form a toner image, and transferring the toner image to a transfer medium such as paper as occasion calls, followed by fixing by the action of heat, pressure, solvent vapor, or heat-and-pressure.

In recent years, in addition to conventional copying machines, equipments making use of electrophotography have become various, as exemplified by printers and facsimile machines. Developing systems are roughly grouped into a two-component developing system making use of carrier particles and a one-component developing system making use of no carrier particles. The one-component developing system is one in which a toner is triboelectrically charged chiefly by the friction of the toner with a triboelectric charging member, and is roughly grouped into a one-component magnetic developing system in which magnetic particles are incorporated in toner particles and a developer is carried and transported by the action of magnetic force and a one-component non-magnetic developing system in which, without use of any magnetic particles, a developer is carried on a developer-carrying member by the action of triboelectric charges of the developer. In the one-component magnetic developing system, without use of any colorant such as carbon black, magnetic particles may be made to serve also as the colorant.

The two-component developing system requires a device with which the concentration of toner is detected to supply the toner in a necessary quantity, because carrier particles such as glass beads or iron powder are necessary in order to impart electric charges to the toner by their friction with the toner or because the concentration of toner in the developer must be kept constant. Accordingly, its developing assembly is large and heavy and also has complicate construction. The two-component developing system also tends to cause adhesion of toner components to the carrier (i.e., toner-spent), and hence the carrier must frequently be replaced. In this regard, the one-component developing system does not require any carrier and such complicate construction, and can make the developing assembly itself compact, small-size and light-weight. In addition, it does not require any replacement of carriers, and hence makes maintenance service unnecessary over a long period of times. On the other hand, the one-component magnetic developing system is difficult to employ in color development because pitch-black magnetic particles are used in toners, whereas the two-component developing system enables control of delicate development condition by means of the concentration detection device and hence is preferably used in color development.

Without regard to the difference between the one-component type and the two-component type, methods are also proposed in which an inorganic fine powder is added to toner particles as an agent externally added (an external additive), and are put into wide use.

For example, Japanese Patent Applications Laid-Open No. 5-66608, No. 4-9860 and so forth disclose a method in which an inorganic fine powder having been subjected to hydrophobic treatment or an inorganic fine powder having been subjected to hydrophobic treatment and thereafter further treatment with a silicone oil is added; and Japanese Patent Applications Laid-Open No. 61-249059, No. 4-264453 and No. 5-346682, a method in which a hydrophobic-treated inorganic fine powder and a silicone-oil-treated inorganic fine powder are used in combination and added.

Methods in which conductive fine particles are externally added to developers as the external additive are also proposed in a large number. For example, carbon black as conductive fine particles is widely known to be used as an external additive for adhering or sticking to toner particle surfaces, for the purpose of providing conductivity to toners or controlling any excess charging of toners to make their triboelectric distribution uniform. Also, Japanese Patent Applications Laid-Open No. 57-151952, No. 59-168458 and No. 60-69660 disclose external addition of conductive fine particles such as tin oxide, zinc oxide and titanium oxide, respectively, to high-resistance magnetic toner. In Japanese Patent Application Laid-Open No. 56-142540, also proposed is a developer in which conductive magnetic particles such as iron oxide, iron powder or ferrite are added to a high-resistance magnetic toner to make the conductive magnetic particles accelerate the induction of electric charges to the magnetic toner so that both developing performance and transfer performance can be achieved. Further, Japanese Patent Applications Laid-Open No. 61-275864, No. 62-258742, No. 61-141452 and No. 2-120865 disclose addition of graphite, magnetite, polypyrrole conductive particles or polyaniline conductive particles to toners.

Various methods are also known in respect of methods of forming electrostatic latent images on latent-image-bearing members such as electrophotographic photosensitive members and electrostatic recording dielectrics. For example, in electrophotography, a method is common in which as a latent-image-bearing member a photosensitive member utilizing a photoconductive material is uniformly charged to the necessary polarity and potential and thereafter the surface of this photosensitive member is subjected to image pattern exposure to form an electrical latent image.

Corona charging assemblies (corona dischargers) have widely been used as charging assemblies for uniformly charging (also inclusive of charge eliminating) latent-image-bearing members to the necessary polarity and potential.

The corona charging assembly is a non-contact type charging assembly. It has a discharge electrode such as a wire electrode and has a shield electrode which surrounds the discharge electrode. Its discharge opening is provided opposingly to and in non-contact with a charging object member latent-image-bearing member, where a high voltage is applied across the discharge electrode and the shield electrode to cause discharge electric current (corona shower) to take place, to which the surface of the latent-image-bearing member is exposed to charge the latent-image-bearing member surface to the intended polarity and potential.

In recent years, contact charging assemblies are proposed in a large number as charging assemblies for charging object members such as latent-image-bearing members because of their advantages of lower ozone generation and lower power consumption than the corona charging assemblies, and have been put into practical use.

The contact charging assembly is an assembly in which a conductive charging member of a roller type (charging roller), a fur brush type, a magnetic-brush type or a blade type is brought into contact with a charging object member such as an image-bearing member and a stated charging bias is applied to this contact charging member or contact charging assembly to charge the surface of the charging object member to the stated polarity and potential.

The charging mechanism (charging principle) of contact charging mixedly involves two types of charging mechanisms, which are (1) discharge charging mechanism and (2) direct-injection charging mechanism. Their characteristics are brought out depending on which mechanism governs the other.

(1) Discharge Charging Mechanism of Contact Charging

This is the mechanism in which the charging object member surface becomes charged by the phenomenon of discharge caused at any microscopic gap(s) to be formed between the contact charging member and the charging object member. The discharge charging has a certain discharge threshold value between the contact charging member and charging object member, and hence a voltage greater than the charge potential must be applied to the contact charging member. Though generated in a remarkably smaller quantity than that in corona charging assemblies, a discharge product is inevitably generated in principle, and hence difficulties due to active ions such as ozone are unavoidable.

(2) Direct-Injection Charging Mechanism of Contact Charging

This is a system in which electric charges are directly injected from the contact charging member into the charging object member to charge the charging object member surface electrostatically. This is also called direct charging, or injection charging, or electric-charge injection charging. Stated more specifically, this is a method in which a medium-resistance contact charging member is kept in contact with the charging object member surface to inject electric charges directly to the surface of the charging object member not through any discharge phenomenon, in short, without using any discharge mechanism basically. Hence, even if the voltage applied to the charging object member is not higher than the discharge threshold value, the charging object member can be charged to the potential corresponding to the applied voltage. This charging system is not accompanied with the generation of active ions such as ozone, and hence any difficulties that may be caused by discharge products does not occur. However, because of direct injection charging, the contact performance of the contact charging member on the charging object member has a great influence on the charging performance. Accordingly, in order to afford construction in which the contact charging member comes into contact with the charging object member more highly frequently, the contact charging member is required to have the construction such that it has closer contact points and has much difference in speed from the charging object member.

In the contact charging assembly, a roller charging system making use of a conductive roller (charging roller) is preferable in view of the stability of charging, and is put into wide use.

The charging mechanism in conventional roller charging is predominantly governed by the above (1) discharge charging mechanism. The charging roller is formed using a conductive or medium-resistance rubber material or foam. In some roller, such a rubber material or foam is provided in layers to attain the desired characteristics.

The charging roller is provided with an elasticity in order to ensure the state of a uniform contact between it and the charging object member. For this reason, it has a great frictional resistance, and in many cases it is driven in follow-up with, or at some difference in speed from, the rotation of the charging object member. Hence, any attempt of direct-injection charging may inevitably cause a decrease in absolute chargeability, a contact unevenness due to shortage in contact performance and roller shape and a charging unevenness due to any deposits on the charging object member.

FIG. 1 is a graph showing examples of charging efficiency of contact charging in electrophotography. The bias voltage applied to the contact charging member is plotted as abscissa, and the charge potential of the charging object (hereinafter "photosensitive member"), obtained there, is plotted as ordinate.

Charge characteristics in the case of roller charging are represented by A. That is, the surface potential of the photosensitive member begins to rise after the applied voltage exceeds a threshold value of about −500 V, and, at voltages higher than such threshold value, the photosensitive member surface potential increases linearly at a slope of 1 with respect to the applied voltage. This threshold value voltage is defined as charging start voltage Vth. Accordingly, when the photosensitive member is charged to −500 V, it is common to employ a method in which a DC voltage of −1,000 V is applied, or, in addition to the charging voltage of −500 V, an AC voltage of, e.g., a peak-to-peak voltage of 1,200 V is applied so as to provide a potential difference larger than the discharge threshold value, to converge the photosensitive member potential to the charge potential.

In order to obtain a photosensitive member surface potential Vd that is required in electrophotography, a DC voltage of "Vd+Vth", what is higher than is necessary, must be applied to the charging roller. The charging performed by applying only a DC voltage to the contact charging member in this way is called "DC charging".

In the DC charging, however, it has been difficult to control the potential of the photosensitive member at the desired value because the resistance value of the contact charging member varies depending on environmental variations and also because the Vth varies with changes in layer thickness caused by the abrasion of the photosensitive member.

Accordingly, in order to achieve more uniform charging, as disclosed in Japanese Patent Application Laid-Open No. 63-149669, "AC charging system" may be used which is a method of applying to the contact charging member a voltage formed by superimposing an AC component having a peak-to-peak voltage of 2×Vth or above, on a DC voltage corresponding to the desired Vd. This method aims at a potential-leveling effect which is attributable to AC, where the potential of the charging object member converges on Vd, the middle of a peak of AC potential, and is by no means affected by external disturbance such as environmental variations.

However, even in such contact charging assemblies, its fundamental charging mechanism employs the phenomenon of discharge from the contact charging member to the photosensitive member. Hence, as stated previously, the voltage applied to the contact charging member is required to be the value higher than the desired surface potential of the photosensitive member, and the ozone may come therefrom at least are a very small level. Also, when the AC charging is performed in order to achieve uniform charging, the ozone may more be generated, the electric field of AC voltage may cause a vibrating noise (AC charging sound) between the contact charging member and the photosensitive member, and any discharging may remarkably cause deterioration or the like of the surface of the photosensitive member. These have come into additional question.

The fur brush charging is one in which, using as a contact charging member a member having a conductive-fiber brush portion (a fur brush charging assembly), the conductive-fiber brush portion is brought into contact with a photosensitive member as the charging object, and a stated charging bias is applied to the conductive-fiber brush portion to charge the surface of the photosensitive member electrostatically to the stated polarity and potential. In this fur brush charging, too, its charging mechanism may predominantly be governed by the above (1) discharge charging mechanism.

For the fur brush charging assembly, a fixed type and a roll type have been put into practical use. One in which medium-resistance fibers formed in a folded pile on a base cloth have been bonded to an electrode is the fixed type. The roll type is formed by winding pile around a mandrel. Those having a fiber density of about 100 fibers/mm$^2$ are obtained relatively with ease, but are still insufficient for contact performance in order to perform well uniform charging by direct-injection charging. In order to perform well uniform charging by direct-injection charging, the fur brush charging assembly must be made to have a velocity differential from that of the photosensitive member; the difference being so large as to make machine construction difficult. This is not realistic.

Charge characteristics of this fur brush charging at the time of application of DC voltage are as shown by B in FIG. 1. Hence, in the case of fur brush charging, too, in both the fixed type and the roll type, the charging is performed under application of a high charging bias voltage in many cases to utilize a phenomenon of discharging.

In contrast to these, the magnetic-brush charging is one in which, using as a contact charging member a member having a magnetic-brush portion (a magnetic-brush charging assembly) formed by confining conductive magnetic particles magnetically by means of a magnet roll, the magnetic-brush portion is brought into contact with a photosensitive member as the charging object, and a stated charging bias is applied to charge the surface of the photosensitive member electrostatically to the stated polarity and potential. In the case of this magnetic-brush charging, its charging mechanism is predominantly governed by the above (2) direct-injection charging mechanism.

As the conductive magnetic particles of which the magnetic-brush portion is constituted, those having particle diameter of from 5 $\mu$m to 50 $\mu$m may be used, and a sufficient velocity differential from that of the photosensitive member may be provided, whereby almost uniform direct-injection charging can be performed.

Charge characteristics of the magnetic-brush charging at the time of application of DC voltage are shown by C in FIG. 1. As shown in FIG. 1, it is possible to attain a charge potential substantially proportional to the applied bias voltage.

The magnetic-brush charging, however, may also cause a difficulty that the conductive magnetic particles constituting the magnetic-brush portion come off to adhere to the photosensitive member. Thus, it is sought to provide an assembly for simple, stable and uniform charging, which can be operated by the direct-injection charging mechanism causing substantially no discharge products such as ozone and achievable of uniform charging at a low applied voltage.

Especially in recent years, from the viewpoint of resource saving and waste reduction and in the sense of effective utilization of toners (developers), an image-forming method which does not bring any transfer residual toner, i.e., waste toner is desired. In the past, in general, after a latent image has been developed with a toner into a visible image (toner image) and the toner image has been transferred to a recording medium such as paper, the toner having remained on the latent-image-bearing member without being transferred to the recording medium is removed by a cleaning means (cleaner), and is transported and put away as waste toner into a waste toner container. Through such a cleaning step, the step of forming images is repeated. Such an image-forming apparatus has been in side used.

In this cleaning step, blade cleaning, fur brush cleaning, roller cleaning and so forth have conventionally been used. Any of these methods are those in which the transfer residual toner is mechanically scraped off or is dammed up and then transported to the waste toner container. Accordingly, with a growing tendency toward resource saving and environmental conservation, it is being demanded to establish the system of reusing or disposing of the waste toner after the waste toner stored in the waste toner container has been collected. Meanwhile what is called the toner reuse, in which the toner collected at the cleaning step is circulated into the developing assembly and reused, has been put into practical use, in which, after a latent image on a latent-image-bearing member is developed with a toner to form a toner image as a visible image and the toner image is transferred to a recording medium such as paper, any toner having remained on the latent-image-bearing member without being transferred to the recording medium is removed by cleaning by various methods, and this toner is circulated into a developing assembly and reused. There, however, has been a problem that pressing a cleaning member against the latent-image-bearing member surface causes the latent-image-bearing member to wear to make the latent-image-bearing member have a short lifetime. Also, when viewed from the standpoint of apparatus, the image-forming apparatus must be made larger in size in order to provide such a toner reuse assembly and a cleaning assembly. This has been a bottleneck in attempts to make apparatus compact.

As a countermeasure therefor, as a system which does not bring any waste toner, also proposed is a technique called a cleaning-at-development or cleanerless system. Conventional techniques concerning the cleaning-at-development or cleanerless system are, as disclosed in Japanese Patent Application Laid-Open No. 5-2287, focused on positive memory or negative memory appearing on images because of an influence of the transfer residual toner on images. However, in these days where electrophotography is utilized on and on, it has become necessary to transfer toner images to various recording mediums. In this sense, such techniques have not been satisfactory for various recording mediums.

The related art having disclosed techniques concerning the cleanerless system is seen in Japanese Patent Applications Laid-Open No. 59-133573, No. 62-203182, 63-133179, No. 64-20587, No. 2-302772, No. 5-2289, No. 5-53482 and No. 5-61383. These, however, neither mention any desirable image-forming methods nor refer to how the toner be constituted.

As developing systems in which the cleaning-at-development or cleanerless system is preferably applied, having basically no cleaning assembly, it has ever been considered essential for the system to be so made up that the latent-image-bearing member surface is rubbed with the toner and toner-carrying member. Accordingly, studies have largely been made on contact developing systems in which the toner or developer comes into contact with an latent-image-bearing member. This is because, in order to collect the transfer residual toner in a developing means, it is considered advantageous for the system to be so made up that the toner or developer comes into contact with and rub the latent-image-bearing member. However, in the cleaning-at-development or cleanerless process making use of a contact development system, its long-term service tends to cause deterioration of toner, deterioration of toner-carrying member surface and deterioration or wear of latent-image-bearing member surface, but any satisfactory solution has not been made for running performance. Accordingly, it has been sought to provide a cleaning-at-development system according to a non-contact developing system.

Here, think about an instance in which the contact charging method is applied in the cleaning-at-development method or cleanerless image-forming method. In the cleaning-at-development method or cleanerless image-forming method, any cleaning member is used, and hence the transfer residual toner left remaining on the latent-image-bearing member comes into contact with the contact charging member as it is, and adhere to or migrate into this contact charging member. Also, in the case of the charging method predominantly governed by the discharge charging mechanism, the transfer residual toner may come to greatly adhere to the contact charging member because of any toner deterioration due to discharge energy. Where any insulating toner commonly used has adhered to or migrated into the contact charging member, a lowering of charging performance may occur.

In the case of the charging system predominantly governed by the discharge charging mechanism, this lowering of charging performance may occur abruptly around the time when a toner layer having adhered to the contact charging member surface comes to have a resistance which may obstruct the discharge voltage. On the other hand, in the case of the charging system predominantly governed by the direct-injection charging mechanism, the uniform charging performance on the charging object member may lower where the transfer residual toner having adhered to or migrated into the contact charging member has lowered the probability of contact between the contact charging member surface and the charging object member.

This lowering of uniform charging performance on the charging object member may lower the contrast and uniformity of electrostatic latent images after imagewise exposure to cause difficulties such as a decrease in image density and an increase in fog. occur seriously.

In this cleaning-at-development system or cleanerless image-forming method, the point is that the charge polarity and charge quantity of the transfer residual toner on the photosensitive member is controlled so that the transfer residual toner can stably be collected in the step of development and the collected toner may not make the developing performance poor. Accordingly, the charge polarity and charge quantity of the transfer residual toner on the photosensitive member is controlled by means of the charging member. This will be described specifically taking the case of a commonly available laser beam printer.

In the case of reverse development making use of a charging member for applying a voltage with negative polarity, a negatively chargeable photosensitive member and a negatively chargeable toner, in the transfer step thereof the image rendered visible is transferred to the recording medium by means of a transfer member to which a voltage with positive polarity is applied. The charge polarity of the transfer residual toner varies from positive to negative depending on, for example, the relation between kinds of recording mediums (differences in thickness, resistance, dielectric constant and so forth) and the areas of images. However, when the photosensitive member is charged with the charging member having a negative polarity, the charge polarity of the transfer residual toner can uniformly be adjusted to the negative side together with the photosensitive member surface even if the polarity of the transfer residual toner has been shifted to the positive side in the transfer step. Hence, when the reversal development is employed as the developing system, the transfer residual toner, which stands negatively charged, remains at light-area potential areas to be developed by toner. On the other hand, the toner present at dark-area potential areas not to be developed by toner is attracted toward the toner carrying member in relation to the development electric field and is collected without remaining on the photosensitive member having a dark-area potential. That is, the cleaning-at-development or cleanerless image-forming method can be established by controlling the charge polarity of transfer residual toner simultaneously with the charging of the photosensitive member by means of the charging member.

However, where the transfer residual toner has adhered to or migrated into the contact charging member beyond the contact charging member's capacity to control toner's charge polarity, it becomes impossible to uniformly adjust the charge polarity of the transfer residual toner, making it difficult to collect the toner in the step of development. Also, even where the transfer residual toner has been collected on the toner-carrying member by mechanical force such as rubbing, the transfer residual toner may adversely affect the triboelectric chargeability of toner on the toner-carrying member, resulting in a lowering of developing performance, unless the charge of the transfer residual toner has not uniformly been adjusted. More specifically, in the cleaning-at-development or cleanerless image-forming method, the charge control performance at the time the transfer residual toner passes the charging member and the manner in which the transfer residual toner adheres to or migrates into the charging member are closely concerned with the running performance and image quality characteristics.

In the cleaning-at-development image-forming method, cleaning-at-development performance can be improved by improving charge control performance required when the transfer residual toner passes the charging member. As a proposal therefor, Japanese Patent Application Laid-Open No. 11-15206 discloses an image-forming method making use of a toner having toner particles containing specific carbon black and a specific azo type iron compound and having inorganic fine powder. It is also proposed, in the cleaning-at-development image-forming method, to improve cleaning-at-development performance by reducing the quantity of transfer residual toner, using a toner having a superior transfer efficiency the shape factors of which have been specified. However, the contact charging used here also applies the discharge charging mechanism, which is not the direct injection charging mechanism, and has the above problem ascribable to the discharge charging. Moreover, these proposals may be effective for keeping the charging performance of the contact charging member from lowering because of the transfer residual toner, but can not be expected to be effective for actively improving the charging performance.

In addition, among commercially available electrophotographic printers, cleaning-at-development image-forming apparatus are also available in which a roller member coming into contact with the photosensitive member is provided between the transfer step and the charging step so that the performance of collecting the transfer residual toner at development can be assisted or controlled. Such image-forming apparatus have good cleaning-at-development performance and the waste toner can sharply be reduced, but involve a high cost and may damage the advantage inherent in the cleaning-at-development system also in view of compact construction.

In order to prevent uneven charging to effect stable and uniform charging, the contact charging member may be coated with a powder on its surface coming into contact with the surface of the member to be charged. Such constitution is disclosed in Japanese Patent Publication No. 7-99442. However, the contact charging member (charging roller) is so constructed as to be follow-up rotated as the charging object member (photosensitive member) is rotated (without no velocity differential drive), and hence may remarkably less cause ozone products compared with corona charging assemblies such as Scorotron. However, the principle of charging is still chiefly the discharge charging mechanism like the case of the roller charging described previously. In particular, a voltage formed by superimposing AC voltage on DC voltage is applied in order to attain more stable charging uniformity, and hence the ozone products caused by discharging may more greatly occur. Accordingly, when the apparatus is used over a long period of time, difficulties such as smeared images due to ozone products tend to come out. Moreover, when the above construction is applied in cleanerless image-forming apparatus, any inclusion of the transfer residual toner makes it difficult for the powder coated, to stand adhered uniformly to the charging member, so that the effect of carrying out uniform charging may lower.

Japanese Patent Application Laid-Open No. 5-150539 also discloses that, in an image-forming method making use of contact charging, at least image-developing particles and conductive fine particles having an average particle diameter smaller than that of the image-developing particles are contained in a toner in order to prevent any charging obstruction which may be caused when toner particles or silica particles having not completely be removed by blade cleaning come to adhere to and accumulate on the surface of the charging means during repetition of image formation for a long time. However, the contact charging used here, or proximity charging, applies the discharge charging mechanism, which is not the direct injection charging mechanism, and has the above problem ascribable to the discharge charging. Moreover, when this construction is applied in the cleanerless image-forming apparatus, nothing is taking into consideration about any of the influence on charging performance that is exercised when the conductive fine particles and transfer residual toner pass the charging step in a larger quantity than the apparatus having a cleaning mechanism, the influence on the collection of these large-quantity conductive fine particles and transfer residual toner in the developing step, and the influence on developer's developing performance that is exercised by the conductive fine particles and transfer residual toner thus collected. Furthermore, when the direct injection charging mechanism is applied in the contact charging, the conductive fine particles can not be fed to the contact charging member in necessary quantity to cause faulty charging due to the influence of the transfer residual toner.

In the proximity charging, it is also difficult to uniformly charge the photosensitive member because of the large-quantity conductive fine particles and transfer residual toner, and the effect of leveling patterns of the transfer residual toner can not be obtained, to cause pattern ghost because the transfer residual toner may shut out pattern-imagewise exposure light. In-machine contamination due to developer may further occur when a power source is instantaneously turned off or paper jam occurs during image formation.

As countermeasures for these, Japanese Patent Application Laid-Open No. 10-307456 discloses an image-forming apparatus in which a developer containing toner particles and conductive charge-accelerating particles having particle diameter which is ½ or less of the particle diameter of toner is applied in a cleaning-at-development image-forming method making use of the direct injection charging mechanism. According to this proposal, a cleaning-at-development image-forming apparatus can be obtained which can sharply reduce the quantity of waste toner and is advantageous for making the apparatus compact at a low cost, and good images are obtainable without causing any faulty charging and any shut-out or scattering of imagewise exposure light. It, however, is sought to make further improvement.

Japanese Patent Application Laid-Open No. 10-307421 also discloses an image-forming apparatus in which a developer containing conductive particles having particle diameter which is 1/50 to ½ of the particle diameter of the toner is applied in a cleaning-at-development image-forming method making use of the direct injection charging mechanism and the conductive particles are made to have a transfer accelerating effect.

Japanese Patent Application Laid-Open No. 10-307455 still also discloses that, a conductive fine powder is controlled to have particle diameter not larger than the size of one pixel of constituent pixels, and the conductive fine powder is controlled to have particle diameter of from 10 nm to 50 $\mu$m in order to attain better charging uniformity.

Japanese Patent Application Laid-Open No. 10-307457 discloses that, taking account of the characteristics of human visual sensation, conductive fine particles are controlled to have particle diameter of about 5 $\mu$m or less, and preferably from 20 nm to 5 $\mu$m, in order to make any influence of faulty charging on images visually recognizable with difficulty.

Japanese Patent Application Laid-Open No. 10-307458 also discloses that a conductive fine powder is controlled to have particle diameter not larger than the particle diameter of a toner to thereby prevent the conductive fine powder from obstructing the development by the toner at the time of development or prevent development bias from leaking through the conductive fine powder. At the same time, it discloses a cleaning-at-development image-forming method which makes use of the direct injection charging mechanism and in which the conductive fine powder is controlled to have particle diameter larger than 0.1 $\mu$m to thereby eliminate a difficulty that the conductive fine powder may become buried in the image-bearing member to shut out imagewise exposure light, thus superior image recording can be materialized. It, however, is sought to make further improvement.

Japanese Patent Application Laid-Open No. 10-307456 discloses a cleaning-at-development image-forming apparatus in which a conductive fine powder is externally added to toner particles so that the conductive fine powder contained in the toner may adhere to an image-bearing member in the step of development, at least at a contact zone between a flexible contact charging member and the image-bearing member, and may remain and be carried on the image-bearing member also after the step of transfer so as to stand between them, to thereby obtain good images without causing neither faulty charging nor shut-off of imagewise exposure light. In this proposal, however, there is room for further improvement in stable performances required when the apparatus are repeatedly used over a long period of time and in performances required when toner particles having a small particle diameter are used in order to achieve a higher resolution.

External addition of conductive particles whose average particle diameter has been specified is also proposed. For example, in Japanese Patent Application Laid-Open No. 9-146293, a toner is proposed in which a fine powder A with an average particle diameter of from 5 nm to 50 nm and a fine powder B with an average particle diameter of from 0.1 μm to 3 μm are used as external additives, and have been made to adhere to toner base particles with particle diameters of from 4 μm to 12 μm, more strongly than a specified extent. This intends to make small the proportion of fine powder B standing liberated and those coming off the toner base particles. In Japanese Patent Application Laid-Open No. 11-95479, also proposed is a toner containing conductive silica particles whose particle diameter has been specified and an inorganic oxide having been made hydrophobic. This is nothing but what aims at the action attributable to the conductive silica particles by which action any electric charges accumulated in the toner in excess are leaked to the outside.

Many proposals are also made in which the particle size distribution and particle shape of toners have been specified. In recent years, as disclosed in Japanese Patent No. 2862827, there is a proposal in which particle size distribution and circularity measured with a flow type particle image analyzer have been specified. As proposals in which the particle size distribution and particle shape of toners have been specified taking account of any influence of external additives, for example, Japanese Patent Application Laid-Open No. 11-174731 discloses a toner having an inorganic fine powder A of 10 nm to 400 nm in average length the circularity of which has been specified and a non-spherical inorganic fine powder B. This proposal intends to keep the inorganic fine powder A from being buried in toner base particles in virtue of the spacer effect attributable to the non-spherical inorganic fine powder B. In Japanese Patent Application Laid-Open No. 11-202557, too, a proposal is made on specifying the particle size distribution and circularity of toners. This proposal is aimed at prevention of a trailing phenomenon by making the density high in respect of toner particles which have participated in development as a toner image, and at improvement in the storage stability of toners in an environment of high temperature and high humidity.

In Japanese Patent Application Laid-Open No. 11-194530, a toner is further proposed which has an external-additive fine powder A with particle diameter of from 0.6 μm to 4 μm and an inorganic fine powder B and whose particle size distribution has been specified. This intends to prevent the toner from deteriorating because of any inorganic fine powder B buried in toner base particles, in virtue of the presence of the external-additive fine powder A between them. Thus, nothing is taken into account in respect of any adhesion of the external-additive fine powder A to, or liberation from, the toner base particles. In Japanese Patent Application Laid-Open No. 10-83096, proposed is a toner comprising spherical resin particles in which a colorant has been enclosed and to the particle surfaces of which fine silica particles have been added. This intends to endow toner particle surfaces with conductivity to enable swift movement and exchange of electric charges across the toner particles and to improve the uniformity of triboelectric charging of the toner.

Meanwhile, approach has also been made from developers in order to establish the image-forming method having the step of injection charging, the cleaning-at-development image-forming method or the cleanerless image-forming method, i.e., in order to impart optimum electric charges to the developers (toners).

Conventionally, in image-forming apparatus of an electrophotographic system for example, an electrostatic latent image is formed on a latent-image-bearing member comprising an electrophotographic photosensitive member, and the latent image is developed by means of a developing assembly. The developing assembly has a developing sleeve serving as a developer-carrying member on which the developer is held and transported.

The surface of this developing sleeve is made to have a rough surface with unevenness (hills and dales) for the sake of its performance of transporting the developer (transport performance). Formerly, as disclosed in Japanese Patent Application Laid-Open No. 54-79043 for example, knurl grooves chiefly in respect of developing sleeves for two-component developers and, as disclosed in Japanese Patent Application Laid-Open No. 55-26526, blast treatment chiefly in respect of developing sleeves for one-component developers are known in the art.

In the case of blast-treated developing sleeves, the surface unevenness tends to become worn and lessen as a result of long-time service. Accordingly, in order to prevent it, a high-hardness material such as SUS stainless steel (Vickers hardness: about 180) is often used as a material for developing sleeves. Formerly, alundum blasting making use of alumina particles as blasting abrasive grains is also known (Japanese Patent Application Laid-Open No. 57-66455).

However, as disclosed in Japanese Patent Applications Laid-Open No. 57-116372, No. 58-11974 and No. 1-131586, in the blasting making use of alundum, rough surface with sharp unevenness is formed at the developing sleeve surface made of SUS stainless steel. FIG. 2 diagrammatically shows a roughness profile curve of a developing sleeve surface having been subjected to alundum blast treatment. It is known that, during its long-term service, toner particles and so forth having especially fine particle size are buried in sharp valleys of this surface (hereinafter this state in which the toner particles and so forth are buried is called "sleeve contamination") and the charging of toner is obstructed at that part to cause faulty images.

For example, a method is designed in which the blast treatment is made using spherical particles such as glass beads. FIG. 3 diagrammatically shows a like roughness profile curve obtained in the glass beads blast treatment. As shown in FIG. 3, according to the glass beads blast treatment, rough surface with a gentle profile form can be obtained at the surface of the developing sleeve made of SUS stainless steel. Thus, the sleeve contamination can be lessened, though not sufficient, to a certain level.

It is becoming prevailing to use aluminum as a material for developing sleeves. Although the SUS stainless steel is expensive, there is an advantage that the use of aluminum enables cost reduction of developing sleeves.

However, the aluminum sleeve has a hardness as low as Hv of about 100, and hence the surface unevenness may easily become worn as a result of use, so that the unevenness may lessen at an early stage.

In more recent years, in order to achieve a higher image quality, there is a tendency of making toners have much smaller particle diameter. This has proved to tend to cause the sleeve contamination much more than ever.

This is explained with reference to FIG. 4. FIG. 4 is an enlarge view of the unevenness corresponding to the roughness profile curve shown in FIG. 3. FIG. 3 shows, as described above, a roughness profile curve obtained when the surface of the SUS stainless-steel developing sleeve is subjected to the blast treatment with spherical-particle glass beads. In the profile shown in FIG. 4, in the case of toners with a large particle diameter, any particles do not enter any cracks in large hills and dales in the roughness profile curve, namely, do not enter small valleys as exemplified by valleys a, b and c. However, with an decrease in particle diameter of the toner, toner particles entering the small valleys a, b and c may increase to cause sleeve contamination, as so considered.

For example, small-diameter toner particles having a particle size distribution of about 7 $\mu$m in volume-average particle diameter commonly contain about from 15% by number to about 20% by number of small toner particles having particle diameter of 4 $\mu$m or less. Such particles enter the small valleys a, b and c. Of course, any finer powder in toner may be cut away in order to lessen smaller toner particles, but it is impossible under the existing conditions to remove them completely.

As stated previously, even without making toners have smaller particle diameter, charge obstruction on toner also tends to occur because of even a slight sleeve contamination when toners having a low chargeability are used, bringing about difficulties such as density loss.

In another case of a developer to which an external additive having the same triboelectric series as its toner has been added, what is called "sleeve ghost", which is a history of print patterns, may appear on the developing sleeve, and this may also appear on printed images. This sleeve ghost has a tendency that, the higher charging performance the external additive has, the more easily it appears. For example, a sleeve ghost which may appear in the case of a developer obtained by adding negatively chargeable fine particles externally to a negatively chargeable toner turns a positive ghost. More specifically, density variation (unevenness) occurs between the part (X) where only thin development is performed because unprinted areas (white background) had continued and the part (Y) where thick development is performed because the printing had been continued.

Think about the mechanism of how this sleeve ghost forms. In the developing step, the toner charged anew electrostatically is fed to areas where the developer (toner) has been consumed on the developer-carrying member (developing sleeve), and the next development is performed there. At this stage, charge quantity differs between the toner remaining on the developing sleeve without being consumed and the toner fed anew. The toner having higher charge quantity has a higher ability to fly to the electrostatic latent image on the latent-image-bearing member, but at the same time shows a tendency of being electrostatically strongly bound to the developing sleeve because of the mirror force acting between the toner and the developing sleeve. Thus, the ability of development depends on the balance between the ability to fly and the mirror force.

This sleeve ghost is also deeply concerned in a layer which is formed by a fine powder contained in the toner present on the developing sleeve and an external additive added externally to the toner. Namely, the reason is that the toner which forms the lowermost layer of the toner layer on the developing sleeve come to differ clearly in particle size distribution between the toner-consumed areas and the toner-unconsumed areas, so that a fine-powder layer which is formed by the fine powder contained in the toner present on the developing sleeve and the external additive added externally to the toner is formed at the lowermost layer of the toner present at the toner-unconsumed areas. The particles which form this fine-powder layer have a large surface area per volume, and hence, compared with the toner having large particle diameter, have a large quantity of triboelectrically generated electric charges per unit weight, so that such particles are electrostatically strongly bound to the developing sleeve because of their own mirror force. Hence, the toner present above the part where this fine-powder layer has been formed comes to have a low developability because it is not sufficiently triboelectrically charged with the developing sleeve surface, so that this may appear as the sleeve ghost on images.

In general, when the toner anew charged electrostatically and fed to the toner-consumed areas has a higher developability than the toner remaining on the developing sleeve without being consumed, the above positive ghost appears. On the contrary, when the toner anew charged electrostatically and fed to the toner-consumed areas has a lower developability than the toner present at other areas, a negative ghost appears, contrary to what is shown in FIG. 5, such that the areas at which the toner has been replaced because the printing had been continued come to have a lower density than the areas at which any toner has not been replaced because the unprinted areas (white background) had continued.

The sleeve ghost explained above is a phenomenon which occurs because the charging of the toner greatly depends on the triboelectric charging with the developing sleeve, together with the formation of the fine-powder layer comprised of the fine powder contained in the toner and the external additive added externally to the toner. Accordingly, in order to solve the problem of sleeve ghost, the mirror force acting between the developing sleeve and the charged-up fine-powder toner present in the vicinity of the developing sleeve surface must be removed or be made smaller by any means.

Besides the above phenomenon of sleeve ghost, a problem may arise such that areas having a low density occur in vertical lines on images obtained by development. More specifically, this is a phenomenon that character lines become slender in the case of character images, and density becomes low in the case of halftone images and solid black images.

This phenomenon is called "fading". We have observed the developing sleeve on the occasion that this fading has occurred, to find that a toner layer with a uniform thickness has been formed on the sleeve. However, upon measurement of the quantity of triboelectrically generated electric charges of the toner on the sleeve, it has been ascertained that the quantity of electric charges of the toner at the region corresponding to the low-density vertical lines in images has a lower value than a normal value.

The reason why the charge quantity of the toner lowers partly as described above is presumed as follows: copied images or image output patterns are not necessarily uniform in image planes, so that areas where the toner is consumed in a large quantity and areas where it is consumed in a small quantity may come. Of these, at the areas where the toner is consumed in a small quantity, the toner is replaced in a relatively small quantity. Hence, the circulation of the toner in the vicinity of the developing sleeve at the corresponding areas is obstructed, so that the toner comes to be packed in the vicinity of the sleeve. Then, in this state the toner is rubbed with the sleeve surface, where the toner particles may deteriorate to become unable to be triboelectrically charged in a normal condition. As the result, continuing copying or printing in this state accelerates the deterioration of the toner to cause a decrease in density (density loss) at such areas.

The low charged toner also passes through the developer layer thickness regulation zone, as a layer having a thickness equal to that of the normally charged toner layer, by the force of friction with the sleeve. Hence, the thickness of the toner layer is uniform on the sleeve.

The smaller the toner particle diameter is, the more the fading is liable to occur. This is due to the fact that a fine-particle toner is highly agglomerative. More specifically, this is because the fine-particle toner has small particle diameter, and, compared with toners having usual particle diameter, has so large a surface area as to be triboelectrically charged in excess, to cause a decrease in fluidity of the toner as a result of electrostatic agglomeration. Moreover, the external additive standing adhered to toner particles and the vicinity thereof also has a great influence. Accordingly, care must be taken when any particles that may obstruct the fluidity of toner or particles that may greatly change the charge quantity of toner are added.

The fading may also remarkably occur not only in a low-humidity environment in which the decrease in fluidity due to the electrostatic agglomeration of toner is accelerated, but also in a normal-temperature and normal-humidity environment or in a high-temperature and high-humidity environment in which the chargeability of toner lowers.

Thus, although approach has been made from both developers (toners) and developer-carrying members in order to establish the image-forming method having the step of injection charging, the cleaning-at-development image-forming method or the cleanerless image-forming method, any proposal has not been made until now in respect of a system in which the problems having been discussed above have all been solved. Under existing circumstances, studies have not yet sufficiently been made.

SUMMARY OF THE INVENTION

An object of the present invention is to provide a developing assembly, a process cartridge and an image-forming method which have solved the problems discussed above and can realize good developing performance.

Another object of the present invention is to provide a developing assembly, a process cartridge and an image-forming method which enable electrostatic latent images to be faithfully developed to achieve good image characteristics, without causing any sleeve ghost.

Another object of the present invention is to provide a developing assembly, a process cartridge and an image-forming method which enable high-density images to be formed without causing any fading in every environment.

Still another object of the present invention is to provide an image-forming method which enables simple, stable and uniform charging by the direct-injection charging mechanism bringing about substantially no discharge products such as ozone and achievable of uniform charging at a low applied voltage; and a developing assembly and a process cartridge which are used in such an image-forming method.

A further object of the present invention is to provide an image-forming method which enables sharp reduction of the quantity of waste toner and enables cleaning-at-development advantageous for low cost and miniaturization; and a developing assembly and a process cartridge which are used in such an image-forming method.

A still further object of the present invention is to provide an image-forming method which enables simple, stable and uniform charging by the direct-injection charging mechanism causing substantially no discharge products such as ozone and achievable of uniform charging at a low applied voltage, and also enables formation of good images without causing any faulty charging even in repeated use over a long period of time; and a developing assembly and a process cartridge which are used in such an image-forming method.

A still further object of the present invention is to provide an image-forming method which enables cleanerless image formation not requiring any independent cleaning step, which can achieve good and uniform charging performance stably; and a developing assembly and a process cartridge which are used in such an image-forming method.

A still further object of the present invention is to provide an image-forming method which enables cleaning-at-development having superior collection performance on transfer residual toner particles; and a developing assembly and a process cartridge which are used in such an image-forming method.

A still further object of the present invention is to provide an image-forming method which enables stable formation of good images even when toner particles having smaller particle diameter are used in order to improve resolution; and a developing assembly and a process cartridge which are used in such an image-forming method.

To achieve the above objects, the present invention provides a developing assembly comprising a developing container holding therein a developer, a developer-carrying member for holding thereon the developer held in the developing container and transporting the developer to a developing zone, and a developer layer thickness regulation member for regulating the layer thickness of the developer held on the developer-carrying member;

the developer comprising toner particles containing at least a binder resin and a colorant, and conductive fine particles; and the developer-carrying member having a substrate and a surface layer formed on the substrate; the surface layer being formed of a material selected from the group consisting of a non-magnetic metal, an alloy and a metallic compound.

The present invention also provides a process cartridge comprising a latent-image-bearing member for holding thereon an electrostatic latent image, a charging means for charging the latent-image-bearing member, and a developing assembly for developing the electrostatic latent image formed on the latent-image-bearing member with a developer to form a developer image;

the developing assembly and the latent-image-bearing member being integrally set as one unit detachably mountable on the main body of an image-forming apparatus;

the developer comprising toner particles containing at least a binder resin and a colorant, and conductive fine particles;

the developing assembly having at least a developing container for holding therein the developer, a developer-carrying member for holding thereon the developer held in the developing container and transporting the developer to a developing zone, and a developer layer thickness regulation member for regulating the layer thickness of the developer to be held on the developer-carrying member; and the developer-carrying member having a substrate and a surface layer formed on the substrate; the surface layer being formed of a material selected from the group consisting of a non-magnetic metal, an alloy and a metallic compound.

The present invention still also provides an image-forming method comprising:

a charging step of charging a latent-image-bearing member;

a latent-image-forming step of forming an electrostatic latent image on the charged surface of the latent-image-bearing member having been charged in the charging step;

a developing step of developing the electrostatic latent image to render it visible as a developer image by means of a developing assembly having a developer-carrying member which holds and transports a developer to a developing zone facing the latent-image-bearing member;

a transfer step of transferring the developer image to a transfer medium; and a fixing step of fixing the developer image transferred to the transfer medium by the use of a fixing means;

these steps being sequentially repeated to form images;

the developer comprising toner particles containing at least a binder resin and a colorant, and conductive fine particles; and the developer-carrying member having a substrate and a surface layer formed on the substrate; the surface layer being formed of a material selected from the group consisting of a non-magnetic metal, an alloy and a metallic compound.

DETAILED DESCRIPTION OF THE PREFERRED EMBODIMENTS

The developing assembly of the present invention may preferably be used in an image-forming apparatus for carrying out contact charging, and particularly preferably an image-forming apparatus having a direct-injection charging mechanism, which carries out an image-forming method having at least:

a charging step of charging a latent-image-bearing member;

a latent-image-forming step of forming an electrostatic latent image on the charged surface of the latent-image-bearing member having been charged in the charging step;

a developing step of developing the electrostatic latent image to render it visible as a developer image by means of a developing assembly provided with a developer-carrying member which holds thereon a developer and transports the developer to a developing zone opposite to the latent-image-bearing member;

a transfer step of transferring the developer image to a transfer medium; and a fixing step of fixing the developer image transferred to the transfer medium by the use of a fixing means;

these steps being sequentially repeated to form images; and the charging step being the step of charging the latent-image-bearing member by applying a voltage to a charging means in a state that the conductive fine particles contained in the developer are interposed at least at the contact zone between the charging means and the latent-image-bearing member.

The developing assembly of the present invention may also preferably be used in an image-forming apparatus for carrying out cleaning-at-development, which carries out an image-forming method having at least:

a charging step of charging a latent-image-bearing member;

a latent-image-forming step of forming an electrostatic latent image on the charged surface of the latent-image-bearing member having been charged in the charging step;

a developing step of developing the electrostatic latent image to render it visible as a developer image by means of a developing assembly provided with a developer-carrying member which holds thereon a developer and transports the developer to a developing zone opposite to the latent-image-bearing member;

a transfer step of transferring the developer image to a transfer medium; and a fixing step of fixing the developer image transferred to the transfer medium by the use of a fixing means;

these steps being sequentially repeated to form images; and the developing step being the step of rendering the electrostatic latent image visible, and at the same time collecting the developer remaining on the latent-image-bearing member after the developer image has been transferred to a recording medium.

The developing assembly of the present invention is characterized by using a developer-carrying member having a layer formed of a non-magnetic metal, an alloy or a metallic compound.

A developer-carrying member is described below which may preferably be used in the developing assembly, process cartridge and image-forming method of the present invention.

Figure 7:
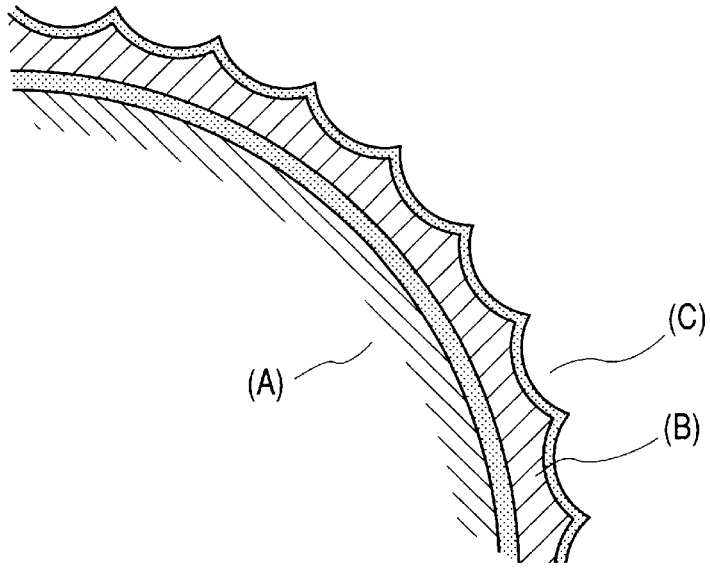
FIG. 7 is a diagrammatic view of a partial cross section of a developer-carrying member having on a substrate a layer formed of a non-magnetic metal, an alloy or a metallic compound.

As an example of the developer-carrying member usable in the present invention, a developing sleeve is shown as a partial view in FIG. 7 and so forth, and how it operates is described below. In FIG. 7, letter symbol (A) denotes a magnet roller (held inside the developing sleeve); (B), a sleeve substrate; and (C), the layer formed of a non-magnetic metal, an alloy or a metallic compound (hereinafter "metallic-coating layer").

Figure 8:
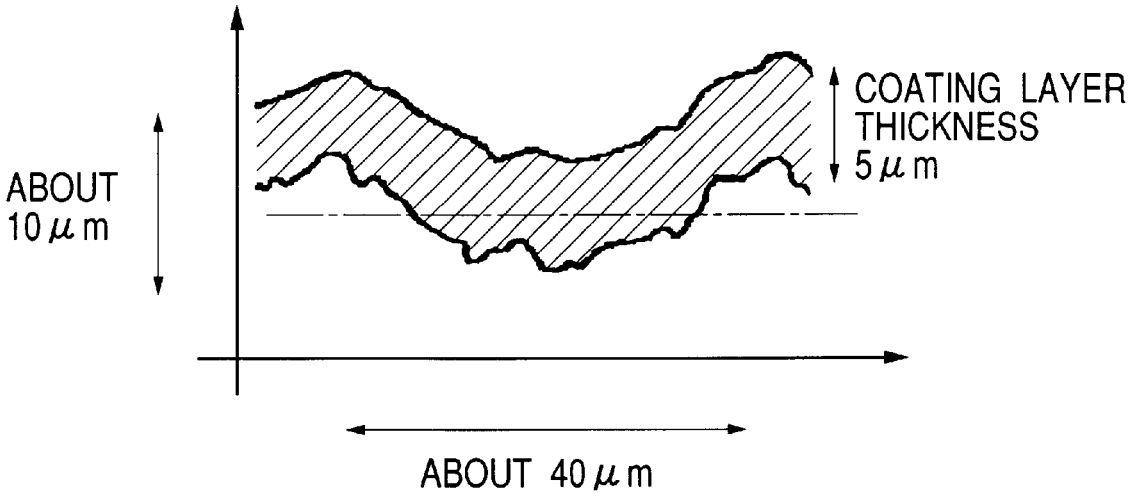
FIG. 8 is a diagrammatic view showing a roughness profile curve of a sleeve surface obtained when a metallic-coating layer is provided on an aluminum sleeve surface having been subjected to glass-beads blast treatment.
Figure 9:
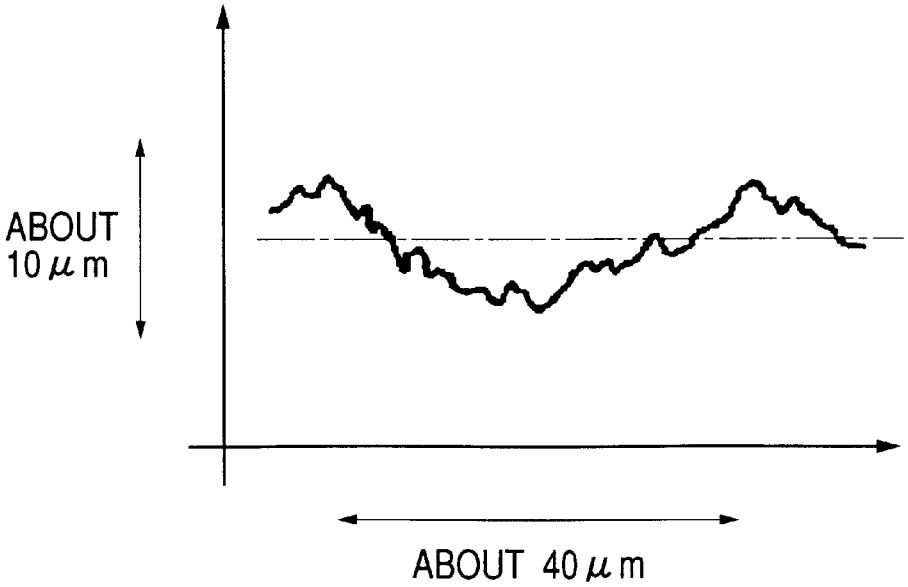
FIG. 9 is a diagrammatic view showing a roughness profile curve of a sleeve surface before the metallic-coating layer is provided on the substrate surface.

FIG. 8 is a diagrammatic view showing a roughness profile curve of a sleeve surface obtained when the metallic-coating layer is provided on an aluminum sleeve surface having been subjected to glass-beads blast treatment (FIG. 9). In the case when the metallic-coating layer is provided, the metallic-coating layer covers the interiors of crayter-shaped dales in a mirror surface form and is so formed as to fill up minute valleys in the crayter-shaped dales. Hence, the effect of preventing sleeve contamination or the like can be brought out.

Observation of the sleeve surface on an optical microscope when the metallic-coating layer is provided after the blast treatment has ascertained that the minute valleys in the crayter-shaped dales have been filled up with the metallic-coating layer.

As stated previously, the sleeve ghost is a phenomenon in which the fine-powder layer which is formed by the fine powder contained in the toner present and the external additive added externally to the toner is formed and the toner present on this layer comes to have a low developability because it is not sufficiently triboelectrically charged with the developing sleeve surface. In particular, such fine powder tends to be accumulated in the minute valleys in the crayter-shaped dales at the sleeve substrate surface, and the fine-powder layer is formed from that part as starting points, so that the sleeve ghost occurs. This has been the problem in conventional developer-carrying members (developing sleeves). However, inasmuch as the minute valleys in the crayter-shaped dales at the surface are filled up with the metallic-coating layer, the level of sleeve ghost can remarkably be improved.

In addition, with regard to the fading caused by a decrease in fluidity due to the partial electrostatic agglomeration of the toner (developer), too, inasmuch as the minute valleys in the crayter-shaped dales at the developing sleeve surface are filled up with the metallic-coating layer, the fine powder of the toner (developer) is no longer accumulated in the minute valleys, and hence the level of fading can also be improved.

In the case when the metallic-coating layer is provided, although the minute valleys in the crayter-shaped dales are no longer present, the metallic-coating layer is formed after the shape of the crayter-shaped dales. Hence, the metallic-coating layer surface can have surface roughness Rz, Ra, average hill-to-hill interval Sm and so forth which do not differ greatly from those of blast-treated substrate surface. Hence, the developer transport performance does not lower.

Especially in the present invention, as will be detailed later a system in which conductive fine particles are added in the developer is employed. The conductive fine particles participate in development together with toner particles and hence are sufficiently fed even to non-image areas on the latent-image-bearing member. Then, the conductive fine particles are actively liberated from the toner particle surfaces in the transfer step. Thus, the conductive fine particles are well efficiently fed to the charging zone through the latent-image-bearing member after transfer so that good contact charging is carried out. Hence, besides the toner fine powder, the conductive fine particles standing liberated are present in a large number in the development system. This enables retention of constantly good developing performance because any phenomenon does not occur such that the developing performance lowers concurrently with accumulation of the fine powder in the minute valleys at the developing sleeve surface.

Making such a metallic-coating layer held uniformly on the substrate surface makes it possible to impart uniform charge to the developer in the lengthwise direction of the developer-carrying member, and good developing performance can be achieved. As methods for forming such a metallic-coating layer on the substrate surface of the developing sleeve, electrolytic plating and electroless plating may preferably be used. In particular, the electroless plating is chemical plating, and hence enables formation of the metallic-coating layer in a good precision without regard to the rough surface due to hills.

Stated specifically, the metallic-coating layer may preferably be formed of a layer comprised of a non-magnetic metal, an alloy or a metallic compound, selected from the group consisting of nickel, chromium, molybdenum and palladium, and may be formed by, e.g., electroless Ni—P plating, electroless Ni—B plating, electroless Pd plating, electroless Pd—P plating, electroless Cr plating, electrolytic Mo plating, electroless Mo plating or the like.

As physical properties of the sleeve surface, the surface may preferably be non-magnetic because the developing sleeve is internally provided with a magnet roll. Accordingly, the metallic-coating layer may preferably have a thickness of from 0.5 $\mu$m to 20 $\mu$m, and more preferably from 3 $\mu$m to 15 $\mu$m. If the metallic-coating layer has a thickness of less than 0.5 $\mu$m, the layer is so thin that the effect attributable to the metallic-coating layer provided may be brought out with difficulty. If on the other hand the metallic-coating layer has a thickness of more than 20 $\mu$m, it may be difficult to keep the thickness of the metallic-coating layer uniform in its lengthwise direction. For example, with regard to the electroless Ni—P plating, Ni is a ferromagnetic material as a single material, but turns amorphous upon its reaction with phosphorus or boron in the electroless plating to come non-magnetic. In the case of the electroless Cr plating, too, the metallic-coating layer can well be used as long as it is 20 $\mu$m or less in thickness because it is not so magnetic as to disturb the magnetic field of the inside magnet.

As the substrate of the developing sleeve, a metallic material having a Vickers hardness (Hv) of from 50 to 200 may be used. If it has an Hv of less than 50, the sleeve may be weak in respect of strength and has a possibility of causing deformation or scrape. If it has an Hv of more than 200, it may be difficult to form the hills and dales uniformly on its surface. As a specific example, it may be made of an aluminum alloy or a copper alloy such as brass. In view of cost, the aluminum alloy is preferred.

The Vickers hardness (Hv) of the developing sleeve after the metallic-coating layer has been provided may differ depending on the material selected. It may be controlled by the temperature set at the time of annealing. As developing sleeves usable in the present invention, those having an Hv of from 200 to 1,000 are preferred. If the developing sleeve has an Hv of less than 200, it is insufficient in respect of strength to tend to cause scratches or scrape of the sleeve surface. Also, in order to make the sleeve have an Hv of more than 1,000, it is difficult to make control in respect of manufacture. As a method of providing a high Hv, a method is available in which the annealing temperature is set higher. However, annealing carried out at a high temperature tends to make the sleeve have a high eccentricity, so that such treatment may adversely affect image density, image quality and so forth.

The substrate surface of the developer-carrying member developing sleeve may preferably be subjected to surface-roughing treatment by spherical particles, and thereafter the layer (metallic-coating layer) comprised of a non-magnetic metal, an alloy or a metallic compound may be formed. This is because the surface-roughing treatment made previously to lessen any minute cracks present at the substrate surface can make the surface after plating have more uniform surface roughness.

The developing sleeve may preferably have a surface roughness of from 0.1 $\mu$m to 3.5 $\mu$m as the arithmetic mean roughness Ra value of the unevenness (hills and dales) of the surface after the layer comprised of a non-magnetic metal, an alloy or a metallic compound has been formed on the substrate. If it has an Ra of less than 0.1 $\mu$m, the developer on the developing sleeve may form an immovable layer on the developing sleeve surface by the action of mirror image force, so that the developer may insufficiently be charged to lower the developing performance to cause faulty images such as unevenness, spots around line images and image density loss. If it has an Ra of more than 3.5 $\mu$m, the developer coat layer on the developing sleeve may insufficiently be regulated, resulting in an insufficient uniformity of images or an image density loss due to insufficient charging. Also, in the present invention, the surface roughness is measured with a surface roughness meter SE-3300H, manufactured by Kosaka Laboratory Ltd., and measured under conditions of a cut-off of 0.8 mm, a specified distance of 8.0 mm and a feed rate of 0.5 mm/s. Measurements at 12 spots are averaged.

The developer usable in the developing assembly, process cartridge and image-forming method of the present invention is described below.

The developer used in the present invention has at least toner particles containing at least a binder resin and a colorant, and conductive fine particles.

The conductive fine particles the developer has move from the developer-carrying member to the latent-image-bearing member in a proper quantity together with the toner particles when the electrostatic latent image formed on the latent-image-bearing member is developed. The developer image formed on the latent-image-bearing member as a result of the development of the electrostatic latent image is transferred to a transfer medium such as paper in the transfer step. Here, the conductive fine particles on the latent-image-bearing member also adhere partly to the transfer medium, but the rest adheres to and is held on the latent-image-bearing member to remain there. In the case of transfer performed under application of a transfer bias with polarity reverse to the charge polarity of the toner particles, the toner particles are attracted to the transfer medium side to come transferred actively. However, the conductive fine particles on the latent-image-bearing member may transfer with difficulty because they are conductive. Hence, the conductive fine particles adhere partly to the transfer medium but the rest adheres to and is held on the latent-image-bearing member to remain there.

In an image-forming method not having any step where the conductive fine particles having adhered to and having been held on the latent-image-bearing member to remain there are removed from the surface of the latent-image-bearing member as in the step of cleaning, the toner particles having remained on the surface of the latent-image-bearing member after the transfer step (hereinafter such toner particles are called "transfer residual toner particles") and the conductive fine particles are carried to the charging zone with movement of the face at which images are held on the latent-image-bearing member (hereinafter this face is called "image-bearing face"). More specifically, where a contact charging member is used in the charging step, the conductive fine particles are carried to the contact zone formed by contact of the latent-image-bearing member with the contact charging member, and adhere to or migrate into the contact charging member. Hence, the contact charging of the latent-image-bearing member is performed in the state the conductive fine particles interpose at the contact zone between the latent-image-bearing member and the contact charging member.

In the present invention, the conductive fine particles are positively (intentionally) carried to the charging part, whereby the contact resistance of the contact charging member can be maintained although the transfer residual toner particles adhere to or migrate into the contact charging member to contaminate it. Hence, the latent-image-bearing member can well be charged by the contact charging member.

Where, however, the conductive fine particles do not stand interposed in a sufficient quantity at the charging zone of the contact charging member, the transfer residual toner particles may adhere to or migrate into the contact charging member to easily cause a low charging of the latent-image-bearing member, to cause image stain.

In addition, since the conductive fine particles positively (intentionally) carried to the contact zone formed by contact of the latent-image-bearing member with the contact charging member can maintain the close contact performance and contact resistance of the contact charging member on the latent-image-bearing member, the direct-injection charging of the latent-image-bearing member can well be performed by the contact charging member.

The transfer residual toner particles having adhered to or migrated into the contact charging member are little by little sent out from the contact charging member onto the latent-image-bearing member to reach the developing zone with movement of the image-bearing face, where the cleaning-at-development is performed in the developing step, i.e., the transfer residual toner particles are collected there. The conductive fine particles having adhered to or migrated into the contact charging member are also likewise little by little sent out from the contact charging member onto the latent-image-bearing member to reach the developing zone with movement of the image-bearing face. That is, the conductive fine particles are present on the latent-image-bearing member together with the transfer residual toner particles, and the transfer residual toner particles are collected in the developing step. Where the collection of transfer residual toner particles in the developing step utilizes a developing bias electric field, the transfer residual toner particles are collected by the aid of the developing bias electric field, whereas the conductive fine particles on the latent-image-bearing member are collected with difficulty because they are conductive. Hence, the conductive fine particles are partly collected but the rest adheres to and is held on the latent-image-bearing member to remain there.

According to studies made by the present inventors, it has been found that the feature that the conductive fine particles collected with difficulty in the developing step are present on the latent-image-bearing member brings about the effect of improving the performance of collecting the transfer residual toner particles. More specifically, the conductive fine particles on the latent-image-bearing member act as an assistant for collecting the transfer residual toner particles present on the latent-image-bearing member, to more ensure the collection of transfer residual toner particles in the developing step, so that image defects such as positive ghost and fog caused by any faulty collection of transfer residual toner particles can effectively be prevented.

In the past, the external addition of conductive fine particles to developers has mostly been intended to control the triboelectric chargeability of toner by making conductive fine particles adhere to toner particle surfaces. Conductive fine particles liberated from or coming off the toner particles have been dealt as a difficulty which causes change or deterioration of developer characteristics. In contrast thereto, the developer of the present invention makes the conductive fine particles liberated positively (intentionally) from the toner particle surfaces. In this point, it differs from the external addition of conductive fine particles to developers, which has conventionally been studied in a great deal. Via the latent-image-bearing member surface after transfer, the conductive fine particles are carried to and come interposed at the charging zone which is the contact zone formed by contact of the latent-image-bearing member with the contact charging member, whereby the charging performance on the latent-image-bearing member is actively improved so that stable, even and uniform charging can be performed and any faulty images can be prevented from being caused by a low charging of the latent-image-bearing member. Also, since the conductive fine particles are present on the latent-image-bearing member in the developing step, the conductive fine particles act as an assistant for collecting the transfer residual toner particles present on the latent-image-bearing member, to more ensure the collection of transfer residual toner particles in the developing step, so that image defects such as positive ghost and fog caused by any faulty collection of transfer residual toner particles can effectively be prevented.

In the developer used in the present invention, the conductive fine particles which adhere to toner particle surfaces to behave together with the toner particles may less contribute to the promotion of charging of the latent-image-bearing member and the improvement in cleaning-at-development performance the developer in the present invention can bring out as its effect, so that the quantity of transfer residual toner particles may increase because of a lowering of the developing performance of toner particles, a lowering of the collection performance on the transfer residual toner particles in the cleaning-at-development step and lowering of the transfer performance. This may cause a difficulty that the uniform charging is obstructed.

The conductive fine particles contained in the developer in the present invention move to the image-bearing face via the charging step and developing step with repetition of image formation, and are further carried again to the charging zone via the transfer step with movement of the image-bearing face. Thus, the conductive fine particles continue being successively fed to the charging zone. Accordingly, the conductive fine particles continue being successively fed to the charging zone even where the conductive fine particles have decreased as a result of, e.g., their coming off in the charging zone or where the ability of conductive fine particles to promote uniform charging performance has deteriorated. Hence, the charging performance on the latent-image-bearing member can be prevented from lowering even when the apparatus is repeatedly used over a long period of time, and good uniform charging can stably be maintained.

According to studies made by the present inventors on how particle diameter of the conductive fine particles added to the developer has influence on the effect of promoting the charging of the latent-image-bearing member and on the cleaning-at-development performance, those having very small particle diameter (e.g., those of about 0.1 $\mu$m or less) among conductive fine particles tend to adhere so strongly to toner particle surfaces that the conductive fine particles can not sufficiently be fed to non-image areas on the latent-image-bearing member in the developing step. In the transfer step, too, the conductive fine particles are not liberated from the toner particle surfaces. Hence, the conductive fine particles can not positively (intentionally) be made to remain on the latent-image-bearing member after transfer and can not positively (intentionally) be fed to the charging zone. Hence, the effect of improving the charging performance on the latent-image-bearing member can not be obtained, and faulty images due to a lowering of the charging performance on the latent-image-bearing member may occur when the transfer residual toner particles adhere to or migrate into the contact charging member.

In addition, in the cleaning-at-development step, too, the effect of improving the collection performance on the transfer residual toner particles can not be obtained because the conductive fine particles can not be fed onto the latent-image-bearing member, and, even if they have been fed onto the latent-image-bearing member, because the conductive fine particles have too small particle diameter. Thus, image defects such as positive ghost and fog caused by any faulty collection of transfer residual toner particles can not effectively be prevented.

On the other hand, those having too large particle diameter (e.g., those of about 10 $\mu$m or more) among conductive fine particles tend to come off from the charging member because of their large particle diameter even if they have been fed to the charging zone. This makes it difficult for the conductive fine particles to continue interposing at the charging zone stably and in a sufficient number of particles, and makes it impossible to promote the uniform charging of the latent-image-bearing member. Moreover, since the number of particles of the conductive fine particles per unit weight become smaller, it comes inevitable to add the conductive fine particles to the developer in a large quantity in order to make the conductive fine particles interpose at the charging zone in a number large enough for sufficiently obtaining the effect of promoting the uniform charging of the latent-image-bearing member (the conductive fine particles interposing at the charging zone are required to be in a large number of particles because the effect of promoting the uniform charging of the latent-image-bearing member can be made greater by enlarging the number of points of contact between the latent-image-bearing member and the conductive fine particles at the charging zone). However, the addition of the conductive fine particles in too large quantity lowers the triboelectric chargeability and developing performance of the developer as a whole to cause a decrease in image density and toner scatter. Also, since the conductive fine particles have such a large particle diameter, the effect as an assistant for collecting the transfer residual toner particles in the developing step can not sufficiently be obtained. If the amount of presence of the conductive fine particles on the latent-image-bearing member is made too large in order to improve the collection of transfer residual toner particles, the conductive fine particles may adversely affect the latent-image-forming step because of their large diameter, e.g., may cause image defects due to shut-out of imagewise exposure light.

An example of how to measure the volume-average particle diameter and particle size distribution of the conductive fine particles is given below. A liquid module is attached to a laser diffraction particle size distribution measuring instrument Model LS-230, manufactured by Coulter Electronics Inc. Setting particle diameter of from 0.04 to 2,000 μm as measurement range, the volume-average particle diameter of the conductive fine particles is calculated from the volume-based particle size distribution obtained. As a procedure of measurement, a very small amount of a surface-active agent is added to 10 $cm^3$ of pure water, and 10 mg of a sample of the conductive fine particles is added thereto, which is then dispersed for 10 minutes by means of an ultrasonic dispersion machine (ultrasonic homogenizer). Thereafter, measurement is made for a measurement time of 90 seconds and at a measuring number of time of once.

In the measurement from a toner or developer, a very small amount of a surface-active agent is added to 100 g of pure water, and 2 to 10 g of the toner or developer is added thereto, which is then dispersed for 10 minutes by means of an ultrasonic dispersion machine (ultrasonic homogenizer). Thereafter, the toner particles and the conductive fine particles are separated by means of a centrifugal separator or the like. In the case of a magnetic toner or developer, a magnet may also be used. A dispersion of the conductive fine particles thus separated is put to measurement for a measurement time of 90 seconds and at a measuring number of time of once.

The present inventors have put forward their studies from those on the particle diameter of the conductive fine particles to further studies on particle size distribution of the developer containing an external additive, which is directly concerned in the behavior of actual developers.

As the result, it has been found that developer may be constructed to contain from 15% by number to 60% by number of particles ranging in particle diameter from 1.00 μm to less than 2.00 μm and from 15% by number to 70% by number of particles ranging in particle diameter from 3.00 μm to less than 8.96 μm, in its number-based particle size distribution in the range of particle diameter of from 0.60 μm to less than 159.21 μm, and this enables effective prevention of faulty charging of the latent-image-bearing member by contact charging, and enables improvement in uniform charging performance on the latent-image-bearing member in direct-injection charging. It has also been found that the collection of transfer residual toner particles in the cleaning-at-development can be improved, and image defects such as fog caused by any faulty collection of transfer residual toner particles can effectively be prevented. The reason therefor is explained below.

The conductive fine particles the developer in the present invention has are contributory to the incorporation of the developer with from 15% by number to 60% by number of the particles ranging in particle diameter from 1.00 μm to less than 2.00 μm in the number-based particle size distribution in the range of particle diameter of from 0.60 μm to less than 159.21 μm of the developer. Stated more specifically, the conductive fine particles the developer in the present invention has are used as those having particles ranging in particle diameter from 1.00 μm to less than 2.00 μm, and such conductive fine particles are so incorporated in the developer that the particles ranging in particle diameter from 1.00 μm to less than 2.00 μm are contained in the developer in the amount falling within the above range, whereby the effect of the present invention can be obtained.

According to studies made by the present inventors, it has been found that the feature that the conductive fine particles ranging in particle diameter from 1.00 μm to less than 2.00 μm are present in the developer is greatly effective for preventing the faulty charging of the latent-image-bearing member which is caused when the transfer residual toner particles adhere to or migrate into the contact charging member in contact charging, for improving the uniform charging performance on the latent-image-bearing member in direct-injection charging, and for effectively preventing the faulty charging and faulty collection of transfer residual toner particles in the image-forming method making use of cleaning-at-development. It has also been found that the particle diameter of the conductive fine particles is greatly concerned in the effect of the conductive fine particles as an assistant for collecting the transfer residual toner particles in the developing step, that there is a range of particle diameter of the conductive fine particles which is optimum as the assistant for collecting the transfer residual toner particles, and that the content (% by number) of the conductive fine particles having the particle diameter particularly in the range of particle diameter of from 1.00 μm to less than 2.00 μm is greatly concerned in the effect as an assistant for collecting the transfer residual toner particles.

The particles of conductive fine particles ranging in particle diameter from 1.00 μm to less than 2.00 μm may hardly strongly adhere to the toner particle surfaces, and are sufficiently fed up to non-image areas on the latent-image-bearing member in the developing step, where they are actively liberated from the toner particle surfaces in the transfer step and then fed to the charging zone in a good efficiency via the latent-image-bearing face after transfer. Also, the above conductive fine particles, which can stand interposed in a uniformly dispersed state at the charging zone, has a great effect of promoting the charging of the latent-image-bearing member, and are stably retained at the charging zone. Hence, the charging performance on the latent-image-bearing member can be prevented from lowering even when the image-forming apparatus is repeatedly used over a long period of time, and good uniform charging is stably maintained. Also, even where the charging member is inevitably contaminated by the transfer residual toner particles as in the cleaning-at-development image-forming method, the charging performance on the latent-image-bearing member can be prevented from lowering. Moreover, since the conductive fine particles can efficiently be fed to the latent-image-bearing face after transfer to exhibit an especially excellent effect as the assistant for collecting the transfer residual toner particles, the performance of collecting the transfer residual toner particles in the cleaning-at-development step can be improved.

As described above, the developer used in the present invention is characterized in that the particles ranging in particle diameter from 1.00 μm to less than 2.00 μm in its number-based particle size distribution in the range of particle diameter of from 0.60 μm to less than 159.21 μm are in a content of from 15% by number to 60% by number. Controlling within the above range the content of particles ranging in particle diameter from 1.00 μm to less than 2.00

μm in the above measurement range of particle diameter enables achievement of the improvement in uniform charging performance on the latent-image-bearing member in the charging step. Also, since the conductive fine particles can be made present stably at the charging zone in an appropriate quantity, any faulty exposure due to the presence of conductive fine particles in excess on the latent-image-bearing member can be prevented in the subsequent exposure step.

If the particles ranging in particle diameter from 1.00 μm to less than 2.00 μm are contained in the developer in an amount too small below the above range, the uniform charging performance on the latent-image-bearing member by contact charging can not sufficiently be improved, and the effect of effectively preventing the faulty collection of transfer residual toner particles in the cleaning-at-development can not well be obtained. If on the other hand the particles ranging in particle diameter from 1.00 μm to less than 2.00 μm are contained in the developer in an amount too large beyond the above range, the conductive fine particles are fed to the charging zone in excess, and hence any conductive fine particles not completely retained at the charging zone may be sent out onto the latent-image-bearing member in such an extent that they shut out the exposure light, to cause image defects due to faulty exposure, or tend to scatter to greatly cause a difficulty such as in-machine contamination.

In the developer used in the present invention, the particles ranging in particle diameter from 1.00 μm to less than 2.00 μm in its number-based particle size distribution in the range of particle diameter of from 0.60 μm to less than 159.21 μm may preferably be in a content of from 20% by number to 50% by number, and more preferably from 20% by number to 45% by number. Controlling the content of the above particles within this range brings about more improvement in uniform charging performance on the latent-image-bearing member by contact charging, and also brings about a greater effect of effectively preventing the faulty collection of transfer residual toner particles in the cleaning-at-development image-forming method. Moreover, the conductive fine particles can be prevented from being fed to the charging zone in excess, and the image defects due to faulty exposure caused when any conductive fine particles not completely retained at the charging zone are sent out in a large quantity onto the latent-image-bearing member can more surely be kept from occurring.

As described previously, in order for the developer in the present invention to be incorporated with from 15% by number to 60% by number of the particles ranging in particle diameter from 1.00 μm to less than 2.00 μm in the number-based particle size distribution in the range of particle diameter of from 0.60 μm to less than 159.21 μm of the developer, the conductive fine particles may be so incorporated in the developer that the particles ranging in particle diameter from 1.00 μm to less than 2.00 μm are contained in the developer in the amount falling within the above range. However, the particles ranging in particle diameter from 1.00 μm to less than 2.00 μm in the number-based particle size distribution in the range of particle diameter of from 0.60 μm to less than 159.21 μm of the developer are by no means limited only to the above conductive fine particles. Instead, the toner particles or other particles to be added to the developer may be contained.

The toner particles contained in the developer used in the present invention, which contain at least a binder resin and a colorant, may be obtained by known production processes. The quantity of the particles ranging in particle diameter from 1.00 μm to less than 2.00 μm may change depending on toner production processes and production conditions (e.g., average particle diameter of toner, and pulverization conditions when produced by pulverization). However, if, in the number-based particle size distribution in the range of particle diameter of from 0.60 μm to less than 159.21 μm of the developer, particles ranging in particle diameter from 1.00 μm to less than 2.00 μm which are ascribable to the toner particles are in a content more than 10% by number, the triboelectric chargeability the particles ranging in particle diameter from 1.00 μm to less than 2.00 μm have may greatly differ from the triboelectric chargeability any toner particles having particle diameter close to average particle diameter have. Hence, a broad triboelectric charge distribution may result, so that the developing performance tends to lower.

That is, in the number-based particle size distribution in the range of particle diameter of from 0.60 μm to less than 159.21 μm of the developer, the particles ranging in particle diameter from 1.00 μm to less than 2.00 μm which are ascribable to the conductive fine particles, may preferably in a content of from 5% by number to 60% by number.

The developer used in the present invention is also characterized in that the particles ranging in particle diameter from 3.00 μm to less than 8.96 μm in its number-based particle size distribution in the range of particle diameter of from 0.60 μm to less than 159.21 μm are in a content of from 15% by number to 70% by number.

In the developer in the present invention, the particles ranging in particle diameter from 3.00 μm to less than 8.96 μm must be in the stated content in order to develop the electrostatic latent image formed on the latent-image-bearing member, to form a developer image, which developer image is transferred to a transfer medium to form the developer image on the transfer medium. Also, the particles ranging in particle diameter from 3.00 μm to less than 8.96 μm may be endowed with triboelectric charge characteristics suited for the particles to electrostatically attract to the electrostatic latent image formed on the latent-image-bearing member and develop the electrostatic latent image faithfully as the developer image.

Particles with particle diameter smaller than 3.00 μm may retain excessive charge or attenuate triboelectric-charge electric charges in excess, making it difficult for the particles to be endowed with stable triboelectric charge characteristics. Hence, such particles tend to adhere in a large quantity to areas having no electrostatic latent image on the latent-image-bearing member (corresponding to white background areas of an image), making it difficult to develop the electrostatic latent image faithfully as the developer image. Also, such particles with particle diameter smaller than 3.00 μm makes it difficult to maintain good transfer performance on transfer mediums having uneven surface (e.g., paper having surface unevenness due to fibers), resulting in an increase in transfer residual toner particles. Hence, the latent-image-bearing member may be brought to the charging step in the state the transfer residual toner particles have adhered thereto in a large quantity. Moreover, the transfer residual toner particles may adhere to or migrate into the contact charging member in a large quantity, and hence the charging of the latent-image-bearing member may be obstructed, tending to obstruct the effect of the present invention that the charging performance on the latent-image-bearing member is improved on account of the contact charging member having a close contact performance to the latent-image-bearing member via the conductive fine particles. Also, as the transfer residual toner particles have smaller particle diameter, the mechanical, electrostatic and, in the case of magnetic toners, magnetic collection force acting on the transfer residual toner particles in the developing step becomes smaller, and hence the force of adhesion between the transfer residual toner particles and the latent-image-bearing member becomes relatively larger, so that the collection performance on the transfer residual toner particles in the developing step may lower to tend to cause image defects such as positive ghost and fog caused by any faulty collection of transfer residual toner particles.

Particles with particle diameter of 8.96 μm or more also make it difficult for the particles to be endowed with sufficiently high triboelectric charge characteristics. In general, the larger particle diameter developers have, the lower resolution the resultant developer images have. However, in the developer used in the present invention in which the conductive fine particles have been so incorporated that particles ranging in particle diameter from 1.00 μm to less than 2.00 μm are contained in the developer in the amount falling within the stated range, the developer contains the particles of the conductive fine particles in so large a quantity that the triboelectric charge quantity of toner particles having particularly large particle diameter more tends to lower. Thus, it is difficult for the particles with particle diameter of 8.96 μm or more to be endowed with triboelectric charge characteristics well high enough for developing the electrostatic latent image faithfully as the developer image, making it more difficult to obtain developer images having good resolution.

Accordingly, the particles ranging in particle diameter from 3.00 μm to less than 8.96 μm in the number-based particle size distribution in the range of particle diameter of from 0.60 μm to less than 159.21 μm are contained in the amount falling within the above range so that the toner particles endowed with triboelectric charge characteristics suited for developing the electrostatic latent image faithfully as the developer image can be ensured. Thus, using the developer in the present invention in which the conductive fine particles have been so incorporated that the particles ranging in particle diameter from 1.00 μm to less than 2.00 μm are also contained in the developer in the amount falling within the stated range, images can be obtained which have high image density and superior resolution.

In the present invention, if the particles ranging in particle diameter from 3.00 μm to less than 8.96 μm are contained in the developer in an amount too small below the above range, it is difficult to ensure the toner particles endowed with triboelectric charge characteristics suited for developing the electrostatic latent image faithfully as the developer image. Hence, the images obtained may have much fog, a low image density or a low resolution.

On the other hand, if the particles ranging in article diameter from 3.00 μm to less than 8.96 μm are contained in the developer in an amount too large beyond the above range, it is difficult to control the content of the particles ranging in particle diameter from 1.00 μm to less than 2.00 μm described previously, within the range specified in the present invention. Also, even when the content of the particles ranging in particle diameter from 1.00 μm to less than 2.00 μm are within the range specified in the present invention, the particles ranging in particle diameter from 1.00 μm to less than 2.00 μm come relatively short with respect to the particles ranging in particle diameter from 3.00 μm to less than 8.96 μm. Hence, the uniform charging performance on the latent-image-bearing member by contact charging can not well be improved, and the effect of effectively preventing the faulty collection of transfer residual toner particles in the cleaning-at-development can not well be obtained.

The particles ranging in particle diameter from 3.00 μm to less than 8.96 μm in the number-based particle size distribution in the range of particle diameter of from 0.60 μm to less than 159.21 μm of the developer in the present invention may preferably be in a content of from 20% by number to 65% by number, and more preferably from 25% by number to 60% by number. Controlling the content of the above particles within this range brings about more improvement in uniform charging performance on the latent-image-bearing member by contact charging, and also brings about a greater effect of effectively preventing the faulty collection of transfer residual toner particles in the cleaning-at-development image-forming method, also making it possible to obtain images having high image density, less fog and superior resolution.

As described above, in order to ensure the toner particles endowed with triboelectric charge characteristics suited for developing the electrostatic latent image faithfully as the developer image and to obtain images having high image density, less fog and superior resolution, the developer in the present invention contains from 15% by number to 70% by number of the particles ranging in particle diameter from 3.00 μm to less than 8.96 μm in its number-based particle size distribution in the range of particle diameter of from 0.60 μm to less than 159.21 μm. Accordingly, the particles ranging in particle diameter from 3.00 μm to less than 8.96 μm, contained in the developer may preferably be ascribable to the toner particles. However, the particles ranging in particle diameter from 3.00 μm to less than 8.96 μm in the number-based particle size distribution in the range of particle diameter of from 0.60 μm to less than 159.21 μm of the developer are by no means limited only to the toner particles. Instead, the conductive fine particles or other particles to be added to the developer may be contained.

The developer usable in the present invention may also preferably have a weight-average particle diameter (D4) of from 4 μm to 10 μm. If the developer has a weight-average particle diameter of less than 4 μm, fog tends to occur in white background areas. If the developer has a weight-average particle diameter of more than 10 μm, it may become difficult to impart proper electric charges uniformly to the developer on the developer-carrying member.

In the present invention, the particle diameter and particle size distribution of the developer are values found using the number-based particle size distribution and circularity distribution in the range of particle diameter of from 0.60 μm to less than 159.21 μm, defining as "particle diameter" the circle-equivalent diameter measured with a flow type particle image analyzer FPIA-1000 (manufactured by Toa Iyou Denshi K.K.).

The measurement with the flow type particle image analyzer is made in the following way: Few drops of a diluted surface-active agent (preferably one prepared by diluting an alkylbenzenesulfonate to about 1/10 with water from which fine dust has been removed) are added to 10 ml of water from which fine dust has been removed through a filter and which consequently contains 20 or less particles falling within the measurement range (e.g., with circle-equivalent diameter of from 0.60 μm to less than 159.21 μm), in $10^3$ $cm^3$. To the resultant dispersion, a measuring sample is added in an appropriate quantity (e.g., 0.5 to 20 mg) and dispersed by means of an ultrasonic homogenizer (output: 50 W; a step-type chip of 6 mm diameter) for 3 minutes, and the particle concentration of the measuring sample is adjusted to 7,000 to 10,000 particles/$10^{-3}$ $cm^3$ (in respect of particles ranging in circle-equivalent diameters measured) to prepare a sample dispersion. Using this sample dispersion, the particle size distribution and circularity distribution of particles having circle-equivalent diameters of from 0.60 μm to less than 159.21 μm are measured. The weight-average particle diameter (D4) is found by calculation from the above number-based particle size distribution.

The summary of measurement is described in a catalog of FPIA-1000 (an issue of June, 1995), published by Toa Iyou Denshi K.K., and in an operation manual of the measuring apparatus and Japanese Patent Application Laid-Open No. 8-136439, and is as follows:

The sample dispersion is passed through channels (extending along the flow direction) of a flat transparent flow cell (thickness: about 200 μm). A strobe and a CCD (charge-coupled device) camera are fitted at positions opposite to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area as this area of the two-dimensional image is calculated as the circle-equivalent diameter.

The circumferential length of each particle is found from the two-dimensional image of each particle, and its ratio to the circumferential length of a circle having the same area as the area of the two-dimensional image is calculated to find the circularity distribution.

Results of measurement (frequency % and cumulative % of particle size distribution and circularity distribution) can be obtained by dividing the range of from 0.06 μm to 400 μm into 226 channels (divided into 30 channels for one octave) as shown in Table 1 below. In actual measurement, particles are measured in the range of circle-equivalent diameters of from 0.60 μm to less than 159.21 μm.

In the following Table 1, the upper-limit numeral in each particle diameter range does not include that numeral itself to mean that it is indicated as "less than".

TABLE 1

| Particle diameter range (μm) | Particle diameter range (μm) | Particle diameter range (μm) | Particle diameter range (μm) |
|---|---|---|---|
| 0.60–0.61 | 3.09–3.18 | 15.93–16.40 | 82.15–84.55 |
| 0.61–0.63 | 3.18–3.27 | 16.40–16.88 | 84.55–87.01 |
| 0.63–0.65 | 3.27–3.37 | 16.88–17.37 | 87.01–89.55 |
| 0.65–0.67 | 3.37–3.46 | 17.37–17.88 | 89.55–92.17 |
| 0.67–0.69 | 3.46–3.57 | 17.88–18.40 | 92.17–94.86 |
| 0.69–0.71 | 3.57–3.67 | 18.40–18.94 | 94.86–97.63 |
| 0.71–0.73 | 3.67–3.78 | 18.94–19.49 | 97.63–100.48 |
| 0.73–0.75 | 3.78–3.89 | 19.49–20.06 | 100.48–103.41 |
| 0.75–0.77 | 3.89–4.00 | 20.06–20.65 | 103.41–106.43 |
| 0.77–0.80 | 4.00–4.12 | 20.65–21.25 | 106.43–109.53 |
| 0.80–0.82 | 4.12–4.24 | 21.25–21.87 | 109.53–112.73 |
| 0.82–0.84 | 4.24–4.36 | 21.87–22.51 | 112.73–116.02 |
| 0.84–0.87 | 4.36–4.49 | 22.51–23.16 | 116.02–119.41 |
| 0.87–0.89 | 4.49–4.62 | 23.16–23.84 | 119.41–122.89 |
| 0.89–0.92 | 4.62–4.76 | 23.84–24.54 | 122.89–126.48 |
| 0.92–0.95 | 4.76–4.90 | 24.54–25.25 | 126.48–130.17 |
| 0.95–0.97 | 4.90–5.04 | 25.25–25.99 | 130.17–133.97 |
| 0.97–1.00 | 5.04–5.19 | 25.99–26.75 | 133.97–137.88 |
| 1.00–1.03 | 5.19–5.34 | 26.75–27.53 | 137.88–141.90 |
| 1.03–1.06 | 5.34–5.49 | 27.53–28.33 | 141.90–146.05 |
| 1.06–1.09 | 5.49–5.65 | 28.33–29.16 | 146.05–150.31 |
| 1.09–1.12 | 5.65–5.82 | 29.16–30.01 | 150.31–154.70 |
| 1.12–1.16 | 5.82–5.99 | 30.01–30.89 | 154.70–159.21 |
| 1.16–1.19 | 5.99–6.16 | 30.89–31.79 | 159.21–163.88 |
| 1.19–1.23 | 6.16–6.34 | 31.79–32.72 | 163.88–168.64 |

TABLE 1-continued

| Particle diameter range (μm) | Particle diameter range (μm) | Particle diameter range (μm) | Particle diameter range (μm) |
|---|---|---|---|
| 1.23–1.28 | 6.34–6.53 | 32.72–33.67 | 168.64–173.56 |
| 1.28–1.30 | 6.53–6.72 | 33.67–34.65 | 173.56–178.63 |
| 1.30–1.34 | 6.72–6.92 | 34.65–35.67 | 178.63–183.84 |
| 1.34–1.38 | 6.92–7.12 | 35.67–36.71 | 183.84–189.21 |
| 1.38–1.42 | 7.12–7.33 | 36.71–37.78 | 189.21–194.73 |
| 1.42–1.46 | 7.33–7.54 | 37.78–38.88 | 194.73–200.41 |
| 1.46–1.50 | 7.54–7.76 | 38.88–40.02 | 200.41–206.26 |
| 1.50–1.55 | 7.76–7.99 | 40.02–41.18 | 206.26–212.28 |
| 1.55–1.59 | 7.99–8.22 | 41.18–42.39 | 212.28–218.48 |
| 1.59–1.64 | 8.22–8.46 | 42.39–43.62 | 218.48–224.86 |
| 1.64–1.69 | 8.46–8.71 | 43.62–44.90 | 224.86–231.42 |
| 1.69–1.73 | 8.71–8.96 | 44.90–46.21 | 231.42–238.17 |
| 1.73–1.79 | 8.96–9.22 | 46.21–47.56 | 238.17–245.12 |
| 1.79–1.84 | 9.22–9.49 | 47.56–48.94 | 245.12–252.28 |
| 1.84–1.89 | 9.49–9.77 | 48.94–50.37 | 252.28–259.64 |
| 1.89–1.95 | 9.77–10.05 | 50.37–51.84 | 259.64–267.22 |
| 1.95–2.00 | 10.05–10.35 | 51.84–53.36 | 267.22–275.02 |
| 2.00–2.08 | 10.35–10.65 | 53.36–54.91 | 275.02–283.05 |
| 2.08–2.12 | 10.65–10.96 | 54.91–56.52 | 283.05–291.31 |
| 2.12–2.18 | 10.96–11.28 | 56.52–58.17 | 291.31–299.81 |
| 2.18–2.25 | 11.28–11.61 | 58.17–59.86 | 299.81–308.56 |
| 2.25–2.31 | 11.61–11.95 | 59.86–61.61 | 308.56–317.56 |
| 2.31–2.38 | 11.95–12.30 | 61.61–63.41 | 317.56–326.83 |
| 2.38–2.45 | 12.30–12.66 | 63.41–65.26 | 326.83–336.37 |
| 2.45–2.52 | 12.66–13.03 | 65.26–67.16 | 336.37–346.19 |
| 2.52–2.60 | 13.03–13.41 | 67.16–69.12 | 346.19–356.29 |
| 2.60–2.67 | 13.41–13.80 | 69.12–71.14 | 356.29–366.69 |
| 2.67–2.75 | 13.80–14.20 | 71.14–73.22 | 366.69–377.40 |
| 2.75–2.83 | 14.20–14.62 | 73.22–75.36 | 377.40–388.41 |
| 2.83–2.91 | 14.62–15.04 | 75.36–77.56 | 388.41–400.00 |
| 2.91–3.00 | 15.04–15.48 | 77.56–79.82 | |
| 3.00–3.09 | 15.48–15.93 | 79.82–82.15 | |

The particle size distribution of the developer may also be measured with other instrument employing the same principle as that of the above measuring method.

In the developer used in the present invention, the conductive fine particles may preferably be in a content of from 0.5% by weight to 10% by weight of the whole developer. Controlling the content of the conductive fine particles within the above range makes it able to feed the conductive fine particles to the charging zone in a quantity appropriate for promoting the charging of the latent-image-bearing member, and to feed the conductive fine particles onto the latent-image-bearing member in a quantity necessary for improving the collection performance on transfer residual toner particles in the cleaning-at-development.

If the conductive fine particles of the developer are in a content too small below the above range, the conductive fine particles fed to the charging zone tends to become short, so that the effect of promoting the stable charging of the latent-image-bearing member may be obtained with difficulty. In this case, in the image-forming method making use of the cleaning-at-development, too, the conductive fine particles present on the latent-image-bearing member together with the transfer residual toner particles at the time of development tend to become short, and in some cases the collection performance on transfer residual toner particles is not sufficiently be improved.

If on the other hand the conductive fine particles of the developer are in a content too large beyond the above range, the conductive fine particles tend to be fed to the charging zone in excess, and hence any conductive fine particles not completely retained at the charging zone may be sent out onto the latent-image-bearing member in a large quantity to tend to cause faulty exposure. Also, this may lower, or disturb, the triboelectric charge characteristics of the toner particles, or may cause a decrease in image density or an increase in fog.

From such a viewpoint, the conductive fine particles in the developer may preferably be in a content of from 0.5% by weight to 10% by weight, and more preferably from 1% by weight to 5% by weight.

The conductive fine particles may also preferably have a resistivity of $10^9$ Ω·cm or less in order to provide the developer with the effect of promoting the charging of the latent-image-bearing member and the effect of improving the collection performance on transfer residual toner particles. If the conductive fine particles have a too high resistivity beyond the above range, the effect of promoting the charging of the latent-image-bearing member for achieving good and uniform charging performance thereon may be small even when the conductive fine particles are made to interpose at the contact zone between the contact charging member and the latent-image-bearing member or at the charging region vicinal thereto and when the close contact performance of the contact charging member on the latent-image-bearing member via the conductive fine particles is maintained. In the cleaning-at-development, too, the conductive fine particles tend to have electric charges with the same polarity as that of the transfer residual toner particles. If the electric charges of the conductive fine particles become large under the same polarity as that of the transfer residual toner particles, the effect of improving the collection performance on transfer residual toner particles may sharply lower.

In order to bring out the effect of promoting the charging of the latent-image-bearing member that is attributable to the conductive fine particles and to stably obtain the good and uniform charging performance on the latent-image-bearing member, the conductive fine particles may preferably have a resistivity smaller than the resistivity of the contact charging member at its surface portion or that of the contact zone between it and the latent-image-bearing member, and may more preferably have a resistivity of 1/100 or less of the resistivity of this contact charging member.

The conductive fine particles may further have resistivity of from $10^1$ to $10^6$ Ω·cm. This is preferable in order for the latent-image-bearing member to be better uniformly charged resisting any charging obstruction due to insulative transfer residual toner particles having adhered to or migrated into the contact charging member, and also in order to more stably obtain the effect of improving the collection performance on transfer residual toner particles in the cleaning-at-development.

In the present invention, the resistivity of the conductive fine particles may be measured by the tablet method and normalizing measurements to determine it. More specifically, about 0.5 g of a powder sample is put in a hollow cylinder of 2.26 $cm^2$ in bottom area. Then, a pressure of 147 N (15 kg) is applied across upper and lower electrodes provided on the top and bottom of the powder sample, and at the same time a voltage of 100 V is applied thereto to measure the resistance value. Thereafter, the measurements are normalized to calculate specific resistance (resistivity).

The conductive fine particles may also be transparent, white or pale-colored conductive fine particles. This is preferable because the conductive fine particles transferred to transfer mediums do not come conspicuous as fog. The conductive fine particles may preferably be transparent, white or pale-colored conductive fine particles also in view of preventing them from obstructing exposure light in the latent-image-forming step. The conductive fine particles may further preferably have a transmittance of 30% or more to imagewise exposure light with which the electrostatic latent image is formed. This transmittance may more preferably be 35% or more.

An example of how to measure the light transmittance of the conductive fine particles is given below. The transmittance is measured in the state the conductive fine particles have been attached for one layer, to an adhesive layer of a transparent film having the adhesive layer on one side. The light is applied to the film in its vertical direction. The light having passed through the film up to its back is converged to measure the amount of the light. Light transmittance is calculated as the net amount of light, on the basis of a difference in the amount of light between a case in which the film is used alone and a case in which the conductive fine particles have been attached thereto. In practice, it may be measured with a transmission type densitometer 310T, manufactured by X-Rite Co.

The conductive fine particles may also preferably be non-magnetic. Inasmuch as the conductive fine particles are non-magnetic, the transparent, white or pale-colored conductive fine particles can be obtained with ease. On the contrary, conductive fine particles having magnetic properties can be made transparent, white or pale-colored with difficulty. Also, in an image-forming method in which the developer is transported and retained by magnetic force in order to hold thereon the developer, the conductive fine particles having magnetic properties may hardly participate in development. Hence, such conductive fine particles may insufficiently be fed onto the latent-image-bearing member, or the conductive fine particles may accumulate on the surface of the developer-carrying member to tend to cause a difficulty such that they obstruct the development the toner particles perform. Moreover, where the conductive fine particles having magnetic properties are added to magnetic toner particles, the conductive fine particles tend to come liberated from toner particles because of magnetic cohesive force, tending to result in a lowering of the performance of feeding the conductive fine particles onto the latent-image-bearing member.

The conductive fine particles in the present invention may include, e.g., fine carbon powders such as carbon black and graphite powder; fine metal powders such as copper, gold, silver, aluminum and nickel powders; metal oxide powders such as zinc oxide, titanium oxide, tin oxide, aluminum oxide, indium oxide, silicon oxide, magnesium oxide, barium oxide, molybdenum oxide, iron oxide and tungsten oxide powders; metal compound powders such as molybdenum sulfide, cadmium sulfide and potassium titanate powders; and compound oxides of these; any of which may be used optionally with adjustment of particle diameter and particle size distribution.

Among these, the conductive fine particles may preferably contain at least one selected from zinc oxide, tin oxide and titanium oxide. Further, particularly preferred are fine particles having at least on their surfaces an inorganic oxide such as zinc oxide, tin oxide and titanium oxide. These oxides are preferred because they can have a resistivity set low as the conductive fine particles and are non-magnetic, white or pale-colored, and the conductive fine particles do not come conspicuous as fog.

Where the conductive fine particles are comprised of a conductive inorganic oxide or contain a conductive inorganic oxide, a metal oxide incorporated with an element such as antimony or aluminum which is different from the chief metallic element of the conductive inorganic oxide, or a conductive material may also be used for the purpose of, e.g., controlling the resistance value. For example, they are zinc oxide containing aluminum, fine stannous oxide particles containing antimony, and fine particles obtained by treating titanium oxide, barium sulfate or aluminum borate particle surfaces with tin oxide containing antimony. The conductive inorganic oxide may preferably be incorporated with the element such as antimony or aluminum in an amount of from 0.05% by weight to 20% by weight, more preferably from 0.05% by weight to 10% by weight, and particularly preferably from 0.1% by weight to 5% by weight.

Conductive inorganic oxides obtained by making the above conductive inorganic oxides into an oxygen-deficient type may also preferably be used.

Commercially available conductive fine titanium oxide particles treated with tin oxide or antimony may include, e.g., EC-300 (available from Titan Kogyo K.K.); ET-300, HJ-1 and HI-2 (all available from Ishihara Sangyo Kaisha, Ltd.); and W-P (available from Mitsubishi Material Co., Ltd.).

Commercially available antimony-doped conductive tin oxide particles may include, e.g., T-1 (available from Mitsubishi Material Co., Ltd.) and SN-100P (available from Ishihara Sangyo Kaisha, Ltd.). Also, commercially available stannous oxide particles may include, e.g., SH-S (available from Nihon Kagaku Sangyo Co., Ltd.).

Particularly preferred ones may include metal oxides such as zinc oxide containing aluminum, metal oxides such as oxygen-deficient type zinc oxide and titanium oxide, and fine particles having any of these at least on the particle surfaces.

As types of the binder resin the toner particles used in the present invention contain, usable are, e.g., styrene resins, styrene copolymer resins, polyester resins, polyvinyl chloride resins, phenolic resins, natural-resin-modified phenolic resins, natural-resin-modified maleic acid resins, acrylic resins, methacrylic resins, polyvinyl acetate resins, silicone resins, polyurethane resins, polyamide resins, furan resins, epoxy resins, xylene resins, polyvinyl butyral, terpene resins, cumarone indene resins, and petroleum resins.

Comonomers copolymerizable with styrene monomers in the styrene copolymers may include, e.g., styrene derivatives such as vinyltoluene; acrylic acid or acrylates such as methyl acrylate, ethyl acrylate, butyl acrylate, dodecyl acrylate, octyl acrylate, 2-ethylhexyl acrylate and phenyl acrylate; methacrylic acid or methacrylates such as methyl methacrylate, ethyl methacrylate, butyl methacrylate and octyl methacrylate; dicarboxylic acids having a double bond or esters thereof such as maleic acid or butyl maleate, methyl maleate and dimethyl maleate; acrylamide, acrylonitrile, methacrylonitrile and butadiene; vinyl chloride; vinyl esters such as vinyl acetate and vinyl benzoate; ethylenic olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more types.

Here, as a cross-linking agent, a compound having at least two polymerizable double bonds may chiefly be used. For example, it may include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

The binder resin may preferably have a glass transition temperature (Tg) of from 50° C. to 70° C. If its glass transition temperature is too low below the above range, the developer may have a low storage stability. If it is too high, the developer may have a poor fixing performance.

It is one of preferred embodiments that a wax component is incorporated in the toner particles used in the present invention. This is because the developer used in the present invention may preferably have a maximum endothermic peak in the range of temperature of from 70° C. to less than 120° C., in its endothermic curve of a DSC chart prepared using a differential thermal analyzer (differential scanning calorimeter DSC). This maximum endothermic peak temperature corresponds to the melting point of the developer, i.e., the melting point of the wax incorporated in the toner particles.

The wax to be incorporated in the toner particles may preferably have a melting point of from 70° C. to 120° C. If it has a melting point lower than 70° C., it may have a large difference in viscosity from the resin and hence may be dispersed in the resin with difficulty or tends to cause phase separation at the time of melt kneading when the developer is produced. If it has a melting point higher than 120° C., the toner particles may have so high a viscosity that the wax tends also to be non-uniformly dispersed in the toner particles.

The melting point of the developer may be measured according to ASTM D3418-82, using a differential thermal analyzer (DSC measuring device) DSC-7 (manufactured by Perkin-Elmer Corporation). The sample for measurement is precisely weighed in an amount of 5 to 20 mg, preferably 10 mg. This sample is put in a pan made of aluminum and an empty pan is set as reference. Measurement is carried out in an environment of normal temperature/normal humidity at a heating rate of 10° C./min within the measuring temperature range of from 30 to 200° C. Then, the temperature of its maximum endothermic peak, i.e., the melting point of the developer is determined.

The wax to be incorporated in the toner particles used in the present invention may include aliphatic hydrocarbon waxes such as low-molecular weight polyethylene, low-molecular weight polypropylene, polyolefins, polyolefin copolymers, microcrystalline wax, paraffin wax and Fischer-Tropsch wax; oxides of aliphatic hydrocarbon waxes, such as polyethylene oxide wax, or block copolymers of these; waxes composed chiefly of a fatty ester, such as carnauba wax and montanate wax; and those obtained by subjecting part or the whole of fatty esters to deoxidizing treatment, such as deoxidized carnauba wax. It may further include saturated straight-chain fatty acids such as palmitic acid, stearic acid, montanic acid and long-chain alkylcarboxylic acids having a still longer-chain alkyl group; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol, melissyl alcohol and long-chain alkyl alcohols having a still longer-chain alkyl group; polyhydric alcohols such as sorbitol; fatty acid amides such as linolic acid amide, oleic acid amide and lauric acid amide; saturated fatty acid bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as m-xylenebisstearic acid amide and N,N'-distearylisophthalic acid amide; fatty metal salts (what is called metal soap) such as calcium stearate, calcium laurate, zinc stearate and magnesium stearate; grafted waxes obtained by grafting vinyl monomers such as styrene and acrylic acid to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

In the present invention, the wax may be used in an amount ranging from 0.5 part by weight to 20 parts by weight, and preferably from 0.5 part by weight to 15 parts by weight, based on 100 parts by weight of the binder resin.

As the colorant the toner particles used in the present invention contain, usable are conventionally known dyes and pigments such as carbon black, lamp black, black iron oxide, ultramarine blue, Nigrosine dyes, aniline blue, Phthalocyanine Blue, Phthalocyanine Green, Hanza Yellow G, Rhodamine 6G, Chalcooil Blue, chrome yellow, quinacridone, Benzidine Yellow, Rose Bengale, triarylmethane dyes, monoazo dyes and disazo dyes, any of which may be used alone or in the form of a mixture.

The developer in the present invention may preferably be a magnetic developer having a magnetization intensity of from 10 $Am^2/kg$ to 40 $Am^2/kg$ under application of a magnetic field of 79.6 kA/m. The developer may more preferably have a magnetization intensity of from 20 $Am^2/kg$ to 35 $Am^2/kg$.

In the present invention, the reason why the magnetization intensity under application of a magnetic field of 79.6 kA/m is specified is as follows: Usually, magnetization intensity at magnetic saturation (saturation magnetization) is used as the quantity expressing magnetic properties of magnetic materials. In the present invention, however, what is important is the magnetization intensity of a magnetic developer in a magnetic field which acts actually on the magnetic developer in the image-forming apparatus. When a magnetic developer is used in the image-forming apparatus, in most commercially available image-forming apparatus the magnetic field which acts on the magnetic developer is tens of kA/m to hundred and tens of kA/m. Accordingly, as a typical value of the magnetic field which acts actually on the magnetic developer in the image-forming apparatus, the magnetic field of 79.6 kA/m (1,000 oersteds) is selected, and the magnetization intensity in the magnetic field of 79.6 kA/m is specified.

If the magnetization intensity in the magnetic field of 79.6 kA/m is too small below the above range, it is difficult to transport the developer by the aid of the magnetic force, making it impossible to make the developer held uniformly on the developer-carrying member. Also, when the developer is transported by the aid of the magnetic force, the rise of ears of one-component magnetic developer can not uniformly be formed, and hence the performance of feeding the conductive fine particles to the latent-image-bearing member may lower, also resulting in a lowering of the collection performance on transfer residual toner particles.

If the magnetization intensity in the magnetic field of 79.6 kA/m is too large beyond the above range, the toner particles may have higher magnetic cohesive properties to make it difficult for the conductive fine particles to be uniformly dispersed in the developer and to be fed to the latent-image-bearing member. Thus, the effect of promoting the charging of the latent-image-bearing member and the effect of improving the collection performance on transfer residual toner particles may be damaged which are the effects attributable to the present invention.

As a means for obtaining such a magnetic developer, a magnetic material may be incorporated in the toner particles. The magnetic material to be incorporated in the toner particles in order to make the developer into the magnetic developer may include magnetic iron oxides such as magnetite, maghematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

As magnetic characteristics of these magnetic materials, those having a saturation magnetization of from 10 to 200 $Am^2/kg$, a residual magnetization of from 1 to 100 $Am^2/kg$ and a coercive force of from 1 to 30 kA/m under application of a magnetic field of 795.8 kA/m. These magnetic materials may be used in an amount of from 20 parts by weight to 200 parts by weight based on 100 parts by weight of the binder resin. Of these magnetic materials, those composed chiefly of magnetite are particularly preferred.

In the present invention, the magnetization intensity of the magnetic developer may be measured with a vibrating-sample type magnetometer VSM P-1-10 (manufactured by Toei Kogyo K.K.) under an external magnetic field of 79.6 kA/m. The magnetic properties of the magnetic material may be measured at a temperature of 25° C. under an external magnetic field of 796 kA/m.

In the present invention, the developer may preferably contain a charge control agent. Among charge control agents, those capable of controlling the developer to be positively chargeable may include, e.g., the following materials.

Nigrosine and nigrosine products modified with a fatty acid metal salt; quaternary ammonium salts such as tributylbenzylammonium 1-hydroxy-4-naphthosulfonate and tetrabutylammonium teterafluoroborate, and analogues of these, i.e., onium salts such as phosphonium salts, and lake pigments of these; triphenylmethane dyes and lake pigments of these (laking agents include tungstophosphoric acid, molybdophosphoric acid, tungstomolybdophosphoric acid, tannic acid, lauric acid, gallic acid, ferricyanic acid and ferrocyanic acid); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; guanidine compounds; and imidazole compounds. Any of these may be used alone or in combination of two or more kinds. Of these, triphenylmethane dyes compounds and quaternary ammonium salts whose counter ions are not halogens may preferably be used. Homopolymers of monomers represented by the following general formula (1), and copolymers with the polymerizable monomers such as styrene, acrylates or methacrylates described previously may also be used as positive charge control agents. In this case, these charge control agents have the function as binder resins (as a whole or in part).

(1)

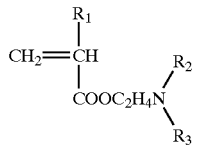

In the formula, $R_1$ represents a hydrogen atom or methyl group, and $R_2$ and $R_3$ each represent a saturated or unsubstituted alkyl group (preferably having 1 to 4 carbon atoms.

In the construction of the present invention, compounds represented by the following general formula (2) are particularly preferred as positive charge control agents.

(2)

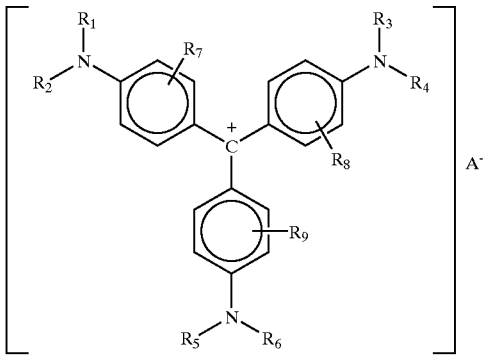

In the formula, $R_1$, $R_2$, $R_3$, $R_4$, $R_5$ and $R_6$ may be the same or different from one another and each represent a hydrogen atom, a substituted or unsubstituted alkyl group or a substituted or unsubstituted aryl group. $R_7$, $R_8$ and $R_9$ may be the same or different from one another and each represent a hydrogen atom, a halogen atom, an alkyl group or an alkoxyl group. $A^-$ represents an anion such as a sulfate ion, a nitrate ion, a borate ion, a phosphate ion, a hydride ion, an organosulfate ion, an organosulfonate ion, an organophosphate ion, a carboxylate ion, an organoborate ion or a tetrafluoroborate ion.

A charge control agent capable of controlling the developer to be negatively chargeable may include the following materials: For example, organic metal complex salts and chelate compounds are effective, including monoazo metal complexes, acetylyacetone metal complexes, aromatic hydroxycarboxylic acid and aromatic dicarboxylic acid type metal complexes. Besides, they may also include aromatic hydroxycarboxylic acids, aromatic mono- and polycarboxylic acids, and metal salts, anhydrides or esters thereof, and phenol derivatives such as bisphenol.

In particular, azo type metal complexes represented by the following general formula (3) shown below are preferred.

(3)

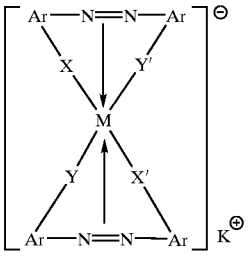

In the formula, M represents a central metal of coordination, including Sc, Ti, V, Cr, Co, Ni, Mn or Fe. Ar represents an aryl group as exemplified by a phenyl group or a naphthyl group, which may have a substituent. In such a case, the substituent includes a nitro group, a halogen atom, a carboxyl group, an anilido group, and an alkyl group having 1 to 18 carbon atoms or an alkoxyl group having 1 to 18 carbon atoms. X, X', Y and Y' each represent —O—, —CO—, —NH—or —NR— (R is an alkyl group having 1 to 4 carbon atoms). K represents a hydrogen, sodium, potassium, ammonium or aliphatic ammonium ion, or nothing.

As the central metal, Fe or Cr is particularly preferred. As the substituent, a halogen atom, an alkyl group or an anilido group is preferred. As the counter ion, hydrogen, ammonium or aliphatic ammonium ion is preferred.

Besides, basic organic acid metal complex salts represented by the following general formula (4) are also capable of imparting negative chargeability, and are usable in the present invention.

(4)

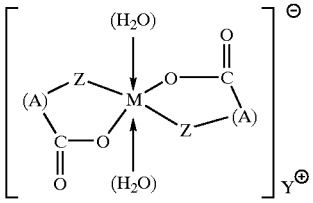

In the formula, M represents a central metal of coordination, including Cr, Co, Ni, Mn, Fe, Zn, Al, Si, B or Zr. A represents;

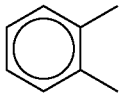

(which may have a substituent such as an alkyl group)

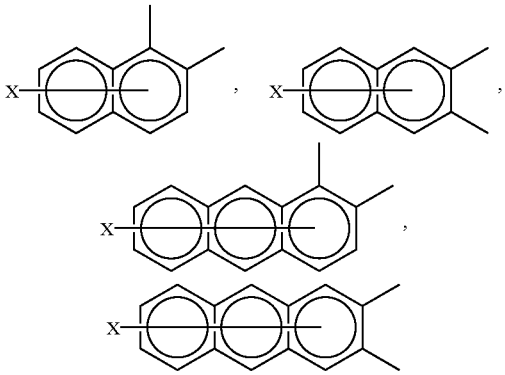

(X represents a hydrogen atom, a halogen atom, a nitro group or an alkyl group), and

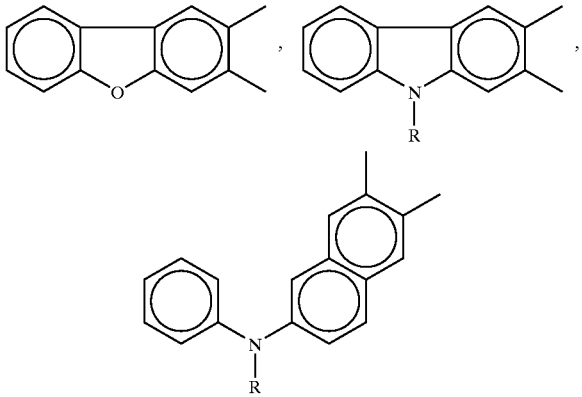

(R represents a hydrogen atom, an alkyl group having 1 to 18 carbon atoms or an alkenyl group having 2 to 18 carbon atoms);

Y' represents hydrogen, sodium, potassium, ammonium or aliphatic ammonium. Z represents

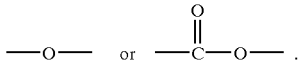

In the general formula (4), as the central metal, Fe, Al, Zn, Zr or Cr is particularly preferred. As the substituent, a halogen atom, an alkyl group or an anilido group is preferred. As the counter ion, hydrogen, alkali metal, ammonium or aliphatic ammonium ion is preferred. A mixture of complex salts having different counter ions may also preferably be used.

As methods for incorporating the charge control agent in the developer, there are a method of adding it internally into the toner particles and a method of adding it externally to the toner particles. The amount of the charge control agent used depends on the type of the binder resin, the presence of any other additives, and the manner by which the toner is produced, including the manner of dispersion, and can not absolutely be specified. Preferably, the charge control agent may be used in an amount ranging from 0.1 to 10 parts by weight, and more preferably from 0.1 to 5 parts by weight, based on 100 parts by weight of the binder resin.

In the present invention, in order to endow the developer with a fluidity, a fluidizing agent may preferably be added to the toner particles at their surfaces and in the vicinity thereof.

As the fluidizing agent, it may preferably be one selected from the group consisting of fine silica powder, fine titanium oxide powder and fine alumina powder.

To the developer usable in the present invention, in order to improve environmental stability, charge stability, developing performance, fluidity and storage stability and to improve cleaning performance, an inorganic fine powder such as fine silica powder, fine titanium powder or fine alumina powder may preferably externally be added, i.e., be present at the developer particle surfaces and in the vicinity thereof. Of these, fine silica powder is particularly preferred.

For example, as the fine silica powder, usable are fine silica powder which is what is called dry-process silica or fumed silica produced by vapor phase oxidation of silicon halides and fine silica powder which is what is called wet-process silica produced from water glass or the like, either of which may be used. The dry-process silica is preferred, as having less silanol groups on the surface and inside of the fine silica powder and leaving less production residues such as $Na_2O$ and $SO_3^{2-}$. In the dry-process silica, it is also possible to use, in its production step, other metal halide compound such as aluminum chloride or titanium chloride together with the silicon halide to give a composite fine powder of silica with other metal oxide. The fine silica powder includes these, too.

As the fluidizing agent usable in the present invention, an inorganic fine powder having been subjected to organic treatment may also be used. As methods for such organic treatment, a method is available in which the inorganic fine powder is treated with an organometallic compound such as a silane coupling agent or a titanium coupling agent, capable of reacting with, or physically adsorptive on, the inorganic fine powder. Making such treatment can make the inorganic fine powder more highly hydrophobic, and a developer having a more superior environmental stability especially in an environment of high humidity can be obtained. Hence, such a treated inorganic fine powder may preferably be used.

The silane coupling agent used in the organic treatment may include, e.g., hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals.

It may also include silane coupling agents having a nitrogen atom, such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine and trimethoxysilyl-γ-propylbenzylamine, which may be used alone or in combination. As a preferred silane coupling agent, it may include hexamethyldisilazane (HMDS) and aminopropyltrimethoxysilane.

As methods of treating the inorganic fine powder with the above silane coupling agent, spraying, an organic solvent method, an aqueous solution method and so forth may be used, for example. There are no particular limitations thereon.

As other organic treatment, a fine powder treated with a silicone oil may also be used. As preferred silicone oils, those having a viscosity at 25° C., of from 0.5 to 10,000 $mm^2/s$, and preferably from 1 to 1,000 $mm^2/s$, may be used, and may include, e.g., methylhydrogensilicone oil, dimethylsilicone oil, phenylmethylsilicone oil, chloromethylsilicone oil, alkyl-modified silicone oil, fatty-acid-modified silicone oil, polyoxyalkylene-modified silicone oil and fluorine-modified silicone oil. When used in positively chargeable developers, it is more preferable to use a silicone oil having a nitrogen atom in the side chain, such as amino-modified silicone oil.

The fine silica powder, fine titanium oxide powder and fine alumina powder used in the present invention may preferably have a BET specific surface area, as measured by the BET method using nitrogen gas absorption, of 30 $m^2/g$ or more, and particularly in the range of from 50 to 400 $m^2/g$. Such powders can provide good results. Also, the fine silica powder, fine titanium oxide powder and fine alumina powder used in the present invention may preferably be used in an amount of from 0.01 to 8 parts by weight, preferably from 0.1 to 5 parts by weight, and particularly preferably from 0.2 to 3 parts by weight, based on 100 parts by weight of the magnetic toner particles. Its use in an amount less than 0.01 part by weight can be less effective for preventing the developer from agglomerating, tending to result in a high fluidity index. Its use in an amount more than 8 parts by weight tends to make the fluidizing agent stand liberated without adhering to the toner particle surfaces, and may make it difficult for one-component developers to maintain a uniform and proper charge quantity, bringing about difficulties such as a lowering of developing performance in some cases.

In the developer usable in the present invention, external additives other than the above fluidizing agent may further be added. For example, a lubricant such as polyethylene fluoride, zinc stearate or polyvinylidene fluoride may be used. In particular, polyvinylidene fluoride is preferred. An abrasive such as cerium oxide, strontium titanate or strontium silicate may be used. In particular, strontium titanate is preferred. Besides, an anti-caking agent, a conductivity-providing agent as exemplified by carbon black, zinc oxide, antimony oxide or tin oxide powder, or reverse-polarity white particles or black particles may also be used in a small quantity as a developability improver.

Any of these external additives may be used in an amount of from 0.01 to 10 parts by weight, and preferably from 0.1 to 7 parts by weight, based on 100 parts by weight of the toner particles.

In producing the toner particles according to the present invention, it is preferable to use a method in which the component materials as described above are thoroughly mixed by means of a ball mill or any other mixer, thereafter the mixture formed is well kneaded by means of a heat kneading machine such as a heat roll, a kneader or an extruder, and the kneaded product obtained is cooled to solidify, followed by pulverization, classification and optionally shape control of toner particles. Besides, applicable are the method as disclosed in Japanese Patent Publication No. 56-13945, in which a melt-kneaded product is atomized in the air by means of a disk or a multiple fluid nozzle to obtain spherical toner particles; a method in which constituent materials are dispersed in a binder resin solution, followed by spray drying to obtain toner particles; the method as disclosed in Japanese Patent Publication No. 36-10231, and Japanese Patent Applications Laid-Open No. 59-53856 and No. 59-61842, in which toner particles are directly produced by suspension polymerization; an emulsion polymerization method as typified by soap-free polymerization in which toner particles are produced by direct polymerization of a polymerizable monomer in the presence of a water-soluble polar polymerization initiator; an association polymerization method in which fine resin particles, a colorant and so forth are subjected to association to produce toner particles; a dispersion polymerization method in which toner particles are directly produced using an aqueous organic solvent capable of dissolving polymerizable monomers and not capable of dissolving the resulting polymer; and, in what is called a microcapsule toner, a method in which a stated material is incorporated in a core material or a shell material, or both of these.

As the treatment for shape control of toner particles, available are a method in which toner particles obtained by pulverization are dispersed in water or in an organic solvent to heat or swell them, a heat treatment method in which the toner particles are passed through hot-air streams, and a mechanical-impact method in which mechanical energy is applied to the toner particles. As a means for applying mechanical impact force, available is a method in which toner particles are pressed against the inner wall of a casing by centrifugal force by means of a high-speed rotating blade to impart mechanical impact force to the toner particles by the force such as compression force or frictional force, as in apparatus such as a mechanofusion system manufactured by Hosokawa Micron Corporation, a hybridization system manufactured by Nara Kikai Seisakusho.

In the present invention, when the treatment to impart mechanical impact is made, the atmospheric temperature at the time of treatment may be set to a temperature around glass transition temperature Tg of the toner particles (Tg plus or minus 30° C.). This is preferable from the viewpoint of the prevention of agglomeration and the productivity. More preferably, treatment to make toner particles spherical by thermomechanical impact may be made at a temperature of Tg plus or minus 20° C. This is preferable in order to make the conductive fine particles function effectively.

As a batch type apparatus, it is one of preferred examples to use the hybridization system having been made commercially available, manufactured by Nara Kikai Seisakusho K.K.

To control the shape of the toner particles obtained by a pulverization process, toner particle constituent materials such as the binder resin may be selected and the conditions at the time of pulverization may appropriately be set. However, since the productivity tends to lower in an attempt to make the circularity of toner particles higher by means of an air grinding machine, it is preferable to use a mechanical grinding machine and set conditions under which the circularity of toner particles can be made higher.

In the present invention, in order to keep low the coefficient of variation of the particle size distribution of toner particles, it is preferable in view of productivity to use a multi-division classifier in the step of classification. Also, in order to lessen any ultrafine particles of the toner particles ranging in particle diameter from 1.00 $\mu$m to less than 2.00 $\mu$m, it is preferable to use the mechanical grinding machine in the step of pulverization.

To the toner particles thus obtained, the external additive is added, and then these are blended by means of a mixing machine, optionally further followed by sieving. Thus the developer used in the present invention can be produced.

As production apparatus used when the toner particles are produced by the pulverization process, a mixing machine may include Henschel Mixer (manufactured by Mitsui Mining & Smelting Co., Ltd.); Super Mixer (manufactured by Kawata K.K.); Ribocone (manufactured by Ohkawara Seisakusho K.K.); Nauta Mixer, Turbulizer and Cyclomix (manufactured by Hosokawa Micron Corporation); Spiral Pin Mixer (manufactured by Taiheiyo Kiko K.K.); and Rhedige Mixer (manufactured by Matsubo K.K.). As a kneading machine, it may include KRC Kneader (manufactured by Kurimoto Tekkosho K.K.); Buss Co-kneader (manufactured by Buss Co.); TEM-type Extruder (manufactured by Toshiba Machine Co., Ltd.); TEX Twin-screw Extruder (manufactured by Nippon Seiko K.K.); PCM Kneader (manufactured by Ikegai Tekkosho K.K.); Three-Roll Mill, Mixing Roll Mill, and Kneader (manufactured by Inoue Seisakusho K.K.); Kneadex (manufactured by Mitsui Mining & Smelting Co., Ltd.); MS-Type Pressure Kneader, Kneader Ruder (manufactured by Moriyama Seisakusho K.K.); and Banbury Mixer (manufactured by Kobe Seikosho K.K.). As a grinding machine, it may include Counter Jet Mill, Micron Jet and Inomizer (manufactured by Hosokawa Micron Corporation); IDS-Type Mill and PJM Jet Grinding Mill (manufactured by Nippon Pneumatic Kogyo K.K.); Cross Jet Mill (manufactured by Kurimoto Tekkosho K.K.); Ulmax (manufactured by Nisso Engineering K.K.); SK Jet O-Mill (manufactured by Seishin Kigyo K.K.); Criptron (manufactured by Kawasaki Heavy Industries, Ltd); and Turbo Mill (manufactured by Turbo Kogyo K.K.). Of these, it is more preferable to use the mechanical grinding machine such as Criptron and Turbo Mill. As a classifier, it may include Classyl, Micron Classifier and Spedic Classifier (manufactured by Seishin Kigyo K.K.); Turbo Classifier (manufactured by Nisshin Engineering K.K.); Micron Separator, Turboprex (ATP) and TSP Separator (manufactured by Hosokawa Micron Corporation); Elbow Jet (manufactured by Nittetsu Kogyo K.K.); Dispersion Separator (manufactured by Nippon Pneumatic Kogyo K.K.); and YM Microcut (manufactured by Yasukawa Shoji K.K.). As a sifter used to sieve coarse powder and so forth, it may include Ultrasonic (manufactured by Koei Sangyo K.K.); Rezona Sieve and Gyrosifter (manufactured by Tokuju Kosakusho K.K.); Vibrasonic System (manufactured by Dulton Co.); Soniclean (manufactured by Shinto Kogyo K.K.); Turbo Screener (manufactured by Turbo Kogyo K.K.); Microsifter (manufactured by Makino Sangyo K.K.); and circular vibrating screens.

A process cartridge of the present invention, an image-forming apparatus which carries out the image-forming method of the present invention, and an image-forming method of the present invention which can preferably make use of the developing assembly, developer-carrying member and developer according to the present invention are described below.

A first embodiment of the process cartridge of the present invention is a process cartridge in which an electrostatic latent image formed on a latent-image-bearing member is rendered visible as a developer image by the use of a developer and this visible developer image is transferred to a transfer medium to form an image, and is characterized by having at least a latent-image-bearing member for holding thereon an electrostatic latent image, a charging means for charging the latent-image-bearing member electrostatically, and a developing assembly for developing the electrostatic latent image formed on the latent-image-bearing member, by the use of the developer to form a developer image;

the developing assembly and the latent-image-bearing member being set integral as one unit and being so constructed as to be detachably mountable to the main body of an image-forming apparatus;

the developer being constructed as described previously;

the developing assembly having at least a developing container for holding therein the developer, a developer-carrying member for holding thereon the developer held in the developing container and transporting the developer to a developing zone, and a developer layer thickness regulation member for regulating the layer thickness of the developer to be held on the developer-carrying member; and the charging step being the step of charging the latent-image-bearing member electrostatically by applying a voltage to a charging means in the state the conductive fine particles the developer has stand interposed at least at the contact zone between the charging means and the latent-image-bearing member.

A second embodiment of the process cartridge of the present invention is a process cartridge in which an electrostatic latent image formed on a latent-image-bearing member is rendered visible as a developer image by the use of the developer and this visible developer image is transferred to a transfer medium to form an image, and has at least a latent-image-bearing member for holding thereon an electrostatic latent image, a charging means for charging the latent-image-bearing member electrostatically, and a developing assembly for developing the electrostatic latent image formed on the latent-image-bearing member, by the use of the developer to render it visible as a developer image, and at the same time collecting the developer having remained on the latent-image-bearing member after the developer image has been transferred to a recording medium;

the developing assembly and the latent-image-bearing member being set integral as one unit and being so constructed as to be detachably mountable to the main body of an image-forming apparatus;

the developer being constructed as described previously; and the developing assembly having at least a developing container for holding therein the developer, a developer-carrying member for holding thereon the developer held in the developing container and transporting the developer to a developing zone, and a developer layer thickness regulation member for regulating the layer thickness of the developer to be held on the developer-carrying member.

A first embodiment of the image-forming apparatus which carries out the image-forming method of the present invention is an image-forming apparatus having at least 1) a latent-image-bearing member for holding thereon an electrostatic latent image, 2) a charging means for charging the latent-image-bearing member electrostatically, 3) a developing assembly having a developer-carrying member for holding thereon a developer and at the same time transporting the developer to a developing zone facing the latent-image-bearing member to develop the electrostatic latent image formed on the latent-image-bearing member, by the use of the developer held on the latent-image-bearing member, to form a developer image, 4) a transfer assembly for transferring the developer image held on the latent-image-bearing member, to a recording medium transfer medium, and 5) a fixing means for fixing the developer image held on the transfer medium, to the surface of the transfer medium;

the developer and the developer-carrying member being constructed as described previously; and the charging means being a means for charging the latent-image-bearing member electrostatically by applying a voltage in the state the conductive fine particles the developer has stand interposed at the contact zone between the charging means and the latent-image-bearing member.

A second embodiment of the image-forming apparatus which carries out the image-forming method of the present invention is an image-forming apparatus having at least 1) a latent-image-bearing member for holding thereon an electrostatic latent image, 2) a charging means for charging the latent-image-bearing member electrostatically, 3) a developing assembly having a developer-carrying member for holding thereon a developer and at the same time transporting the developer to a developing zone facing the latent-image-bearing member to develop the electrostatic latent image formed on the latent-image-bearing member, by the use of the developer held on the latent-image-bearing member, to form a developer image, 4) a transfer assembly for transferring the developer image held on the latent-image-bearing member, to a recording medium transfer medium, and 5) a fixing means for fixing the developer image held on the transfer medium, to the surface of the transfer medium;

the developer and the developer-carrying member being constructed as described previously; and the developing assembly developing the electrostatic latent image formed on the latent-image-bearing member, by the use of the developer to render it visible as a developer image, and at the same time collecting the developer having remained on the latent-image-bearing member after the developer image has been transferred to a recording medium.

A first embodiment of the image-forming method of the present invention is an image-forming method comprising:

a charging step of charging a latent-image-bearing member electrostatically;

a latent-image-forming step of forming an electrostatic latent image on the charged surface of the latent-image-bearing member having been charged in the charging step;

a developing step of developing the electrostatic latent image to render it visible as a developer image by means of a developing assembly having a developer-carrying member which, holding thereon a developer, transports the developer to a developing zone facing the latent-image-bearing member;

a transfer step of transferring the developer image to a transfer medium; and a fixing step of fixing by a fixing means the developer image having been transferred to the transfer medium;

these steps being successively repeated to form images;

the developer and the developer-carrying member being constructed as described previously; and the charging being the step of charging the latent-image-bearing member electrostatically by applying a voltage to a charging means in the state the conductive fine particles the developer has stand interposed at the contact zone between the charging means and the latent-image-bearing member.

A second embodiment of the image-forming method of the present invention is an image-forming method comprising:

a charging step of charging a latent-image-bearing member electrostatically;

a latent-image-forming step of forming an electrostatic latent image on the charged surface of the latent-image-bearing member having been charged in the charging step;

a developing step of developing the electrostatic latent image to render it visible as a developer image by means of a developing assembly having a developer-carrying member which, holding thereon a developer, transports the developer to a developing zone facing the latent-image-bearing member;

a transfer step of transferring the developer image to a transfer medium; and a fixing step of fixing by a fixing means the developer image having been transferred to the transfer medium;

these steps being successively repeated to form images; and the developer and the developer-carrying member being constructed as described previously; and the developing step being the step of rendering the electrostatic latent image visible as a developer image, and at the same time collecting the developer having remained on the latent-image-bearing member after the developer image has been transferred to a recording medium.

The first embodiment of each of the process cartridge, image-forming apparatus and image-forming method described above is an embodiment employing what is called the contact charging system in which the charging step is to charge the latent-image-bearing member electrostatically by applying a voltage to a charging member kept in contact with the latent-image-bearing member, in the state the components of the developer stand interposed at the contact zone between the latent-image-bearing member and the charging member.

The second embodiment of each of the process cartridge, image-forming apparatus and image-forming method described above is an embodiment employing what is called the cleaning-at-development system in which the developing step serves also as the step of collecting the developer having remained on the latent-image-bearing member after the developer image has been transferred to a recording medium.

The developing assembly, process cartridge and image-forming method of the present invention are described below in detail.

First, the charging step in the image-forming method of the present invention is carried out using a charging assembly of a non-contact type, such as a corona charging assembly as a charging means, or using a contact charging assembly in which a conductive charging member (contact charging member or contact charging assembly) of a roller type (charging roller), a fur brush type, a magnetic-brush type or a blade type is kept in contact with a charging object member latent-image-bearing member and a stated charging bias is applied to this contact charging member (herein "contact charging member") to charge the surface of the charging object member electrostatically to the stated polarity and potential. In the present invention, it is preferable to use the contact charging assembly as having advantages of lower ozone generation and lower power consumption than the charging assembly of a non-contact type, such as the corona charging assembly.

The transfer residual toner particles on the latent-image-bearing member are considered to include those corresponding to a pattern of images to be formed and those ascribable to what is called fogging toner at areas where no image is formed. As to the transfer residual toner particles corresponding to a pattern of images to be formed, it is difficult for them to be completely collected in the cleaning-at-development. If their collection is inadequate, transfer residual toner particles not well collected may appear as they are, on images formed subsequently, to cause a pattern ghost. On such transfer residual toner particles corresponding to an image pattern, the collection performance in the cleaning-at-development can sharply be improved by leveling the pattern of transfer residual toner particles. For example, where the developing step is a contact development process, a relative difference in speed may be provided between the movement speed of the developer-carrying member holding thereon the developer and the movement speed of the latent-image-bearing member standing in contact with the developer-carrying member, whereby the pattern of transfer residual toner particles can be leveled and at the same time the transfer residual toner particles can be collected in a good efficiency. However, where transfer residual toner particles remain on the latent-image-bearing member in a large quantity as in the case when a power source is suddenly switched off in the course of image formation or at the time of paper jam, a pattern ghost may appear because the pattern of transfer residual toner particles having remained on the latent-image-bearing member obstructs latent-image formation by imagewise exposure. As a countermeasure therefor, where the contact charging assembly is used, the pattern of transfer residual toner particles may be leveled by means of the contact charging member. Thus, the transfer residual toner particles can be collected in a good efficiency even when the developing step is a non-contact development process, and the pattern ghost due to faulty collection can be prevented from occurring.

Also, in the case when the transfer residual toner particles remain on the latent-image-bearing member in a large quantity, too, the contact charging member first dams up the transfer residual toner particles, then levels the pattern of transfer residual toner particles, and send out the transfer residual toner particles gradually onto the latent-image-bearing member. Thus, the pattern ghost due to any obstruction of latent-image formation can be prevented. With regard to the lowering of charging performance on the latent-image-bearing member because of any contamination of the contact charging member when a large quantity of transfer residual toner particles are dammed up by the contact charging member, the lowering of uniform charging performance on the latent-image-bearing member can be lessened to a level of no problem in practical use by using the specific developer in the present invention. From this point of view, it is preferable in the present invention to use the contact charging assembly.

In the present invention, a relative difference in speed may be provided between the movement speed at the surface of the contact charging member and the movement speed at the surface of the latent-image-bearing member. The relative difference in speed provided between the movement speed at the surface of the contact charging member and the movement speed at the surface of the latent-image-bearing member may cause a great increase in torque between the contact charging member and the latent-image-bearing member and a remarkable scrape of the surfaces of the contact charging member and latent-image-bearing member. However, a lubricating effect (friction reduction effect) can be obtained where the components the developer has are made to interpose at the contact zone between the contact charging member and the latent-image-bearing member. This makes it possible to provide the difference in speed without causing any great increase in torque and any remarkable scrape.

The components the developer has which interpose at the contact zone between the contact charging member and the latent-image-bearing member may preferably contain at least the conductive fine particles descried previously. More preferably, the proportion of content of the conductive fine particles with respect to the whole developer components interposing at the contact zone may be higher than the proportion of content of the conductive fine particles contained in the developer in the present invention (i.e., the conductive fine particles in the developer before it is used in the image formation of the present invention). Inasmuch as the components the developer has which interpose at the contact zone contain at least the conductive fine particles, conduction paths between the latent-image-bearing member and the contact charging member can be ensured and the uniform charging performance on the latent-image-bearing member can be kept from lowering where the transfer residual toner particles adhere to or migrate into the contact charging member. Also, inasmuch as the proportion of content of the conductive fine particles with respect to the whole developer components interposing at the contact zone is higher than the proportion of content of the conductive fine particles contained in the developer in the present invention, the uniform charging performance on the latent-image-bearing member can be kept from lowering where the transfer residual toner particles adhere to or migrate into the contact charging member. In addition, even where a relatively large difference in relative-movement speed is provided between the contact charging member and the latent-image-bearing member, the contact charging member and the latent-image-bearing member can be kept from being scraped or scratched, because the conductive fine particles containing in a large number the particles ranging in particle diameter from 1.00 $\mu$m to less than 2.00 $\mu$m, which exhibit superior lubricating properties, are fed to the charging zone.

The charging bias applied to the contact charging member may be only DC voltage. Even by such voltage, good charging performance on the latent-image-bearing member can be achieved. It may also be a voltage formed by superimposing an alternating voltage (AC voltage) on DC voltage. As waveforms of such alternating voltage, any of sinusoidal waveform, rectangular waveform and triangular waveform may appropriately be used. The alternating voltage may also be a voltage of pulse waves formed by periodic on/off of a DC power source. Thus, as the alternating voltage, a bias may be used which has such a waveform that its voltage value changes periodically.

In the present invention, the charging bias applied to the contact charging member may preferably be applied within the range that any discharge products are not formed. More specifically, it may preferably be lower than the voltage at which the discharge starts occurring between the contact charging member and the charging object member (latent-image-bearing member). Also, a charging system predominantly governed by a direct-injection charging mechanism is preferred.

In the cleaning-at-development method, insulative transfer residual toner particles remaining on the latent-image-bearing member may come into contact with the contact charging member and adhere to or migrate into it to cause a lowering of the charging performance on the latent-image-bearing member. In the case of the charging system predominantly governed by a discharge charging mechanism, the charging performance on the latent-image-bearing member tends to lower abruptly around the time when a toner layer having adhered to the contact charging member surface comes to have a resistance which may obstruct the discharge voltage. On the other hand, in the case of the charging system predominantly governed by a direct-injection charging mechanism, the uniform charging performance on the charging object member (latent-image-bearing member) may lower where the transfer residual toner particles having adhered to or migrated into the contact charging member has lowered the probability of contact between the contact charging member surface and the charging object member. This may lower the contrast and uniformity of electrostatic latent images to cause a decrease in image density and make fog occur seriously.

According to the mechanism of the lowering of charging performance in the discharge charging mechanism and that in the direct-injection charging mechanism, the effect of preventing the charging performance on the latent-image-bearing member from lowering and the effect of promoting the charging of the latent-image-bearing member which are attributable to the conductive fine particles made to interpose at least at the contact zone between the latent-image-bearing member and the charging member kept in contact with the latent-image-bearing member are more remarkable in the direct-injection charging mechanism. Accordingly, the developer in the present invention may preferably be applied in the direct-injection charging mechanism.

More specifically, in the discharge charging mechanism, in order that the toner layer formed by the transfer residual toner particles adhering to or migrating into the contact charging member may be made not come to have the resistance which may obstruct the discharge voltage fed from the contact charging member to the latent-image-bearing member, by making at least the conductive fine particles interpose at the contact zone between the latent-image-bearing member and the charging member kept in contact with the latent-image-bearing member, the proportion of content of the conductive fine particles must be made higher with respect to the whole developer components interposing at the contact zone between the latent-image-bearing member and the charging member kept in contact with the latent-image-bearing member and at the charging region vicinal thereto. Accordingly, much more transfer residual toner particles must be sent out onto the latent-image-bearing member in order that the quantity of transfer residual toner particles thus adhering or migrating is restricted so that the toner layer having adhered to or migrated into the contact charging member may not come to have the resistance which may obstruct the discharge voltage. This tends to obstruct the formation of latent images.

On the other hand, in the direct-injection charging mechanism, contact points between the contact charging member and the charging object member can be ensured with ease via the conductive fine particles by making at least the conductive fine particles interpose at the contact zone between the latent-image-bearing member and the charging member kept in contact with the latent-image-bearing member. Thus, the transfer residual toner particles having adhered to or migrated into the contact charging member can be prevented from lowering the probability of contact between the contact charging member surface and the charging object member, and the charging performance on the latent-image-bearing member can be kept from lowering.

In particular, in the case when the relative difference in speed is provided between the movement speed at the surface of the contact charging member and the movement speed at the surface of the latent-image-bearing member, the quantity of the whole developer components interposing at the contact zone between the latent-image-bearing member and the contact charging member can be restricted by the rubbing friction between the contact charging member and the latent-image-bearing member. This can more surely keep the latent-image-bearing member from its charging obstruction, and also can remarkably add the opportunities of contact of the conductive fine particles with the latent-image-bearing member at the contact zone between the contact charging member and the latent-image-bearing member. Thus, the direct-injection charging to the latent-image-bearing member via the conductive fine particles can more be promoted. On the other hand, in the discharge charging, the discharge takes place not at the contact zone between the latent-image-bearing member and the contact charging member, but at a region where the latent-image-bearing member and the contact charging member are not in contact and have a minute gap. Hence, the effect of preventing the charging obstruction can not be expected which is attributable to the fact that the quantity of the whole developer components interposing at the contact zone is restricted.

From these viewpoints, too, it is preferable in the present invention to use the charging system predominantly governed by the direct-injection charging mechanism. The charging system predominantly governed by the direct-injection charging mechanism not relying on the discharge charging is preferred. To materialize such a charging system, the charging bias applied to the contact charging member may preferably be lower than the voltage at which the discharge starts taking place between the contact charging member and the charging object member (latent-image-bearing member).

As the construction that the relative difference in speed is provided between the movement speed at the surface of the contact charging member and the movement speed at the surface of the latent-image-bearing member, the difference in speed may preferably be provided by driving the contact charging member rotatingly.

The direction of the movement at the surface of the contact charging member and the direction of the movement speed at the surface of the latent-image-bearing member may preferably be opposite to each other. More specifically, the contact charging member and the latent-image-bearing member may move in the direction opposite to each other. In order that the transfer residual toner particles left on the latent-image-bearing member and carried to the contact charging member are temporarily collected in the contact charging member and are leveled there, the contact charging member and the latent-image-bearing member may preferably be moved in the direction opposite to each other. For example, the contact charging member may preferably be so constructed that it is rotatingly driven and, in addition, as its rotational direction it is rotated in the direction opposite to the direction of movement of the latent-image-bearing member surface at the contact zone between them. That is, the charging is performed in the state the transfer residual toner particles left on the latent-image-bearing member are first drawn apart by the rotation in the opposite direction. This makes it possible to perform the direct-injection charging mechanism predominantly and to keep the latent-image formation from being obstructed. In addition, improving the effect of leveling the pattern of transfer residual toner particles makes it possible to improve the collection performance on transfer residual toner particles and to more surely prevent the pattern ghost from occurring because of faulty collection.

The relative difference in speed may also be provided by moving the contact charging member in the same direction as the direction of movement of the latent-image-bearing member surface. However, the charging performance in the direct-injection charging depends on the ratio of the movement speed of the latent-image-bearing member to the relative movement speed of the contact charging member. Hence, in order to attain the same relative movement ratio as that in the case of opposite direction, the movement speed of the contact charging member rotated in the same direction must be made larger than the case of opposite direction. Thus, in view of the movement speed, it is more advantageous to move the charging member in the opposite direction. In the effect of leveling the pattern of transfer residual toner particles, too, it is more advantageous to move the charging member in the direction opposite to the movement direction of the latent-image-bearing member surface.

In the present invention, the ratio of the movement speed of the latent-image-bearing member to the relative movement speed of the contact charging member (relative movement speed ratio) may preferably be from 10% to 500%, and more preferably from 20% to 400%.

If the relative movement speed ratio is too small below the above range, the probability of contact between the contact charging member surface and the latent-image-bearing member can not sufficiently be made higher to make it difficult in some cases to maintain the charging performance on the latent-image-bearing member by the direct-injection charging. Moreover, the above effect that the quantity of the conductive fine particles interposing at the contact zone between the latent-image-bearing member and the contact charging member can be restricted by the rubbing friction between the contact charging member and the latent-image-bearing member and the effect of leveling the pattern of transfer residual toner particles to improve the collection performance on the developer in the cleaning-at-development can not be obtained in some cases.

If the relative movement speed ratio is too large beyond the above range, it follows that the movement speed of the contact charging member is made higher. Hence, the developer components carried to the contact zone between the latent-image-bearing member and the contact charging member may scatter to tend to cause in-machine contamination, and also the latent-image-bearing member and the contact charging member tend to wear or tend to be scratched, tending to come to have a short lifetime.

Where the movement speed of the contact charging member is 0 (in the state the contact charging member stands still), the point of contact of the contact charging member with the latent-image-bearing member comes to the fixed point. Hence, the part of contact of the contact charging member with the latent-image-bearing member tends to wear or deteriorate, and the effect of keeping the latent-image-bearing member from its charging obstruction and the effect of leveling the pattern of transfer residual toner particles to improve the collection performance on the developer in the cleaning-at-development tend to lower undesirably.

The relative movement speed ratio indicating the relative difference in speed described here can be represented by the following equation.

$$\text{Relative movement speed ratio } (\%) = |[(Vc-Vp)/Vp]\times 100|.$$

In the equation, Vc is the movement speed of the contact charging member surface, Vp is the movement speed of the latent-image-bearing member surface, and the movement speed Vc of the contact charging member surface is the value to be represented by the same letter symbol as the movement speed Vp of the latent-image-bearing member surface when the contact charging member surface moves in the same direction as the latent-image-bearing member surface at their contact zone.

In the present invention, the contact charging member may preferably have an elasticity in order to temporarily collect in the contact charging member the transfer residual toner particles left on the latent-image-bearing member and also to hold the conductive fine particles on the contact charging member and provide the contact zone between the latent-image-bearing member and the contact charging member to perform the direct-injection charging predominantly. The contact charging member may preferably-have an elasticity also in order to level the pattern of transfer residual toner particles by the aid of the contact charging member to improve the collection performance on transfer residual toner particles.

In the present invention, the latent-image-bearing member is charged by applying a voltage to the charging member, and hence the charging member may also preferably be conductive. Accordingly, the charging member may preferably be a magnetic brush contact charging member having a conductive elastic roller and a magnetic brush portion having magnetic particles bound magnetically to the roller, which magnetic brush portion is brought into contact with the charging object member, or a brush member comprised of conductive fibers. In view of an advantage that the construction of the charging member can be made simple, the charging member may preferably be an conductive elastic roller or a brush roller having conductivity. In view of an advantage that the developer components (e.g., the transfer residual toner particles and the conductive fine particles) adhering to or migrating into the charging member can stably be retained with ease without scattering, the charging member may preferably be the conductive elastic roller.

With regard to the hardness of the conductive elastic roller as a roller member, any too low hardness may make the roller member have so unstable a shape as to come into poor contact with the charging object member. Also, the conductive fine particles standing interposed at the contact zone between the roller member and the latent-image-bearing member may scrape or scratch the conductive elastic roller surface, so that no stable charging performance may be attained. On the other hand, any too high hardness not only may make it impossible to ensure the charging contact zone between the roller member and the charging object member, but also may make poor the micro-contact with the surface of the charging object member (latent-image-bearing member). Hence, any stable charging performance on the latent-image-bearing member can not be achieved. Moreover, the effect of leveling the pattern of transfer residual toner particles may lower to make it impossible to improve the collection performance on transfer residual toner particles. Accordingly, one may contemplate making higher the pressure of contact of the conductive elastic roller with the latent-image-bearing member. This, however, tends to cause scrape, scratch or the like of the roller contact charging member or latent-image-bearing member. From these viewpoints, the conductive elastic roller as the roller member may preferably have an Asker-C hardness ranging from 20 to 50, more preferably from 25 to 50, and most preferably from 25 to 40. Here, the Asker-C hardness is the hardness measured with a spring type hardness meter Asker-C (manufactured by Kohbunshi Keiki K.K.), prescribed in JIS K-6301. In the present invention, it is measured under a load of 9.8 N and in the form of a roller.

In the present invention, the surface of the roller member as a contact charging member may preferably have minute cells or unevenness so that the conductive fine particles can stably be retained thereon.

It is also important for the conductive elastic roller member to have an elasticity to attain a sufficient state of contact with the latent-image-bearing member and at the same time to function as an electrode having a resistance low enough to charge the moving latent-image-bearing member. On the other hand, it is necessary to prevent voltage from leaking when any defective portions such as pinholes are present in the latent-image-bearing member. In the case when the latent-image-bearing member such as an electrophotographic photosensitive member is used as the charging object member, the conductive elastic roller member may have a resistivity of from $10^3$ to $10^8$ Ω·cm, and preferably from $10^4$ to $10^7$ Ω·in order to achieve sufficient charging performance and anti-leak.

The volume resistivity of the conductive elastic roller member may be measured in the following way: A roller is kept in pressure contact with a cylindrical aluminum drum of 30 mm in diameter in such a way that a contact pressure of 49 N/m is applied to the roller, in the state of which a voltage of 100 V is applied across its mandrel and the aluminum drum to make measurement.

The conductive elastic roller may be produced by, e.g., forming on its mandrel a medium-resistance layer of a rubber or foam as a flexible member. The medium-resistance layer may be comprised of a resin (e.g., urethane), conductive particles (e.g., carbon black), a curing agent, a blowing agent and so forth, and is formed on the mandrel to provide the form of a roller. Thereafter, the roller formed may optionally be cut, and its surface may be ground to be shaped as desired, thus the conductive elastic roller can be produced.

Materials for the conductive elastic roller are by no means limited to elastic foams. As elastic materials, they may include rubber materials such as ethylene-propylene-diene polyethylene (EPDM), urethane, butadiene acrylonitrile rubber (NBR), silicone rubber and isoprene rubber. In order to control resistivity, a conductive material such as carbon black or a metal oxide may also be dispersed. Those obtained by blowing these may also be used. Also, the resistivity may be controlled using an ion-conductive material, without dispersing the conductive material or using the former in combination with the conductive material.

The conductive elastic roller is provided in contact with the charging object member latent-image-bearing member, resisting the elasticity and at a stated pressing force. There are no particular limitations on the width at this charging contact zone. It may preferably be in a width of 1 mm or more, and more preferably 2 mm or more, in order to attain stable and close contact between the conductive elastic roller and the latent-image-bearing member.

The charging member used in the charging step in the present invention may be one with which the latent-image-bearing member is charged by applying a voltage to a brush comprised of conductive fibers (brush member). Such a charging brush as a contact charging member may be comprised of fibers commonly used and a conductive material dispersed therein to make resistance control. As the fibers, commonly known fibers may be used, including, e.g., nylon, acrylic, rayon, polycarbonate or polyester. As the conductive material, commonly known conductive materials may be used, including, e.g., metals such as nickel, iron, aluminum, gold and silver; metal oxides such as iron oxide, zinc oxide, tin oxide, antimony oxide and titanium oxide; and also conductive powders such as carbon black. These conductive powders may optionally previously be subjected to surface treatment for the purpose of making hydrophobic or resistance control. When used, these conductive powders are selected taking account of dispersibility in fibers and productivity.

The charging brush serving as the contact charging member includes a fixed type and a rotatable roll type. Such a roll type charging brush includes, e.g., a roll brush obtained by winding in a spiral form a tape having conductive fibers made into pile fabric, around a mandrel made of a metal. The conductive fibers may have a fiber thickness of from 1 denier to 20 deniers (a fiber diameter of from about 10 $\mu$m to 500 $\mu$m), a brush fiber length of from 1 mm to 15 mm and a brush density of from 10,000 to 300,000 threads per square inch ($1.5\times10^7$ to $4.5\times10^8$ threads per square meter). Such a brush may preferably be used.

As the charging brush, a brush having a brush density as high as possible may preferably be used, and one fiber may also preferably be formed of few to hundreds of fine fibers. For example, as in 300 deniers/50 filaments, 50 fine fibers of 300 deniers may be bundled and may be set as one fiber. In the present invention, however, what determines the charging points of direct-injection charging depends chiefly on the density of interposition of conductive fine particles at the contact charging zone between the latent-image-bearing member and the contact charging member and its vicinity. Hence, the scope of selection for the contact charging member is widened.

The charging brush may preferably have, like the case of the conductive elastic roller, a resistivity of from $10^3$ Ω·cm to $10^8$ Ω·cm, and more preferably from $10^4$ Ω·cm to $10^7$ Ω·cm, in order to achieve sufficient charging performance and anti-leak.

Materials for the charging brush may include conductive Rayon fibers REC-B, REC-C, REC-M1 and REC-M10, available from Unichika. Ltd.; and also SA-7, available from Toray Industries, Inc.; Thunderon, available from Nihon Sanmo K.K.; Belltron, available from Kanebo, Ltd.; Clacarbo, available from Kuraray Co., Ltd., a product obtained by dispersing carbon in Rayon; and Roabal, available from Mitsubishi Rayon Co., Ltd. In view of environmental stability, REC-B, REC-C, REC-M1 and REC-M10 may particularly preferably be used.

The contact charging member may also have a flexibility. This is preferable in view of an advantage that opportunities of contact of the conductive fine particles with the latent-image-bearing member can be made larger at the contact zone between the contact charging member and the latent-image-bearing member to achieve a high contact performance and bring about an improvement in direct-injection charging performance. Namely, the contact charging member comes into close contact with the latent-image-bearing member via the conductive fine particles, and the conductive fine particles present at the contact zone between the contact charging member and the latent-image-bearing member rub the latent-image-bearing member surface closely. Thus, the charging of the latent-image-bearing member by the contact charging member is predominantly governed by safe and stable direct-injection charging performed via the conductive fine particles, not making use of any discharge phenomena. Accordingly, a high charging efficiency that has not been achievable by roller charging or the like performed by conventional discharge charging can be achieved by the employment of direct-injection charging performed via the conductive fine particles, and a potential substantially equal to the voltage applied to the contact charging member can be imparted to the latent-image-bearing member. In addition, inasmuch as the contact charging member has a flexibility, the effect of damming up the transfer residual toner particles temporarily and the effect of leveling the pattern of transfer residual toner particles can be made higher when a large quantity of transfer residual toner particles are fed to the contact charging member. Thus, any faulty images can more surely be prevented from occurring because of the obstruction of latent-image formation and the faulty collection of transfer residual toner particles.

As to the amount of interposition of the conductive fine particles at the contact zone between the latent-image-bearing member and the contact charging members, any too small amount of interposition can not sufficiently provide the effect of lubrication attributable to the conductive fine particles, resulting in a large friction between the latent-image-bearing member and the contact charging member, and hence it may become difficult for the contact charging member to be rotatingly driven with a difference in speed with respect to the latent-image-bearing member. Namely, any small amount of interposition of the conductive fine particles may make the drive torque excess, so that the surface of the contact charging member or latent-image-bearing member tends to scrape if rotated forcibly. Moreover, the effect of adding the opportunities of contact attributable to the conductive fine particles can not sufficiently be obtained in some cases, and no good charging performance on the latent-image-bearing member may be achievable. On the other hand, any too large amount of interposition of the conductive fine particles at the contact zone may make the conductive fine particles themselves come off from the contact charging member in a very large quantity. This may cause the obstruction of latent-image formation, such as shut-out of imagewise exposure light, to tend to adversely affect image formation.

According to studies made by the present invention, the amount of interposition of the conductive fine particles at the contact zone between the latent-image-bearing member and the contact charging member may preferably be 1,000 particles/mm$^2$ or more, and more preferably be 10,000 particles/mm$^2$ or more. Inasmuch as the amount of interposition of the conductive fine particles is 1,000 particles/mm$^2$ or more, the drive torque may by no means become excess, and the effect of lubrication attributable to the conductive fine particles can sufficiently be obtained. If the amount of interposition is greatly smaller than 1,000 particles/mm$^2$, the desired effect of adding the opportunities of contact can not sufficiently be obtained to tend to cause a lowering of the charging performance on the latent-image-bearing member.

In the case when the direct-injection charging system is used to perform the uniform charging of the latent-image-bearing member in the cleaning-at-development image-forming method, there is also a possibility of lowering of the charging performance on the latent-image-bearing member where the transfer residual toner particles adhere to or migrate into the contact charging member. In order to perform good direct-injection charging by keeping the transfer residual toner particles from adhering to or migrating into the contact charging member or by resisting any charging obstruction on the latent-image-bearing member which may be caused where the transfer residual toner particles adhere to or migrate into the contact charging member, the amount of interposition of the conductive fine particles at the contact zone between the latent-image-bearing member and the contact charging member may preferably be 10,000 particles/mm$^2$ or more. If the amount of interposition is greatly smaller than 10,000 particles/mm$^2$, the charging performance on the latent-image-bearing member tends to lower when the transfer residual toner particles are in a large quantity.

The proper range of the amount of presence of the conductive fine particles on the latent-image-bearing member in the charging step depends also on what effect of uniform charging performance on the latent-image-bearing member is obtainable by in what density coating the conductive fine particles on the latent-image-bearing member.

The upper-limit value of the amount of presence of the conductive fine particles on the latent-image-bearing member is up to the amount in which the conductive fine particles are uniformly applied to the latent-image-bearing member in one layer. Even if coated more than that, it does not follow that the effect is improved. Conversely, any excess conductive fine particles may be sent out after the charging step to cause difficulties that the particles shut out or scatter exposure light.

The upper-limit value of coating density may differ depending on, e.g., the particle diameter of the conductive fine particles and the retention of the conductive fine particles on the contact charging member, and can not sweepingly be specified. If anything to describe, the amount in which the conductive fine particles are uniformly applied to the latent-image-bearing member in one layer may be regarded as the upper limit.

If the amount of presence of the conductive fine particles on the latent-image-bearing member is more than 500,000 particles/mm$^2$, depending on the particle diameter and so forth of the conductive fine particles, the conductive fine particles tend to come off from the latent-image-bearing member in a very large quantity to contaminate the interior of the image-forming apparatus and also in some cases cause shortage of the amount of exposure on the latent-image-bearing member without regard to the light transmitting properties of the conductive fine particles themselves. As long as this amount of presence is not more than 500,000 particles/mm$^2$, the particles coming off can be controlled to a small quantity, so that the in-machine contamination due to the scatter of the conductive fine particles can be made less occur and also the exposure obstruction can better be prevented.

An experiment has also been made on the effect of improving the collection performance of transfer residual toner particles that is concerned with the amount of presence of the conductive fine particles on the latent-image-bearing member to find the following: Where the amount of presence of the conductive fine particles on the latent-image-bearing member after charging and before development is more than 100 particles/mm$^2$, the collection performance on transfer residual toner particles is clearly improved compared with an instance in which any conductive fine particles are not present on the latent-image-bearing member, and images formed by the cleaning-at-development and free of any image defects are obtained up to a level where the conductive fine particles are uniformly applied to the latent-image-bearing member in one layer. Like the case of the amount of presence of the conductive fine particles on the latent-image-bearing member after transfer and before charging, there is seen a tendency that the come-off of the conductive fine particles from the latent-image-bearing member becomes remarkable gradually at the level where the amount of presence of the conductive fine particles come to more than 500,000 particles/mm$^2$, to affect the latent-image formation to cause an increase in fog.

More specifically, the amount of interposition of the conductive fine particles at the contact zone between the latent-image-bearing member and the contact charging member may be set to be 1,000 particles/mm$^2$ or more and the amount of presence of the conductive fine particles on the latent-image-bearing member may be so set as to be 100 particles/mm$^2$ or more and not to be greatly more than 500,000 particles/mm$^2$. This is preferable to form images in good charging performance on the latent-image-bearing member, in good collection performance on transfer residual toner particles and without any image defects due to in-machine contamination or exposure obstruction. The amount of interposition of the conductive fine particles at the contact zone between the latent-image-bearing member and the contact charging member may preferably be set to be 10,000 particles/mm$^2$ or more.

The relationship between the amount of interposition of the conductive fine particles at the contact zone between the latent-image-bearing member and the contact charging member and the amount of presence of the conductive fine particles on the latent-image-bearing member can not sweepingly be specified because there are factors such as (1) the feed (quantity) of the conductive fine particles to the contact zone between the latent-image-bearing member and the contact charging member, (2) the adhesion of the conductive fine particles to the latent-image-bearing member and contact charging member, (3) the retention of the contact charging member for the conductive fine particles and (4) the retention of the latent-image-bearing member for the conductive fine particles. Experimentally, it has been found that, in measuring the amount of presence of particles having come off on the latent-image-bearing member (the amount of presence of the conductive fine particles on the latent-image-bearing member in the latent-image-forming step), it is 100 to 100,000 particles/mm$^2$ within the range that the amount of interposition of the conductive fine particles at the contact zone between the latent-image-bearing member and the contact charging member is 1,000 to 1,000,000 particles/mm$^2$.

A method of measuring the amount of interposition of the conductive fine particles at the contact zone and the amount of presence of the conductive fine particles on the latent-image-bearing member is described below.

To know the amount of interposition of the conductive fine particles at the contact zone, it is preferable to directly measure the value at the contact zone between the contact charging member and the latent-image-bearing member. However, where the movement direction of the surface of the contact charging member which forms the contact zone is opposite to the movement direction of the surface of the latent-image-bearing member, most of the particles having been present on the latent-image-bearing member before its contact with the contact charging member are taken off by the contact charging member coming into contact while moving in the opposite direction. Accordingly, in the present invention, the quantity of particles on the contact charging member surface immediately before their reach to the contact zone is regarded as the amount of interposition.

Stated specifically, the rotation of the latent-image-bearing member and conductive elastic roller (contact charging member) is stopped in the state any charging bias is not applied thereto, and the surfaces of the latent-image-bearing member and conductive elastic roller are photographed using a videomicroscope (OVM100N, manufactured by Olympus) and a digital still recorder (SR-3100, manufactured by Deltis). As to the conductive elastic roller, the conductive elastic roller is brought into contact with a slide glass under the same conditions for bringing the conductive elastic roller into contact with the latent-image-bearing member, and the contact area is photographed on the back of the slide glass at 10 spots or more, using the videomicroscope and through an objective lens of 1,000 magnifications. In order to separate individual particles regionally from the digital image obtained, the data are binarized with a certain threshold value, and the number of regions where the particles are present is measured using a desired image-processing software. As to the amount of presence on the latent-image-bearing member, too, the surface of the latent-image-bearing member is photographed with the like videomicroscope, and the like processing is performed to make measurement.

The amount of presence of the conductive fine particles on the latent-image-bearing member is measured by photographing the surface of the latent-image-bearing member after transfer and before charging, and after charging and before development, by the same means as the above, using an image-processing software.

In the present invention, the latent-image-bearing member may have an outermost surface layer having a volume resistivity of from $1\times10^{9}$ Ω·cm to $1\times10^{14}$ Ω·cm, and preferably from $1\times10^{10}$ Ω·cm to $1\times10^{14}$ Ω·cm. This is preferable because better charging performance can be provided on the latent-image-bearing member. In the charging system employing the direct-injection of electric charges, electric charges can be delivered and received in a good efficiency where the resistivity on the side of the charging object member is low controlled. For such a purpose, the outermost surface layer may preferably have a volume resistivity of $1\times10^{14}$ Ω·cm or less. Meanwhile, in order to retain electrostatic latent images for a stated time as the role of the latent-image-bearing member, the outermost surface layer may preferably have a volume resistivity of $1\times10^{9}$ Ω·cm or more. In order to retain electrostatic latent images without causing any disorder of even minute latent images, it may preferably have a volume resistivity of $1\times10^{10}$ Ω·cm or more.

The latent-image-bearing member may further be an electrophotographic photosensitive member and the outermost surface layer of the electrophotographic photosensitive member may have a volume resistivity of from $1\times10^{9}$ Ω·cm to $1\times10^{14}$ Ω·cm. This is more preferable because sufficient charging performance can be provided on the electrophotographic photosensitive member.

The latent-image-bearing member may also preferably be a photosensitive drum or photosensitive belt having a photoconductive insulating material layer formed of a photoconductive insulating material such as amorphous selenium, CdS, $ZnO_2$ or amorphous silicon. A photosensitive member having an amorphous silicon photosensitive layer or an organic photosensitive layer may particularly preferably be used.

The organic photosensitive layer may be of a single-layer type in which the photosensitive layer contains a charge-generating material and a charge-transporting material in the same layer, or may be a function-separated photosensitive layer comprised of a charge transport layer and a charge generation layer. A multi-layer type photosensitive layer comprising a conductive substrate and superposingly formed thereon the charge generation layer and the charge transport layer in this order is one of preferred examples.

Adjustment of surface resistance of the latent-image-bearing member enables more stable performance of the uniform charging of the latent-image-bearing member.

In order to make charge injection more efficient or accelerate it by adjusting the surface resistance of the latent-image-bearing member, it is also preferable to provide a charge injection layer on the surface of the electrophotographic photosensitive member. The charge injection layer may preferably have a form in which conductive fine particles are dispersed in a resin.

In the present invention, the latent-image-forming step of forming an electrostatic latent image on the charged surface of the latent-image-bearing member and the latent-image-forming means may preferably be the step of writing image information as an electrostatic latent image on the latent-image-bearing member surface by imagewise exposure and an imagewise exposure means, respectively. As the imagewise exposure means, it is by no means limited to laser scanning exposure means by which digital latent images are formed, and may also be other light-emitting device such as usual analog imagewise exposure means or LED. It may still also be a means having in combination a light-emitting device such as a fluorescent lamp and a liquid-crystal shutter or the like. Any of these will do as long as electrostatic latent images corresponding to the image information can be formed.

The latent-image-bearing member may be an electrostatic recording dielectric member. In this case, a dielectric surface as the latent-image-bearing member surface is uniformly primarily charged to the stated polarity and potential and thereafter destaticized selectively by a distaticizing means such as a destaticization stylus head or an electron gun to write and form the intended electrostatic latent image.

In the present invention, the surface of the developer-carrying member that carries the developer may move in the same direction as the direction of movement of the latent-image-bearing member surface, or may move in the opposite direction. In the case when the former's movement direction is the same direction as the latter's, the movement speed of the developer-carrying member surface may preferably be 100% or more in ratio with respect to the movement speed of the latent-image-bearing member surface. If it is less than 100%, a poor image quality may result.

As long as the ratio of the movement speed of the developer-carrying member surface to the movement speed of the latent-image-bearing member surface is 100% or more (i.e., the movement speed of the developer-carrying member surface is equal to or higher than the movement speed of the latent-image-bearing member surface), the toner particles can sufficiently be fed from the developer-carrying member side to the latent-image-bearing member side, and hence a sufficient image density can be achieved with ease and the conductive fine particles can also sufficiently be fed. Thus, good charging performance on the latent-image-bearing member can be achieved.

In addition, the movement speed of the developer-carrying member surface may preferably be 1.05 to 3.0 times the movement speed of the latent-image-bearing member surface. With an increase in the movement speed ratio, the developer is fed to the developing zone in a larger quantity, and the developer is more frequently taken on and off the electrostatic latent image, where it is repeatedly scraped off at the unnecessary part and imparted to the necessary part, so that the collection performance of transfer residual toner particles can be improved and any pattern ghost due to faulty collection can more surely be kept from occurring. Moreover, images faithful to latent images can be obtained. Also, in the contact development process, with an increase in the movement speed ratio, the collection performance of transfer residual toner particles is more improved on account of the friction between the latent-image-bearing member and the developer-carrying member. However, if the movement speed ratio is greatly beyond the above range, fog and image stain tend to occur because of the scattering of developer from the surface of the developer-carrying member. Thus, in the contact development process, the latent-image-bearing member or the developer-carrying member tends to have a short lifetime due to wear or scrape caused by their rubbing friction. Where the developer layer thickness regulation member which regulates the quantity of developer on the developer-carrying member is kept in contact with the developer-carrying member via the developer, the developer layer thickness regulation member or the developer-carrying member tends to have a short lifetime due to wear or scrape caused by their rubbing friction. From the foregoing viewpoint, the movement speed of the developer-carrying member surface may more preferably be 1.1 to 2.5 times the movement speed of the latent-image-bearing member surface.

In the present invention, in order to apply the non-contact type developing system, the developer layer on the developer-carrying member may preferably be formed in a thickness smaller than the preset gap distance at which the developer-carrying member is set apart from the latent-image-bearing member. The present invention has made it possible to materialize at a high image quality level the cleaning-at-development image formation making use of the non-contact type developing system, which has been difficult in the past. In the developing step, the non-contact type developing system is used in which the developer layer is set non-contact with the latent-image-bearing member and the electrostatic latent image on the latent-image-bearing member is rendered visible as a developer image. Thus, any development fog which may be caused by the development bias injected into the latent-image-bearing member does not occur even when conductive fine particles having a low electrical-resistance value are added into the developer in a large quantity. Hence, good images can be obtained.

In this case, the developer-carrying member may also preferably be set opposingly to the latent-image-bearing member, having a gap distance of from 100 $\mu$m to 1,000 $\mu$m between them. If the gap distance at which the developer-carrying member is set apart from the latent-image-bearing member is too small below the above range, the developing performance of the developer may greatly change with respect to any variations of the gap distance. Hence, this makes it difficult to mass-produce image-forming apparatus which satisfy stable image characteristics. If the gap distance at which the developer-carrying member is set apart from the latent-image-bearing member is too large beyond the above range, the toner particles may have a low follow-up performance with respect to the latent image on the latent-image-bearing member. Hence, this tends to cause a lowering of image quality such as a lowering of resolution and a decrease in image density. Also, the performance of feeding the conductive fine particles onto the latent-image-bearing member tends to lower, and the charging performance on the latent-image-bearing member tends to lower.

From these viewpoints, the developer-carrying member may more preferably be set opposingly to the latent-image-bearing member, having a gap distance of from 100 $\mu$m to 600 $\mu$m between them. Inasmuch as the gap distance at which the developer-carrying member is set apart from the latent-image-bearing member is 100 $\mu$m to 600 $\mu$m, the collection of transfer residual toner particles in the cleaning-at-development step can more predominantly be performed. If the gap distance is too large beyond this range, the performance of collecting transfer residual toner particles to the developing assembly may lower to tend to cause fog due to faulty collection.

In the present invention, the development may preferably be performed by the step of development performed forming an alternating electric field (AC electric field) across the developer-carrying member and the latent-image-bearing member. The alternating electric field can be formed by applying an alternating voltage across the developer-carrying member and the latent-image-bearing member. The development bias applied may be one formed by superimposing an alternating voltage (AC voltage) on DC voltage.

As waveforms of such alternating voltage, any of sinusoidal waveform, rectangular waveform and triangular waveform may appropriately be used. They also be pulse waves formed by periodic on/off of a DC power source. Thus, as the waveform of alternating voltage, a waveform such that its voltage value changes periodically.

At least an AC electric field (alternating electric field) of from $3\times10^6$ to $10\times10^6$ V/m in peak-to-peak electric field intensity and from 100 to 5,000 Hz in frequency may preferably be formed across the developer-holding developer-carrying member and the latent-image-bearing member by applying the development bias. Forming the alternating electric field within the above range by applying the development bias makes it easy for the conductive fine particles added to the developer to uniformly move to the latent-image-bearing member side. Also, the uniform and dense contact attained between the contact charging member and the latent-image-bearing member at the charging zone via the conductive fine particles can remarkably promote the uniform charging (in particular, the direct-injection charging) of the latent-image-bearing member. Still also, since the alternating electric field is formed by applying the development bias, any injection of electric charges into the latent-image-bearing member does not take place at the developing zone even when a great difference in potential is present between the developer-carrying member and the latent-image-bearing member, and hence any development fog which may be caused when the development bias injects electric charges into the latent-image-bearing member does not occur even when the conductive fine particles are added to the developer in a large quantity. Thus, good images can be obtained.

If the alternating electric field formed by applying the development bias across the developer-carrying member and the latent-image-bearing member is at an intensity too low below the above range, the conductive fine particles fed to the latent-image-bearing member tend to be in an insufficient quantity to tend to lower the uniform charging of the latent-image-bearing member. Also, because of a weak development power, images with a low image density tend to be formed. If on the other hand the alternating electric field is at an intensity too high beyond the above range, the development powder may be so strong as to tend to cause a lowering of resolution due to fine-line crushing, a lowering of image quality due to an increase in fog and a lowering of charging performance on the latent-image-bearing member, and tend to cause image defects due to a leak of development bias to the latent-image-bearing member.

If the alternating electric field formed by applying the development bias across the developer-carrying member and the latent-image-bearing member has a frequency too low below the above range, it may be hard for the conductive fine particles to be uniformly fed to the latent-image-bearing member, to tend to cause unevenness in the uniform charging of the latent-image-bearing member. If the alternating electric field has a frequency too high beyond the above range, the conductive fine particles fed to the latent-image-bearing member tend to be in an insufficient quantity to tend to lower the uniform charging of the latent-image-bearing member.

At least an AC electric field (alternating electric field) of from $4\times10^6$ to $10\times10^6$ V/m in peak-to-peak electric field intensity and from 500 to 4,000 Hz in frequency may more preferably be formed across the developer-holding developer-carrying member and the latent-image-bearing member by applying the development bias. Forming the alternating electric field within the above range by applying the development bias makes it easy for the conductive fine particles added to the developer to uniformly move to the latent-image-bearing member side, makes it able for the conductive fine particles to be uniformly applied to the latent-image-bearing member after transfer, and makes it able to maintain a high performance of collecting transfer residual toner particles also when the non-contact type developing system is applied.

If the alternating electric field formed by applying the development bias across the developer-carrying member and the latent-image-bearing member is at an intensity too low below the above range, the performance of collecting transfer residual toner particles to the developing assembly may lower to tend to cause fog due to faulty collection. Also, if the alternating electric field formed by applying the development bias across the developer-carrying member and the latent-image-bearing member is at a frequency too low below the above range, the developer may less frequently be taken on and off the electrostatic latent image to tend to lower the performance of collecting transfer residual toner particles to the developing assembly, and tend to lower image quality, too. If the alternating electric field has a frequency too high beyond the above range, toner particles which can follow up any changes of the electric field may be in a small quantity to lower the collection performance on transfer residual toner particles to tend to cause positive ghost due to faulty collection performance on the transfer residual toner particles.

In the present invention, the transfer step may be the step of transferring to an intermediate transfer member the developer image formed through the developing step, and thereafter again transferring the developer image to the recording medium such as paper. More specifically, the transfer medium to which the developer image is transferred may also be an intermediate transfer member such as a transfer drum. In the case when the transfer medium serves as the intermediate transfer member, the developer image is obtained by again transferring it from the intermediate transfer member to the recording medium such as paper. The use of such an intermediate transfer member can make smaller the quantity of transfer residual toner particles on the latent-image-bearing member without regard to recording mediums of various types such as cardboards.

In the present invention, the intermediate transfer member may also preferably be in contact with the latent-image-bearing member via the transfer medium (as the recording medium) at the time of transfer.

In the step of contact transfer in which the developer image on the latent-image-bearing member is transferred to the transfer medium while a transfer means is kept in contact with the latent-image-bearing member via the transfer medium, the transfer means may preferably be at a contact pressure of from 2.94 to 980 N/m, and more preferably from 19.6 to 490 N/m, in linear pressure. If the transfer means is at a contact pressure too low below the above range, transport aberration of transfer mediums and faulty transfer tend to occur, undesirably. A contact pressure which is too high beyond the above range may cause deterioration of or developer adhesion to the latent-image-bearing member surface to consequently cause the melt adhesion of developer to the latent-image-bearing member surface.

As the transfer means in the transfer step, an assembly having a transfer roller or a transfer belt may preferably be used. The transfer roller may have at least a mandrel and a conductive elastic layer covering the mandrel, and the conductive elastic layer may preferably be an elastic member comprised of a solid or foamed-material layer made of an elastic material such as polyurethane rubber or ethylene-propylene-diene polyethylene (EPDM) in which a conductivity-providing agent such as carbon black, zinc oxide, tin oxide or silicon carbide has been mixed and dispersed to adjust electrical resistance (volume resistivity) to a medium resistance of from 106 to $10^{10}$ Ω·cm.

As preferable transfer process conditions in the transfer roller, the contact pressure of the transfer roller may be from 2.94 to 490 N/m, and more preferably from 19.6 to 294 N/m. If the linear pressure as the contact pressure is too low below the above range, the transfer residual toner particles may increase to tend to damage the charging performance on the latent-image-bearing member. If the contact pressure is too high beyond the above range, the transfer residual toner particles tend to be transferred because of the pressing force, so that the feed of the transfer residual toner particles to the latent-image-bearing member or contact charging member may decrease to lower the effect of promoting the charging of the latent-image-bearing member and lower the collection performance of transfer residual toner particles in the cleaning-at-development. Also, developer spots around line images may also greatly occur.

In the contact transfer step in which the developer image is transferred to the transfer medium while the transfer means is kept in contact with the latent-image-bearing member via the transfer medium, the DC voltage may preferably be from ±0.2 to ±10 kV.

The developing assembly of the present invention is also especially effectively usable in image-forming apparatus having a small-diameter drum type photosensitive member having a diameter of 30 mm or less. More specifically, since any independent cleaning step is not provided after the transfer step and before the charging step, the charging, exposure, developing and transfer steps can be provided at a higher degree of freedom, and, in combination with the small-diameter photosensitive member having a diameter of 30 mm or less, the image-forming apparatus can be made compact and space-saving. In beltlike photosensitive members, too, the respective steps can likewise be provided at a higher degree of freedom. Accordingly, the developing assembly of the present invention is effective also for image-forming apparatus making use of a photosensitive belt which forms a curvature radius of 25 mm or less at the contact portion.

EXAMPLES

The present invention is described below in greater detail by giving Examples. The present invention is by no means limited to these Examples.

First, production examples of the toner particles contained in the developer, examples of the conductive fine particles and production examples of the developers are described.

Toner Particles

Production Example 1

100 parts by weight of a styrene-butyl acrylate-monobutyl maleate copolymer (copolymerization ratio: 75:15:10; Mn: 5,000, Mw: 300,000; Tg: 58° C.) as a binder resin, 90 parts by weight of magnetite (saturation magnetization of 85 $Am^2/kg$, residual magnetization of 6 $Am^2/kg$ and coercive force of 5 kA/m under magnetic field of 795.8 kA/m) as a magnetic powder, 2 parts by weight of a monoazo iron complex (negative charge control agent) and 4 parts by weight of Fischer-Tropsh wax (release agent) were mixed by means of a Henschel mixer, and the mixture obtained was melt-kneaded by means of a twin-screw extruder heated to 130° C. The kneaded product obtained was cooled and thereafter crushed, and the crushed product obtained was pulverized by means of a fine grinding mill making use of jet streams. The pulverized product obtained was further strictly classified by means of a multi-division classifier utilizing the Coanda effect, to obtain negatively chargeable toner particles 1 (T-1) having a weight-average particle diameter (D4) of 6.9 μm determined from the particle size distribution in the range of particle diameter of from 0.60 μm to less than 159.21 μm. Also, in the endothermic curve of a DSC chart, the maximum endothermic peak was present at 96° C.

Toner Particles

Production Example 2

100 parts by weight of a polyester resin as a binder resin, obtained by adding terephthalic acid, fumaric acid, trimellitic acid, ethylene oxide addition bisphenol A and propylene oxide addition bisphenol A in a molar ratio of 33:14:7:24:22 followed by condensation polymerization (acid value: 28, hydroxyl value: 10; Mn: 6,000, Mw: 400,000; Tg: 60° C.), 90 parts by weight of magnetite (saturation magnetization of 85 $Am^2/kg$, residual magnetization of 6 $Am^2/kg$ and coercive force of 5 kA/m under magnetic field of 795.8 kA/m) as a magnetic powder, 2 parts by weight of an iron complex of 3,5-di-t-butylsalicylic acid (negative charge control agent) and 4 parts by weight of low-molecular-weight polypropylene (release agent) were mixed by means of a Henschel mixer, and the mixture obtained was melt-kneaded by means of a twin-screw extruder heated to 130° C. The kneaded product obtained was cooled and thereafter crushed, and the crushed product obtained was pulverized by means of a fine grinding mill making use of jet streams. The pulverized product obtained was further strictly classified by means of a multi-division classifier utilizing the Coanda effect, to obtain negatively chargeable toner particles 2 (T-2) having a weight-average particle diameter (D4) of 7.5 μm determined from the particle size distribution in the range of particle diameter of from 0.60 μm to less than 159.21 μm. Also, in the endothermic curve of a DSC chart, the maximum endothermic peak was present at 114° C.

Toner Particles

Production Example 3

100 parts by weight of a styrene-butyl acrylate-monobutyl maleate copolymer (copolymerization ratio: 75:15:10; Mn: 5,000, Mw: 300,000; Tg: 58° C.) as a binder resin, 90 parts by weight of magnetite (saturation magnetization of 85 $Am^2/kg$, residual magnetization of 6 $Am^2/kg$ and coercive force of 5 kA/m under magnetic field of 795.8 kA/m) as a magnetic powder, 2 parts by weight of a monoazo iron complex (negative charge control agent) and 4 parts by weight of Fischer-Tropsh wax (release agent) were mixed by means of a Henschel mixer, and the mixture obtained was melt-kneaded by means of a twin-screw extruder heated to 130° C. The kneaded product obtained was cooled and thereafter crushed, and the crushed product obtained was pulverized by means of a mechanical grinding mill. The pulverized product obtained was further strictly classified by means of a multi-division classifier utilizing the Coanda effect, to obtain negatively chargeable toner particles 3 (T-3) having a weight-average particle diameter (D4) of 6.0 μm determined from the particle size distribution in the range of particle diameter of from 0.60 μm to less than 159.21 μm. Also, in the endothermic curve of a DSC chart, the maximum endothermic peak was present at 97° C.

Toner Particles

Production Example 4

Negatively chargeable toner particles 4 (T-4) having a weight-average particle diameter (D4) of 6.8 μm was obtained in the same manner as in Toner Particles Production Example 1 except that, in place of the magnetic powder, 7 parts by weight of carbon black was used as a colorant. In the endothermic curve of a DSC chart, the maximum endothermic peak was present at 94° C.

Toner Particles

Production Example 5

In Toner Particles Production Example 1, conditions for the pulverization and classification were changed to obtain negatively chargeable toner particles 5 (T-5) having a weight-average particle diameter (D4) of 8.7 μm determined from the particle size distribution in the range of particle diameter of from 0.60 μm to less than 159.21 μm.

Toner Particles

Production Example 6

In Toner Particles Production Example 1, conditions for the pulverization and classification were changed to obtain negatively chargeable toner particles 6 (T-6) having a weight-average particle diameter (D4) of 9.5 μm determined from the particle size distribution in the range of particle diameter of from 0.60 μm to less than 159.21 μm.

Conductive Fine Particles

Examples 1 to 7

Primary particles of zinc oxide were granulated by pressure, followed by air classification to obtain conductive fine zinc oxide particles C-1 to C-7. These particles were all white. Also, physical properties of these conductive fine particles were as shown in Table 2.

Conductive Fine Particles

Examples 8 and 9

Primary particles of tin oxide were granulated by pressure, followed by air classification to obtain conductive fine tin oxide particles C-8 and C-9. These particles were all white. Also, their physical properties were as shown in Table 2.

Conductive Fine Particles

Example 10

Primary particles of titanium oxide were granulated by pressure, followed by air classification to remove coarse particles, and thereafter dispersed in an aqueous system, followed by filtration carried out repeatedly to remove fine particles to obtain white fine titanium oxide particles C-10. Their physical properties were as shown in Table 2.

TABLE 2

| Conductive fine particles | Material | Volume-average particle diameter (μm) | Volume resistivity (Ω · cm) |
|---|---|---|---|
| C-1 | ZnO | 1.0 | $1.0 \times 10^4$ |
| C-2 | ZnO | 1.5 | $9.1 \times 10^5$ |
| C-3 | ZnO | 0.5 | $5.3 \times 10^3$ |
| C-4 | ZnO | 5.5 | $1.0 \times 10^4$ |
| C-5 | ZnO | 0.06 | $1.0 \times 10^4$ |
| C-6 | ZnO | 1.0 | $7.2 \times 10^0$ |
| C-7 | ZnO | 1.0 | $1.9 \times 10^{10}$ |
| C-8 | $SnO_2$ | 0.8 | $5.8 \times 10^3$ |
| C-9 | $SnO_2$ | 2.1 | $3.6 \times 10^5$ |
| C-10 | $TiO_2$ | 0.9 | $1.5 \times 10^6$ |

Developer

Production Example 1

To 100 parts by weight of the magnetic toner particles T-1, 1.0 part by weight of fine silica particles having been surface-treated with dimethylsilicone oil and hexamethyldisilazane (BET specific surface area: 300 $m^2/g$), 0.6 part by weight of fine strontium titanate particles (volume-average particle diameter: 1.0 μm) and 1.0 part by weight of the conductive fine zinc oxide particles C-1 were added, and these were uniformly mixed by means of a Henschel mixer to obtain a negatively chargeable magnetic developer D-1.

The particle size distribution in the range of particle diameter of from 0.60 μm to less than 159.21 μm of the magnetic developer D-1 thus obtained was, as described in the embodiments of the invention, measured with the flow type particle image analyzer FPIA-1000 (manufactured by Toa Iyou Denshi K.K.). To describe it in greater detail, 10 ml of water from which fine dust had been removed through a filter (preferably so made that the number of particles ranging in particle diameter from 0.60 μm to less than 159.21 μm as circle-equivalent diameter was measured to be 20 or less particles in $10^3$ $cm^3$) and few drops of a diluted surface-active agent (preferably one prepared by diluting an alkylbenzenesulfonate to about 1/10 with water from which fine dust had been removed) were added into a screw-mouthed bottle of 30 mm in inner diameter and 65 mm in height and made of hard glass (e.g., a screw-mouthed bottle for 30 ml, SV-30, available from Nichiden Rikagarasu K.K.). To this, a measuring sample was so added in an appropriate quantity (e.g., 0.5 to 20 mg) that the particle concentration of the measuring sample came 7,000 to 10,000 particles/$10^3$ $cm^3$ in respect of particles ranging in circle-equivalent diameters measured, and dispersed by means of an ultrasonic homogenizer for 3 minutes (a step-type chip of 6 mm diameter was applied in Ultrasonic Homogenizer UH-50, manufactured by K.K. SMT, with an output of 50 W and a frequency of 20 kHz, and treated setting the scale of power control volume to 7, e.g., at a dispersion power of about a half of the maximum output obtained when the same chip was used) to prepare a sample dispersion. Using this sample dispersion, the particle size distribution of particles having circle-equivalent diameters of from 0.60 μm to less than 159.21 μm were measured.

The content (% by number) of the particles ranging in particle diameter from 1.00 μm to less than 2.00 μm and 3.00 μm to less than 8.96 μm each were determined from the particle size distribution thus obtained. The data of the particle size distribution and so forth are shown in Table 3.

Developer

Production Examples 2 to 17

To 100 parts by weight of the magnetic toner particles shown in Table 3, 1.0 part by weight of fine silica particles having been surface-treated with dimethylsilicone oil and hexamethyldisilazane (BET specific surface area: 300 $m^2/g$), 0.6 part by weight of fine strontium titanate particles (volume-average particle diameter: 1.0 μm) and the stated amount of the conductive fine particles shown in Table 3 were added, and these were uniformly mixed by means of a Henschel mixer to obtain negatively chargeable magnetic developers D-2 to D-13 and D-15 to 17 and a negatively chargeable magnetic developer D-14 (without the conductive fine particles). Then, in the same manner as in Developer Production Example 1, the particle size distribution of each developer obtained was measured. Formulation and particle size distribution data are shown in Table 3.

TABLE 3

| | Toner | Conductive fine particles | | Particle size distribution | | |
|---|---|---|---|---|---|---|
| Developer | Particles | | Content (wt. %) | Volume-average particle diameter (μm) | 1.00 to < 2.00 μm particles, % by number | 3.00 to < 8.96 μm particles, % by number |
| D-1 | T-1 | C-1 | 1.0 | 6.8 | 35.7 | 22.9 |
| D-2 | T-1 | C-2 | 1.5 | 6.8 | 38.9 | 25.1 |
| D-3 | T-1 | C-3 | 2.0 | 6.8 | 40.2 | 25.9 |
| D-4 | T-1 | C-4 | 1.0 | 6.9 | 27.6 | 14.8 |
| D-5 | T-1 | C-5 | 2.0 | 6.6 | 61.1 | 25.1 |
| D-6 | T-1 | C-1 | 0.6 | 6.8 | 31.4 | 19.8 |
| | | C-8 | 0.4 | | | |
| D-7 | T-1 | C-1 | 0.7 | 6.8 | 35.1 | 21.4 |
| | | C-10 | 0.1 | | | |
| D-8 | T-2 | C-1 | 1.0 | 7.5 | 18.8 | 53.1 |
| D-9 | T-2 | C-3 | 1.0 | 7.3 | 24.3 | 27.8 |
| D-10 | T-2 | C-6 | 1.0 | 7.5 | 19.7 | 52.7 |
| D-11 | T-2 | C-7 | 1.0 | 7.5 | 19.4 | 54.1 |
| D-12 | T-3 | C-1 | 1.0 | 6.0 | 21.0 | 53.9 |
| D-13 | T-3 | C-1 | 0.2 | 6.1 | 19.1 | 49.8 |
| | | C-9 | 0.8 | | | |

TABLE 3-continued

| Developer | Toner Particles | Conductive fine particles | Content (wt. %) | Volume-average particle diameter (μm) | Particle size distribution: 1.00 to < 2.00 μm particles, % by number | Particle size distribution: 3.00 to < 8.96 μm particles, % by number |
|---|---|---|---|---|---|---|
| D-14 | T-4 | C-1 | 1.0 | 6.8 | 35.9 | 23.1 |
| D-15 | T-5 | C-1 | 0.3 | 8.7 | 13.4 | 43.7 |
| D-16 | T-6 | C-1 | 1.0 | 9.5 | 15.1 | 73.4 |
| D-17 | T-1 | — | — | 6.8 | 9.8 | 73.5 |

Developer-Carrying Member

Production Example 1

An aluminum sleeve crude pipe of 20 mm in outer diameter, 0.65 mm in wall thickness, having a Vickers hardness Hv of 100 was used. First, its surface was blast-treated. As blast abrasive grains therefor, spherical glass beads of 25 μm in particle diameter were used, and the blast treatment was carried out in the following way.

The glass beads were blown against the sleeve, rotating at 0.6 $s^{-1}$ (36 rpm), in four directions from four nozzles of 7 mm in diameter positioned at a distance of 150 mm from the sleeve, and were blown at a blast pressure of 2.5 $kg/cm^2$ for each and for 9 seconds (for 36 seconds in total). After the blast treatment, in order to remove blast abrasive grains remaining on the sleeve crude pipe, the surface of the sleeve was washed, and thereafter dried. After drying and air cooling, the surface roughness of the sleeve was measured to find that Ra was 0.73 μm.

Next, as plating pretreatment, the surface of the above blasted sleeve was subjected to zincate treatment to deposit zinc on the surface. In this zincate treatment, a commercially available zincate treating agent (trade name: Shyuma K-102; available from Nihon Kanizen K.K.).

Thereafter, the above zincate surface-treated sleeve was immersed in an electroless Ni—P plating bath to form an electroless Ni—P metallic-coating layer of 7 μm thick. The plating was so carried out that the concentration of P in the Ni—P metallic-coating layer came to 10.3% by weight. As the electroless Ni—P plating bath, a commercially available plating bath (trade name: S-754; available from Nihon Kanizen K.K.) was used. The sleeve on which the Ni—P metallic-coating layer was formed had a hardness Hv of 500 and a surface roughness Ra of 0.75 μm. In the interior of the sleeve thus provided with the metallic-coating layer on its surface, a magnet roller was set built-in and then flanges were attached to produce a developer-carrying member 1 (S-1). Formulation and surface hardness/roughness data of the developer-carrying member 1 (S-1) are shown in Table 4.

Developer-Carrying Member

Production Example 2

A zincate surface-treated aluminum sleeve obtained in the same manner as in Developer-Carrying Member Production Example 1 was immersed in a Cr plating bath to form a Cr metallic-coating layer of 5 μm thick. As the Cr plating bath, a commercially available catalyst chromic-anhydride solution was used. The sleeve on which the Cr metallic-coating layer was formed had a hardness Hv of 800 and a surface roughness Ra of 0.67 μm. In the interior of the sleeve thus provided with the metallic-coating layer on its surface, a magnet roller was set built-in and then flanges were attached to produce a developer-carrying member 2 (S-2). Formulation and surface hardness/roughness data of the developer-carrying member 2 (S-2) are shown in Table 4.

Developer-Carrying Member

Production Example 3

A zincate surface-treated aluminum sleeve obtained in the same manner as in Developer-Carrying Member Production Example 1 was immersed in an electroless Ni—B plating bath to form an electroless Ni—B metallic-coating layer of 10 μm thick. The plating was so carried out that the concentration of B in the Ni—B metallic-coating layer came to 6.1% by weight. As the electroless Ni—B plating bath, a weakly acidic solution of nickel sulfate, dimethylaminoborane and sodium malonate was used. The sleeve on which the Ni—B metallic-coating layer was formed had a hardness Hv of 610 and a surface roughness Ra of 0.59 μm. In the interior of the sleeve thus provided with the metallic-coating layer on its surface, a magnet roller was set built-in and then flanges were attached to produce a developer-carrying member 3 (S-3). Formulation and surface hardness/roughness data of the developer-carrying member 3 (S-3) are shown in Table 4.

Developer-Carrying Member

Production Example 4

A zincate surface-treated aluminum sleeve obtained in the same manner as in Developer-Carrying Member Production Example 1 was immersed in an electroless Pd—P plating bath to form an electroless Pd—P metallic-coating layer of 12 μm thick. As the electroless Pd—P plating bath, a weakly acidic solution of palladium chloride, dimethylaminoborane and hydrochloric acid was used. The sleeve on which the Pd—P metallic-coating layer was formed had a hardness Hv of 720 and a surface roughness Ra of 0.57 μm. In the interior of the sleeve thus provided with the metallic-coating layer on its surface, a magnet roller was set built-in and then flanges were attached to produce a developer-carrying member 4 (S-4). Formulation and surface hardness/roughness data of the developer-carrying member 4 (S-4) are shown in Table 4.

Developer-Carrying Member

Production Example 5

A zincate surface-treated aluminum sleeve obtained in the same manner as in Developer-Carrying Member Production Example 1 was immersed in a molybdic acid solution to form a coating layer of 5 μm thick. The sleeve on which the molybdenum coating layer was formed had a hardness Hv of 350 and a surface roughness Ra of 0.64 μm. In the interior of the sleeve thus provided with the metallic-coating layer on its surface, a magnet roller was set built-in and then flanges were attached to produce a developer-carrying member 5 (S-5). Formulation and surface hardness/roughness data of the developer-carrying member 5 (S-5) are shown in Table 4.

Developer-Carrying Member

Production Example 6

A SUS stainless steel sleeve of 20 mm in outer diameter, 0.65 mm in wall thickness, having a Vickers hardness Hv of 180 was used. First, its surface was blast-treated. The blasting was carried out under the same conditions as the case of the aluminum sleeve in Developer-Carrying Member Production Example 1 except that the blast pressure was changed to 4.0 kg/cm$^2$. After the blast treatment, drying and air cooling was carried out, and the surface roughness of the sleeve was measured to find that Ra was 0.75 $\mu$m.

This sleeve was treated in the same manner as in Developer-Carrying Member Production Example 1 to form an Ni—P metallic-coating layer. The sleeve on which the molybdenum coating layer was formed had a hardness Hv of 600 and a surface roughness Ra of 0.75 $\mu$m. In the interior of the sleeve thus provided with the metallic-coating layer on its surface, a magnet roller was set built-in and then flanges were attached to produce a developer-carrying member 6 (S-6). Formulation and surface hardness/roughness data of the developer-carrying member S-6 are shown in Table 4.

Developer-Carrying Member

Production Example 7

A developer-carrying member 7 (S-7) was obtained in the same manner as in Developer-Carrying Member Production Example 1 except that, in Developer-Carrying Member Production Example 1, the conditions at the time of plating were changed. Formulation and surface hardness/roughness data of the developer-carrying member S-7 are shown in Table 4.

Developer-Carrying Member

Production Example 8

A developer-carrying member 8 (S-8) was obtained in the same manner as in Developer-Carrying Member Production Example 2 except that, in Developer-Carrying Member Production Example 2, the conditions at the time of plating were changed. Formulation and surface hardness/roughness data of the developer-carrying member S-8 are shown in Table 4.

Developer-Carrying Member

Production Example 9

A zincate surface-treated aluminum sleeve obtained in the same manner as in Developer-Carrying Member Production Example 1 was immersed in a copper sulfate bath to carry out plating to form a Cu metallic-coating layer of 0.7 $\mu$m thick. The sleeve on which the Cu coating layer was formed had a hardness Hv of 230 and a surface roughness Ra of 0.72 $\mu$m. In the interior of the sleeve thus provided with the metallic-coating layer on its surface, a magnet roller was set built-in and then flanges were attached to produce a developer-carrying member 9 (S-9). Formulation and surface hardness/roughness data of the developer-carrying member 9 (S-9) are shown in Table 4.

Developer-Carrying Member

Production Example 10

The aluminum sleeve crude pipe used in Developer-Carrying Member Production Example 1 was used as it was, without making any blast treatment. In the interior of this sleeve, a magnet roller was set built-in and then flanges were attached to produce a developer-carrying member 10 (S-10). The surface roughness Ra of this sleeve was 0.10 $\mu$m. Formulation and surface hardness/roughness data of the developer-carrying member 10 (S-10) are shown in Table 4.

In Table 4, the numeral shown in "parentheses" in respect of the surface roughness Ra indicates the surface roughness of the original crude pipe because any layer was not formed on its surface. (The same applies also in S-13 given later.)

Developer-Carrying Member

Production Example 11

Plating was carried out on the above developer-carrying member 10 (S-10). A developer-carrying member 11 (S-11) was obtained in the same manner as in Developer-Carrying Member Production Example 1 except that the conditions at the time of plating were changed. Formulation and surface hardness/roughness data of the developer-carrying member S-11 are shown in Table 4.

Developer-Carrying Member

Production Example 12

In Developer-Carrying Member Production Example 1, the aluminum sleeve crude pipe was blast-treated under the same conditions except that spherical glass beads of 150 $\mu$m in particle diameter were used as the blast abrasive grains for blast-treating the surface. Using the blasted sleeve thus obtained, a developer-carrying member was produced in the same manner as in Developer-Carrying Member Production Example 1 except that the conditions at the time of plating were changed, to obtain a developer-carrying member 12 (S-12) having an Ni—P metallic-coating layer as the surface layer. Formulation and surface hardness/roughness data of the developer-carrying member S-12 are shown in Table 4.

Developer-Carrying Member

Production Example 13

The aluminum sleeve (blasted sleeve) before the metallic-coating layer was provided, used in Developer-Carrying Member Production Example 1, was used. In the interior of this sleeve, a magnet roller was set built-in and then flanges were attached to produce a developer-carrying member 13 (S-13). Formulation and surface hardness/roughness data of the developer-carrying member S-13 are shown in Table 4.

TABLE 4

| Developing sleeve | Substrate Material | Substrate Hv | After layer formation: Layer material | After layer formation: Layer thickness ($\mu$m) | After layer formation: Hv | After layer formation: Surface roughness Ra ($\mu$m) | Remarks |
|---|---|---|---|---|---|---|---|
| S-1 | Aluminum | 100 | Ni-P | 7 | 500 | 0.75 | |
| S-2 | Aluminum | 100 | Cr | 5 | 800 | 0.67 | |
| S-3 | Aluminum | 100 | Ni-B | 10 | 610 | 0.59 | |
| S-4 | Aluminum | 100 | Pd-P | 12 | 720 | 0.57 | |
| S-5 | Aluminum | 100 | Mo | 5 | 350 | 0.64 | |
| S-6 | SUS | 180 | Ni-P | 7 | 600 | 0.75 | |
| S-7 | Aluminum | 100 | Ni-P | 0.3 | 170 | 0.74 | |
| S-8 | Aluminum | 100 | Cr | 23 | 1000 | 0.65 | |
| S-9 | Aluminum | 100 | Cu | 0.7 | 230 | 0.72 | |
| S-10 | Aluminum | 100 | — | — | — | (0.10) | Blastless mirror sleeve |
| S-11 | Aluminum | 100 | Ni-P | 0.8 | 420 | 0.25 | |
| S-12 | Aluminum | 100 | Ni-P | 0.6 | 380 | 3.8 | |
| S-13 | Aluminum | 100 | — | — | — | (0.73) | Blasted sleeve |

Example 1

Image evaluation was made using an image-forming apparatus shown diagrammatically in Table 10. This image-forming apparatus is a laser beam printer (recording apparatus) of the cleaning-at-development system (cleanerless system), utilizing a transfer-system electrophotographic process. This is an example of an image-forming apparatus which has a process cartridge from which a cleaning unit having a cleaning member such as a cleaning blade has been removed, makes use of a magnetic one-component developer (i.e., a magnetic toner having magnetic toner particles and an external additive) as the developer, and performs non-contact development where the developer-carrying member and the latent-image-bearing member are so disposed that the developer layer on the former is in non-contact with the latter's surface.

(1) Construction of Image-Forming Apparatus

Reference numeral 1 denotes a rotating-drum type OPC photosensitive member serving as the latent-image-bearing member, and is rotatingly driven in the clockwise direction (in the direction of an arrow) at a peripheral speed (process speed) of 230 mm/sec.

Reference numeral 2 denotes a charging roller serving as the contact charging member. This member comprises as a mandrel a SUS stainless steel roller of 6 mm in diameter, and a medium-resistance foamed urethane layer formulated with urethane resin, carbon black as conductive fine particles, a curing agent and a blowing agent, formed on the mandrel in a roller form, having been further cut and polished to control its shape and surface properties. This is a charging roller having a foamed urethane roller of 16 mm in diameter and with a flexibility. In this charging roller, the resistivity of the foamed urethane roller was $10^5$ Ω·cm and the hardness was 30 degrees as Asker-C hardness.

The charging roller 2 is so provided as to be kept in pressure contact with the photosensitive member 1, resisting an elasticity and at a preset pressing force. Symbol n denotes a charging zone as a contact zone between the photosensitive member 1 and the charging roller. In the present Examples, the charging roller 2 is rotatingly driven in the counter direction (the direction opposite to the movement direction of the photosensitive member 1) at the charging zone n, the part of its contact with the photosensitive member 1, at a peripheral speed of 235 mm/sec. (relative movement speed ratio: 200%). Also, Conductive Fine Particles C-1 are previously applied to the surface of the charging roller 2 in a substantially uniform coating weight in one layer.

To the mandrel 2*a* of the charging roller 2, a DC voltage of −700 V is applied as charging bias from a charging bias application power source S1. In the present Examples, the surface of the photosensitive member 1 is uniformly charged by the direct-injection charging system, to a potential (−680 V) substantially equal to the voltage applied to the charging roller 2. This will be detailed later.

Reference numeral 3 denotes a laser beam scanner (exposure assembly) having a laser diode, a polygon mirror and so forth. This laser beam scanner outputs laser beams (wavelength: 740 nm) intensity-modulated correspondingly to time-sequential electrical digital pixel signals of intended image information, and the laser light effects scanning exposure of the uniformly charged surface of the photosensitive member 1. As a result of this scanning exposure, an electrostatic latent images corresponding to the intended image information is formed.

Reference numeral 4 denotes a developing assembly. The electrostatic latent image on the surface of the photosensitive member 1 is developed as a developer image by this developing assembly. The developing assembly 4 of the present Examples is a non-contact type reverse developing assembly making use of, as the developer 4*d*, a developer D-1 which is a negatively chargeable one-component insulating developer. The developer 4*d* has toner particles t and conductive fine particles m.

Reference numeral 4*a* denotes a developing sleeve provided internally with a magnet roll 4*b*, serving as the developer-carrying member. This developing sleeve 4*a* is provided opposingly to the photosensitive member 1, leaving a gap distance of 300 μm between them, and is rotated at a peripheral speed of 120% (peripheral speed: 282 mm/sec.) of the peripheral speed of the photosensitive member 1, in the same direction as the direction of rotation of the photosensitive member 1 at a developing zone (developing region) a which is the part where it stands opposite to the photosensitive member 1.

On this developing sleeve 4*a*, the developer 4*d* is coated in thin layer by an elastic blade 4*c* made of rubber. The elastic blade 4*c* regulates the layer thickness of the developer 4*d* on the developing sleeve 4*a*, and also imparts electric charges to the developer.

The developer 4*d* applied to the developing sleeve 4*a* is, as the developing sleeve 4*a* is rotated, transported to the developing zone "a", the part where it stands opposite to the photosensitive member 1. Also, to the developing sleeve 4*a*, a development bias voltage is applied from a development bias application power source S2. Here, as the development bias voltage, a voltage formed by superimposing on a DC voltage of −420 V a rectangular-waveform AC voltage with a frequency of 1,600 Hz and a peak-to-peak voltage of 1,500 V (electric-field intensity: $5\times10^6$ V/m) was used, and one-component jumping development (toner projection development) was performed between the developing sleeve 4*a* and the photosensitive member 1.

Reference numeral 5 denotes a medium-resistance transfer roller as the contact transfer member, and is kept in contact with the photosensitive member 1 at a linear pressure of 98 N/m to form a transfer contact zone b. To this transfer contact zone b, a transfer medium P as the recording medium is fed at a stated timing from a paper feed section (not shown), and also a stated transfer bias voltage is applied thereto from a transfer bias application power source S3. Thus, the developer image held on the side of the photosensitive member 1 is successively transferred on to the surface of the transfer medium P fed to the transfer contact zone b.

In the present Examples, a roller with a resistivity of $5\times10^8$ Ω·cm was used as the transfer roller 5 to perform transfer under application of a DC voltage of +3,000 V. More specifically, the transfer medium P guided to the transfer contact zone b is sandwich-transported through this transfer contact zone b, and the developer image formed and held on the surface of the photosensitive member 1 is successively transferred on by the aid of electrostatic force and pressing force.

Reference numeral 6 denotes a fixing assembly of a heat fixing system or the like. The transfer medium P which has been fed to the transfer contact zone b (transfer nip) and to which the developer image on the side of the photosensitive member 1 has been transferred is separated from the surface of the photosensitive member 1 and guided into this fixing assembly 6, where the developer image is fixed thereto, and then delivered out of the apparatus as an image-formed matter (a print or a copy).

From the image-forming apparatus used in the present Examples, any cleaning unit has been removed. The developer left after transfer (the transfer residual toner particles), having remained on the surface of the photosensitive member 1 after the developer image has been transferred to the transfer medium P, is not removed by a cleaning means.

Instead, as the photosensitive member 1 is rotated, it reaches the developing zone "a" through the charging zone n and is removed (collected) by cleaning-at-development in the developing assembly 4.

The image-forming apparatus in the present Example is constructed as a process cartridge 7 detachably mountable on the main body of the image-forming apparatus, having three process machineries, the photosensitive member 1, the charging roller 2 and the developing assembly 4, as one unit. In the present invention, the combination of process machineries to be put into one process cartridge is by no means limited to the above, and any desired combination may be employed. In the drawing, reference numeral 8 denotes a process cartridge detaching/attaching guide and holding member.

(2) Behavior of Conductive Fine Particles

The conductive fine particles m contained in the developer 4*d* of the developing assembly 4 move to the photosensitive member 1 side in an appropriate quantity together with the toner particles t when the electrostatic latent image on the side of the photosensitive member is developed by the developing assembly 4.

The developer image (i.e., toner particles) on the photosensitive member 1 are attracted to the recording medium transfer medium P side at the transfer zone b by influence of the transfer bias to move actively. However, the conductive fine particles m on the photosensitive member 1 do not actively move to the transfer medium P side because they are conductive, and substantially stay attached and held on the photosensitive member 1 to remain there.

In the present Examples, since the image-forming apparatus does not have any independent cleaning means, the transfer residual toner particles and conductive fine particles having remained on the surface of the photosensitive member 1 after transfer are carried to the charging zone n, the contact zone between the photosensitive member 1 and the contact charging member charging roller 2, as the photosensitive member 1 is rotated, and come to adhere to the charging roller 2. Hence, the direct-injection charging of the photosensitive member 1 is performed in the state the conductive fine particles m are present at the contact zone n between the photosensitive member 1 and the charging roller 2.

Because of such presence of the conductive fine particles m, the close contact performance and contact resistance of the charging roller 2 on the photosensitive member 1 can be maintained even where the transfer residual toner particles have adhered to the charging roller 2, and hence the charging roller 2 can be made to perform the direct-injection charging of the photosensitive member 1.

Namely, the charging roller 2 comes into close contact with the photosensitive member 1 via the conductive fine particles m, and the conductive fine particles m rub the photosensitive member 1 surface closely. Thus, the charging of the photosensitive member 1 by the charging roller 2 can predominantly be governed by the stable and safe direct-injection charging, which does not make use of any phenomenon of discharge, and hence a high charging efficiency that has not been achievable by any conventional roller charging and so forth can be achieved. Hence, the potential substantially equal to the voltage applied to the charging roller 2 can be imparted to the photosensitive member 1.

The transfer residual toner particles having adhered to or migrated into the charging roller 2 are gradually sent out from the charging roller 2 onto the photosensitive member 1 to come to reach the developing zone "a" with movement of the photosensitive member 1 surface, and then removed (collected) by cleaning-at-development in the developing assembly 4.

The cleaning-at-development is a system in which the toner particles having remained on the photosensitive member 1 after transfer are collected by fog take-off bias of the developing assembly (i.e., fog take-off potential difference Vback which is the potential difference between the DC voltage applied to the developing assembly and the surface potential of the photosensitive member) at the time of next-time and later development in the image-forming step (i.e., at the time of the development of latent images which is performed after development again through the charging step and exposure step). In the case of the reverse development as in the image-forming apparatus used in the present Examples, this cleaning-at-development is performed by the action of an electric field with which the toner particles are collected by development bias from the part of dark-area potential to the developing sleeve and an electric field with which the toner particles are made to adhere to the part of light-area potential from the developing sleeve (i.e., participate in development).

As the image-forming apparatus is operated, the conductive fine particles m contained in the developer of the developing assembly 4 also move to the photosensitive member 1 surface at the developing zone "a" and are carried to the charging zone n through the transfer zone b with the movement of the photosensitive member 1 surface. Thus, the conductive fine particles m continue being anew fed successively to the charging zone n, and hence any lowering of the charging performance can be prevented from occurring and good charging performance on the photosensitive member 1 can stably be maintained even where the conductive fine particles m have decreased at the charging zone n as a result of coming-off or the like or when the conductive fine particles m at the charging zone n have deteriorated.

Thus, in the image-forming apparatus of the contact charging system, transfer system and toner recycling system, the photosensitive member 1 as the latent-image-bearing member can uniformly be charged at a low applied voltage by the use of the charging roller 2, which is simple as the contact charging member. Moreover, even where the charging roller 2 is contaminated by the transfer residual toner particles, the ozoneless direct-injection charging can stably be maintained over a long period of time. Therefore, a simple-construction and low-cost image-forming apparatus free of any difficulties due to ozone products and any difficulties due to faulty charging can be obtained.

Since in the present Examples the developing assembly is the non-contact type developing assembly, the development bias is by no means injected into the photosensitive member 1, and good images can be obtained. Also, any injection of electric charges into the photosensitive member 1 does not take place at the developing zone "a", and hence a large potential difference can be provided between the developing sleeve 4*a* and the photosensitive member 1 by, e.g., applying AC bias. This makes it ready for the conductive fine particles m to be uniformly developed. Hence, the conductive fine particles m can uniformly be applied to the photosensitive member 1 surface to achieve uniform contact at the charging zone and achieve good charging performance, and good images can be obtained.

The lubricating effect (friction reduction effect) attributable to the conductive fine particles interposed at the contact face between the charging roller 2 and the photosensitive member 1, the difference in speed can readily and effectively be provided between the charging roller 2 and the photosensitive member 1. Because of this lubricating effect, the friction between the charging roller 2 and the photosensitive member 1 can be lessened to lessen the driving torque, and the surface of the charging roller 2 or photosensitive member 1 can be prevented from wearing or being scratched. Also, by providing this difference in speed, the opportunities of contact of the conductive fine particles with the photosensitive member 1 can remarkably be added at the mutual contact zone (charging zone) n between the charging roller 2 and the photosensitive member 1 to achieve a high contact performance. Hence, this makes it possible to perform good direct-injection charging.

In the present Examples, the charging roller 2 is rotatingly driven, and, as its rotational direction, is so constructed as to be rotated in the direction opposite to the movement direction of the photosensitive member 1, to obtain the effect that the transfer residual toner particles on the photosensitive member 1 which are carried to the charging zone n are temporarily collected in the charging roller 2 to level the amount of presence of the transfer residual toner particles interposing at the charging zone n. Hence, any faulty charging due to localization of transfer residual toner particles at the charging zone n can be prevented from occurring, and more stable charging performance can be achieved.

In addition, rotating the charging roller 2 in the opposite direction makes it possible to perform the charging in the state the transfer residual toner particles left on the latent-image-bearing member are first drawn apart by such rotation in the opposite direction, and this makes it possible to perform the direct-injection charging mechanism predominantly. Also, this does not cause any lowering of charging performance which may be caused when the conductive fine particles come off in excess from the charging roller 2.

(3) Evaluation

Figure 10:
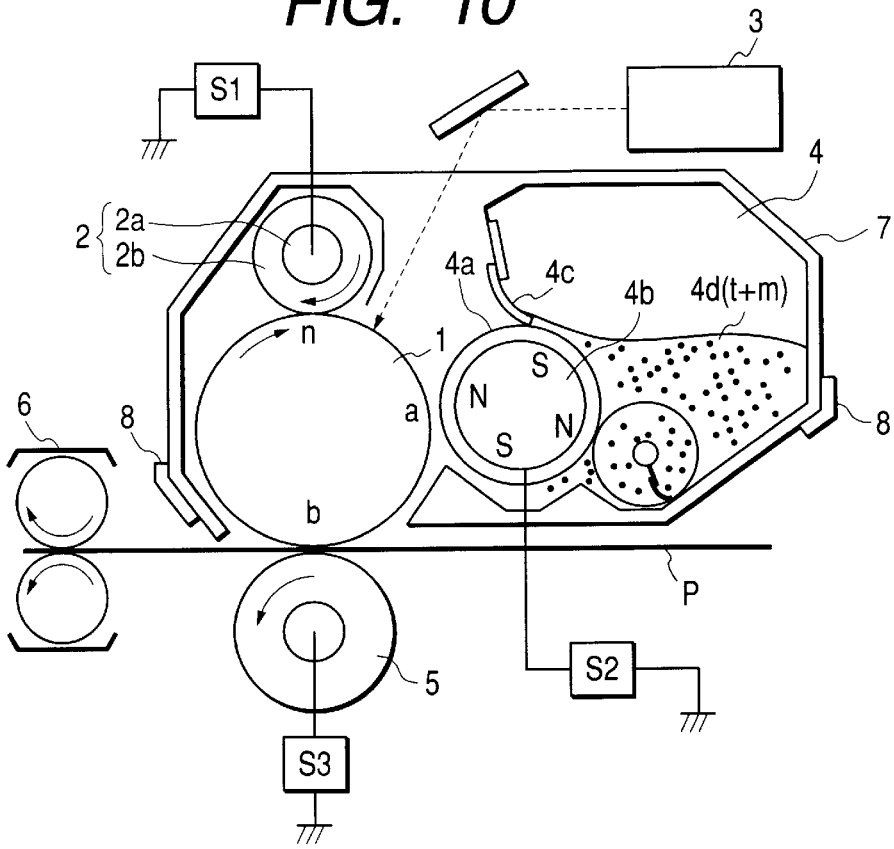
FIG. 10 is a schematic diagrammatic view showing an example of an image-forming apparatus used in the present invention.

The image-forming apparatus shown in FIG. 10 was used to make a print test. Into its developer cartridge, 1,650 g of the developer D-1 was filled, and the print test was conducted by continuous printing of a 5%-coverage image on 30,000 sheets in a normal temperature and normal humidity environment (23° C./50% RH). As the transfer medium, LTR-size plain paper of 90 g/m$^2$ was used. As the result, image density was sufficiently high, fog only a little appeared and also any lowering of developing performance was not seen at the initial stage and even after the continuous printing on 30,000 sheets.

After the continuous printing on 30,000 sheets, the charging roller 2 was also observed on its part corresponding to the contact zone n between it and the photosensitive member 1 to find that, though a very small quantity of transfer residual toner particles were seen, the contact zone was substantially full-covered with the white, conductive fine particles.

Any image defects due to faulty charging also did not occur from the beginning (initial stage) and even after the continuous printing on 30,000 sheets and good direct-injection charging performance was achieved, because the conductive fine particles had stood present at the contact zone n between the photosensitive member 1 and the charging roller 2 and also the conductive fine particles had a sufficiently low resistivity.

Printed images were evaluated in the manner described below.

(I) Image Density

Evaluated by the density of images printed at the initial stage, and on the first sheet after the continuous printing on 30,000 sheets was completed and, after leaving for 2 days. Here, the image density was measured with "Macbeth Reflection Densitometer" (manufactured by Macbeth Co.) as a relative density with respect to an image printed on a white background area with a density of 0.00 of an original. The results of evaluation are shown in Table 5. In Table 5, letter symbols on this item indicate the following evaluation.

A: Very good; image density which is high enough even for graphic images to be presented in a high grade (1.40 or more).

B: Good; image density which is high enough for non-graphic images to have a high-grade image quality (1.35 to less than 1.40).

C: Average; image density which is tolerable as being high enough to recognize characters or letters (1.20 to less than 1.35).

D: Poor; image density with a density too low to be tolerable (less than 1.20).

(II) Fog

Printed images were sampled at the initial stage and after the continuous printing on 30,000 sheets. Fog density (%) was calculated from a difference between the whiteness at white background areas of printed images and the whiteness of a transfer paper. The whiteness was measured with "Reflectometer" (manufactured by Tokyo Denshoku K.K.). The results of evaluation are shown in Table 5. In Table 5, letter symbols on this item indicate the following evaluation.

A: Very good; fog which is commonly not recognizable to the naked eye (less than 1.5%).

B: Good; fog which is not recognizable unless stared carefully (1.5% to less than 2.5%).

C: Average; fog which is recognizable with ease but at a tolerable level (2.5% to less than 4.0%).

D: Poor; fog which is recognized as image stain and is not tolerable (4.0% or more).

(III) Ghost

Figures 11A, 11B, 11C:
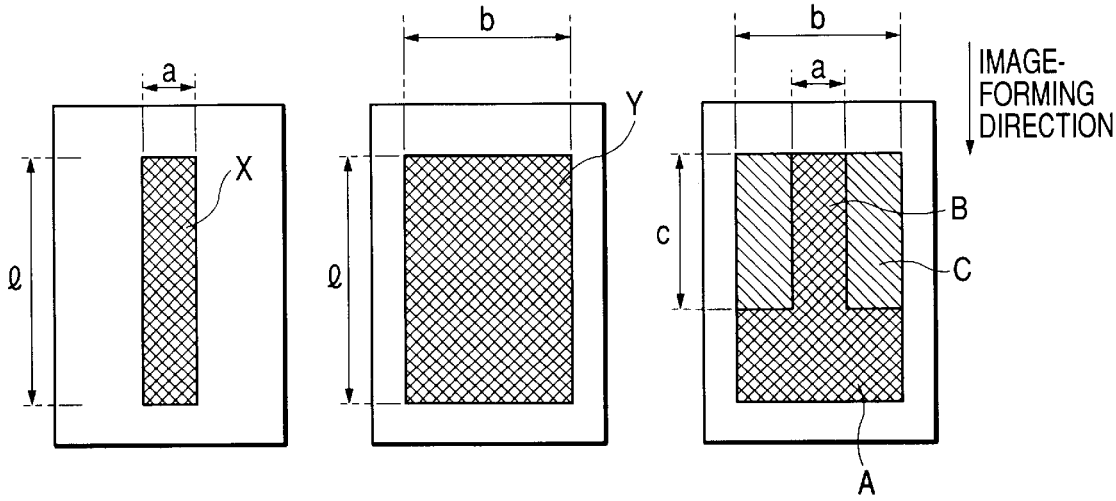
FIGS. 11A, 11B and 11C are diagrammatic views of a printed image for describing a method of evaluating sleeve ghost in Examples of the present invention.

At the initial stage and after the continuous printing on 30,000 sheets, a solid-black beltlike image X with width a and length l as shown in FIG. 11A was printed, and thereafter a halftone image Y with width b (>a) and length l as shown in FIG. 11B was printed, where any difference in light and shade (areas A, B and C in FIG. 11C) appearing on the halftone image was evaluated.

A: Any light-and-shade difference is not seen at all (the light-and-shade difference is less than 0.02).

B: Slight light-and-shade difference is seen in the areas B and C (the light-and-shade difference is from 0.02 to less than 0.04).

C: Light-and-shade difference is a little seen in all the areas A, B and C (the light-and-shade difference is from 0.04 to less than 0.07).

D: Light-and-shade difference is conspicuously seen (the light-and-shade difference is 0.07 or more).

(IV) Fading

Figure 1:
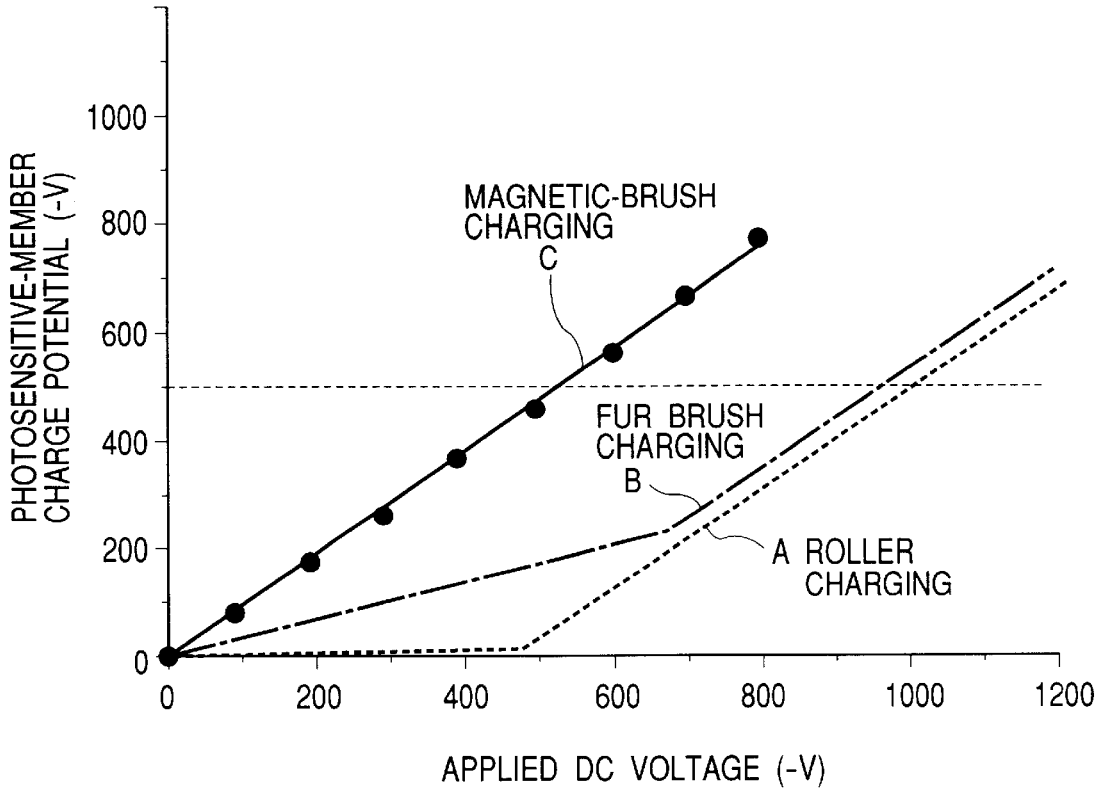
FIG. 1 is a graph showing charge characteristics of charging members.
Figure 2:
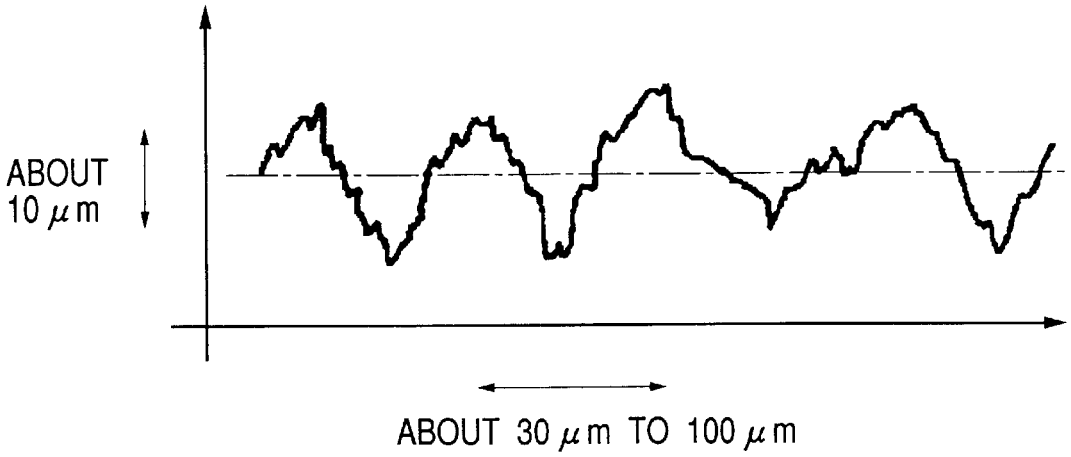
FIG. 2 is a diagrammatic view of a roughness profile curve of a SUS stainless steel developing sleeve surface having been subjected to alundum blast treatment.
Figure 3:
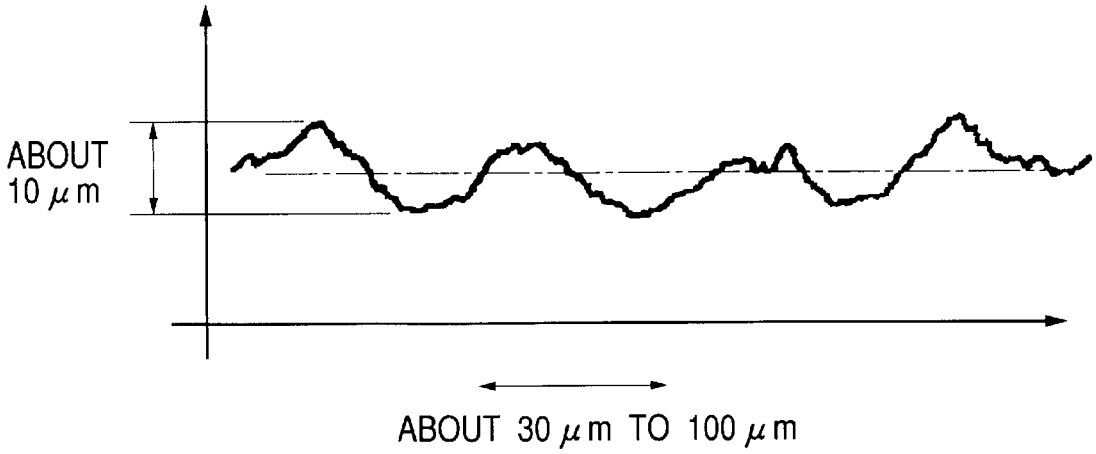
FIG. 3 is a diagrammatic view of a roughness profile curve of a SUS stainless steel sleeve surface having been subjected to glass-beads blast treatment.
Figure 4:
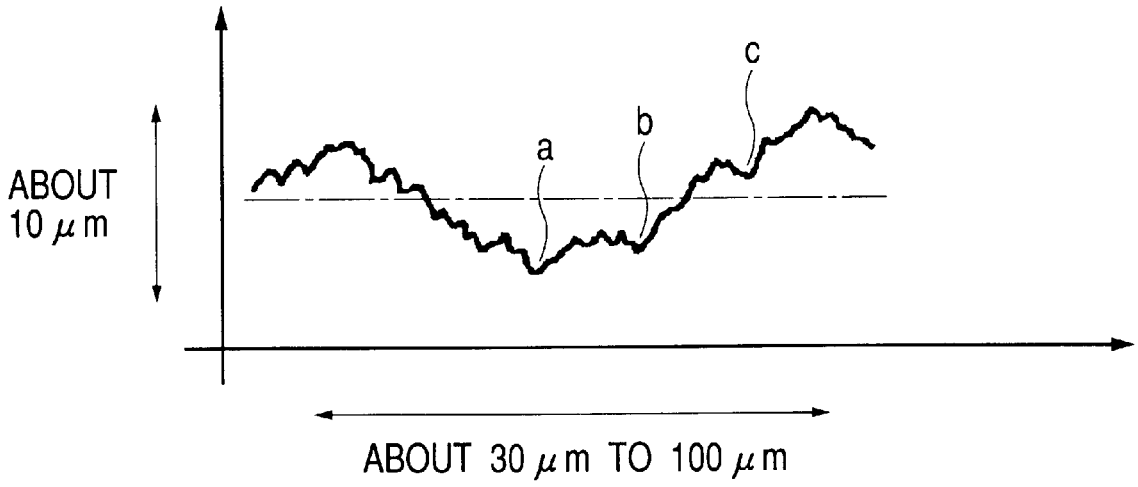
FIG. 4 is an enlarged view of the roughness profile curve shown in FIG. 3.
Figure 5:
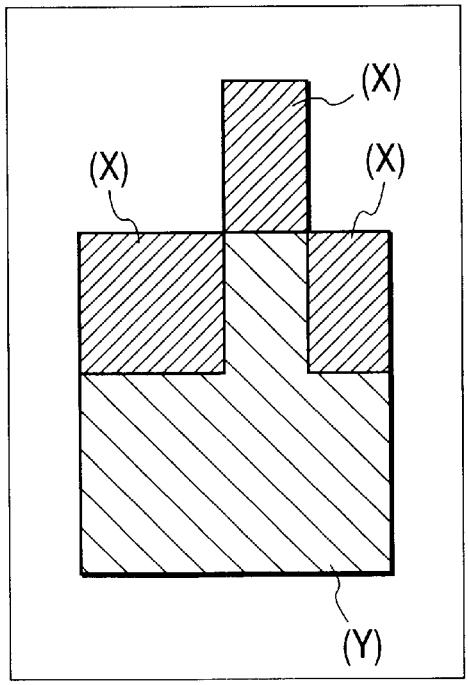
FIG. 5 is a diagrammatic view of a printed image used to explain sleeve ghost.
Figure 6:
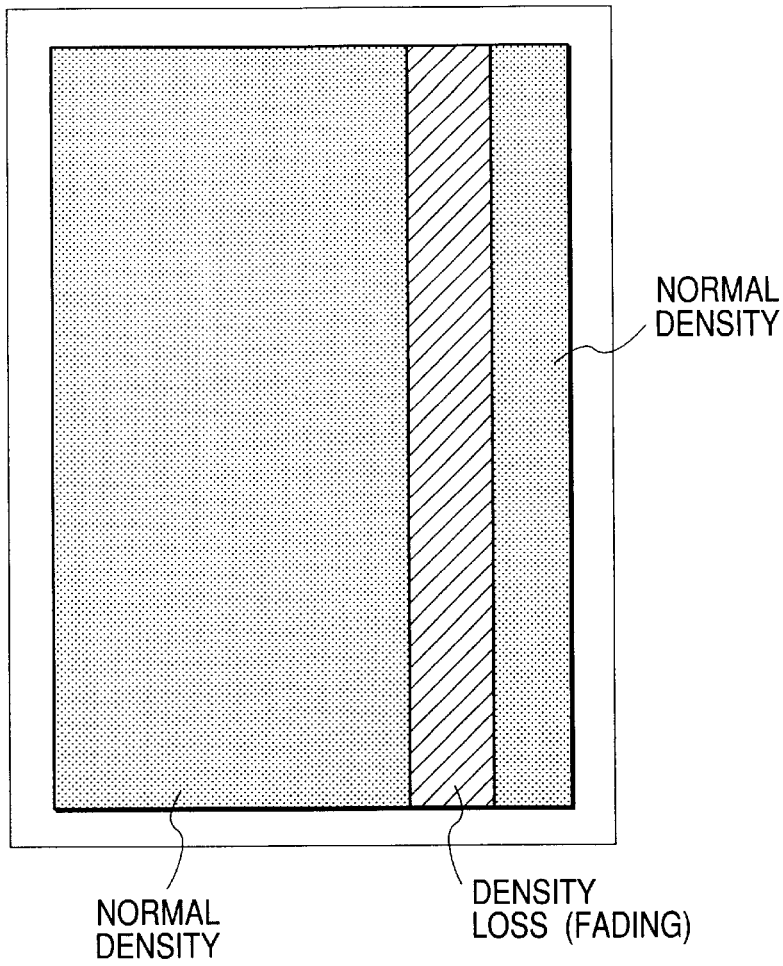
FIG. 6 is a diagrammatic view of a printed image used to explain fading.

At the initial stage and after the continuous printing on 30,000 sheets, a solid-black image was printed to make evaluation by any difference in density on an image as shown in FIG. 6, between the density in an area of density loss appeared in a belt form and the density in a normal image area.

A: Any area of density loss is not seen at all (the density difference is less than 0.02).

B: An area of slight density loss is seen (the density difference is 0.02 to less than 0.08).

C: An area of density loss is seen, but at a level of no problem in practical images (the density difference is 0.08 to less than 0.20).

D: An area of remarkable density loss is seen, and at a level problematic also in practical images (the density difference is 0.20 or more).

(V) Change in Surface Roughness Ra of Developer-Carrying Member

Any difference (ΔRa) in surface roughness Ra of the developer-carrying member before evaluation and after the continuous printing on 30,000 sheets was examined to make judgment of wear resistance of the developer-carrying member surface. With regard to the measurement of Ra, it was measured with a surface roughness meter SE-3300H, manufactured by Kosaka Laboratory Ltd., under conditions of a cut-off of 0.8 mm, a specified distance of 8.0 mm and a feed rate of 0.5 mm/s, and measurements at 12 spots were averaged. However, as to Examples and Comparative Examples in which the developer-carrying member S-10, having an Ra value of 0.1 or less originally at the initial stage, this item was excluded from the evaluation.

A: Wear resistance is very good (the ΔRa is less than 0.10 μm).

B: Wear resistance is relatively good (the ΔRa is 0.10 μm to less than 0.15 μm).

C: Wear resistance is a little low, but of no problem in practical use (the ΔRa is 0.15 μm to less than 0.20 μm).

D: Wear resistance is so weak as to be problematic also in practical use (the ΔRa is 0.20 μm or more).

(VI) Transfer Efficiency

Transfer performance was evaluated at the initial stage and after the continuous printing on 30,000 sheets. To evaluate the transfer performance, transfer residual toner particles left on the photosensitive member when a solid black image was formed were taken off with Mylar tape by taping. The Mylar tape with the toner particles thus taken off was stuck on white paper. From the Macbeth density measured thereon, the Macbeth density measured on Mylar tape alone (without toner) stuck on white paper was subtracted to obtain numerical values by which the evaluation was made. The results of evaluation are shown in Table 5.

A: Very good (less than 0.04).

B: Good (0.04 to less than 0.08).

C: Average (0.08 to less than 0.20).

D: Poor (0.20 or more).

(VII) Charging Performance on Photosensitive Member

The surface potential of a photosensitive member charged uniformly at the initial state (after the printing on about 40 to 50 sheets) was measured, and, after the continuous printing on 30,000 sheets, the surface potential of the photosensitive member charged uniformly was likewise measured disposing a sensor at the position of the developing assembly. The charging performance on the photosensitive member was evaluated by the difference in potential between the both occasions. The results of evaluation are shown in Table 5. It indicates that, the larger the difference comes toward minus, the more greatly the charging performance on the photosensitive member lowers.

(VIII) Faulty Pattern Recovery (Pattern Ghost)

A vertical-line identical pattern (repeated vertical lines of 2 dots and 98 spaces) was continuously printed, and thereafter a halftone image (repeated horizontal lines of 2 dots and 3 spaces) print test was made to visually evaluate whether or not any light and shade (ghost) corresponding to the pattern of vertical lines appeared. The results of evaluation are shown in Table 5.

A: Very good (any light and shade do not appear).

B: Good (light and shade is seen to have slightly appeared, but does not affect images).

C: Average (light and shade slightly appear, but within the range of a level tolerable in practical use).

D: Poor (light and shade appear conspicuously and is not tolerable).

Examples 2 to 90 & Comparative Examples 1 to 4

Image evaluation was made in the same manner as in Example 1. Results obtained are shown in Tables 5 to 8. Here, with regard to Examples 24, 31, 38, 45, 59 and 66, the developing assembly was changed for the developing assembly for performing development with a non-magnetic one-component developer to make image evaluation. Also, with regard to Example 89, the elastic blade, the developer layer thickness regulation member, was changed for a magnetic blade to make evaluation. Still also, in Example 90, evaluation was made using a system in which the transfer residual toner particles having remained on the latent-image-bearing member photosensitive drum after transfer are collected by a cleaner, and the step of again returning them to the developing system was not carried out.

TABLE 5

| | Developer-carrying member | Developer | Image density | | Fog | | Ghost | | Fading | | Change in developer-carrying member surface roughness Ra | Transfer efficiency | | Charging performance ΔV | Faulty pattern recovery |
|---|---|---|---|---|---|---|---|---|---|---|---|---|---|---|---|
| | | | Initial stage | After 30,000 sheets | Initial stage | After 30,000 sheets | Initial stage | After 30,000 sheets | Initial stage | After 30,000 sheets | | Initial stage | After 30,000 sheets | After 30,000 sheets | After 30,000 sheets |
| Ex.1 | S-1 | D-1 | A | A | A | A | A | A | A | A | A | A | B | −30 | A |
| Ex.2 | S-2 | D-1 | A | A | A | A | A | A | A | A | A | A | B | −30 | B |
| Ex.3 | S-3 | D-1 | A | A | A | A | A | B | A | B | A | B | B | −35 | B |
| Ex.4 | S-4 | D-1 | A | B | B | A | A | B | A | B | A | B | B | −40 | B |
| Ex.5 | S-5 | D-1 | A | B | B | B | A | A | B | B | C | B | C | −50 | C |
| Ex.6 | S-6 | D-1 | A | A | A | A | A | B | A | A | A | A | B | −30 | B |
| Ex.7 | S-7 | D-1 | A | C | B | B | B | C | C | B | C | B | C | −60 | C |
| Ex.8 | S-8 | D-1 | B | C | B | C | C | C | C | C | A | B | C | −60 | C |
| Ex.9 | S-9 | D-1 | A | B | B | C | B | B | B | B | C | B | B | −45 | B |
| Comp. Ex.1 | S-10 | D-1 | C | D | C | C | C | D | C | C | — | B | D | −100 | D |
| Ex.10 | S-11 | D-1 | A | C | A | B | A | C | A | C | A | B | C | −50 | C |
| Ex.11 | S-12 | D-1 | B | B | C | B | C | C | C | C | A | B | C | −55 | C |
| Comp. | S-13 | D-1 | C | D | D | D | C | D | D | D | D | C | D | −90 | D |

TABLE 5-continued

| | Devel-oper-carrying member | Devel-oper | Image density | | Fog | | Ghost | | Fading | | Change in devel-oper-carrying member surface roughness Ra | Transfer efficiency | | Charging perfor-mance ΔV | Faulty pattern recovery |
|---|---|---|---|---|---|---|---|---|---|---|---|---|---|---|---|
| | | | Initial stage | After 30,000 sheets | Initial stage | After 30,000 sheets | Initial stage | After 30,000 sheets | Initial stage | After 30,000 sheets | | Initial stage | After 30,000 sheets | After 30,000 sheets | After 30,000 sheets |
| Ex.2 | | | | | | | | | | | | | | | |
| Ex.12 | S-1 | D-2 | A | A | A | A | A | A | A | A | A | A | B | −30 | B |
| Ex.13 | S-1 | D-3 | A | A | A | A | A | A | A | A | A | B | B | −35 | B |
| Ex.14 | S-1 | D-4 | B | C | C | B | B | C | B | C | A | B | C | −55 | C |
| Ex.15 | S-1 | D-5 | B | B | C | C | B | C | C | C | A | C | C | −60 | C |
| Ex.16 | S-1 | D-6 | A | A | A | A | A | A | A | A | A | A | A | −25 | A |
| Ex.17 | S-1 | D-7 | A | A | A | A | A | A | A | A | A | A | A | −30 | A |
| Ex.18 | S-1 | D-8 | A | C | B | C | B | C | B | C | A | B | C | −60 | C |
| Ex.19 | S-1 | D-9 | A | A | A | B | A | A | A | A | A | A | B | −35 | B |
| Ex.20 | S-1 | D-10 | B | C | C | B | B | B | B | C | A | C | C | −90 | C |
| Ex.21 | S-1 | D-11 | A | B | B | B | A | B | A | B | A | B | B | −40 | C |

TABLE 6

| | Devel-oper-carrying member | Devel-oper | Image density | | Fog | | Ghost | | Fading | | Change in devel-oper-carrying member surface roughness Ra | Transfer efficiency | | Charging perfor-mance ΔV | Faulty pattern recovery |
|---|---|---|---|---|---|---|---|---|---|---|---|---|---|---|---|
| | | | Initial stage | After 30,000 sheets | Initial stage | After 30,000 sheets | Initial stage | After 30,000 sheets | Initial stage | After 30,000 sheets | | Initial stage | After 30,000 sheets | After 30,000 sheets | After 30,000 sheets |
| Ex.22 | S-1 | D-12 | A | B | A | B | A | B | A | B | A | B | B | −35 | B |
| Ex.23 | S-1 | D-13 | A | A | A | A | A | A | A | A | A | A | B | −30 | B |
| Ex.24 | S-1 | D-14 | A | B | A | A | A | A | A | A | A | A | B | −35 | A |
| Ex.25 | S-1 | D-15 | C | B | B | B | A | A | A | A | A | B | B | −40 | B |
| Ex.26 | S-1 | D-16 | B | B | C | C | B | C | C | C | A | C | C | −55 | C |
| Comp. Ex.3 | S-1 | D-17 | B | D | A | D | B | C | B | C | A | A | D | −140 | D |
| Ex.27 | S-2 | D-2 | A | A | A | A | A | A | A | A | A | A | B | −25 | B |
| Ex.28 | S-2 | D-3 | A | A | A | A | A | A | A | A | A | B | B | −40 | B |
| Ex.29 | S-2 | D-8 | A | B | B | B | B | B | B | B | A | B | C | −55 | C |
| Ex.30 | S-2 | D-12 | A | B | A | B | A | B | A | B | A | B | B | −30 | B |
| Ex.31 | S-2 | D-14 | A | B | A | A | A | A | A | A | A | A | B | −40 | B |
| Ex.32 | S-2 | D-15 | C | B | B | B | A | B | A | A | A | B | B | −45 | B |
| Ex.33 | S-2 | D-16 | B | B | C | C | B | C | C | C | A | C | C | −50 | C |
| Ex.34 | S-3 | D-3 | A | B | A | A | A | B | A | B | A | B | B | −40 | B |
| Ex.35 | S-3 | D-7 | A | A | A | A | A | A | A | A | A | A | B | −35 | B |
| Ex.36 | S-3 | D-9 | A | B | A | B | A | B | A | B | A | A | B | −40 | B |
| Ex.37 | S-3 | D-12 | A | B | A | B | B | B | B | B | A | B | B | −40 | B |
| Ex.38 | S-3 | D-14 | A | B | A | A | A | B | A | B | A | A | B | −40 | A |
| Ex.39 | S-3 | D-15 | C | B | B | B | A | B | A | B | A | B | B | −45 | B |
| Ex.40 | S-3 | D-16 | C | B | C | C | B | C | C | C | A | C | C | −60 | C |
| Ex.41 | S-4 | D-4 | B | C | C | B | B | C | B | C | A | B | C | −55 | C |
| Ex.42 | S-4 | D-8 | B | B | B | B | B | B | B | B | A | B | C | −50 | C |
| Ex.43 | S-4 | D-11 | B | C | B | B | B | C | B | C | A | B | C | −50 | C |
| Ex.44 | S-4 | D-13 | A | B | A | B | A | B | A | B | A | A | B | −35 | B |

TABLE 7

| | Devel-oper-carrying member | Devel-oper | Image density | | Fog | | Ghost | | Fading | | Change in devel-oper-carrying member surface roughness Ra | Transfer efficiency | | Charging perfor-mance ΔV | Faulty pattern recovery |
|---|---|---|---|---|---|---|---|---|---|---|---|---|---|---|---|
| | | | Initial stage | After 30,000 sheets | Initial stage | After 30,000 sheets | Initial stage | After 30,000 sheets | Initial stage | After 30,000 sheets | | Initial stage | After 30,000 sheets | After 30,000 sheets | After 30,000 sheets |
| Ex.45 | S-4 | D-14 | A | B | A | B | A | B | A | B | A | A | B | −35 | B |
| Ex.46 | S-4 | D-15 | C | B | B | B | A | B | A | B | A | B | B | −40 | B |

TABLE 7-continued

| | Devel-oper-carrying member | Devel-oper | Image density | | Fog | | Ghost | | Fading | | Change in devel-oper-carrying member surface roughness Ra | Transfer efficiency | | Charging perfor-mance ΔV | Faulty pattern recovery |
|---|---|---|---|---|---|---|---|---|---|---|---|---|---|---|---|
| | | | Initial stage | After 30,000 sheets | Initial stage | After 30,000 sheets | Initial stage | After 30,000 sheets | Initial stage | After 30,000 sheets | | Initial stage | After 30,000 sheets | After 30,000 sheets | After 30,000 sheets |
| Ex.47 | S-5 | D-2 | A | B | B | B | A | B | B | B | C | B | C | −50 | C |
| Ex.48 | S-5 | D-3 | A | B | B | B | A | B | A | B | C | B | B | −40 | B |
| Ex.49 | S-5 | D-4 | C | C | C | B | B | B | C | C | C | B | C | −60 | C |
| Ex.50 | S-5 | D-5 | B | C | C | C | A | B | C | C | C | C | C | −60 | C |
| Ex.51 | S-5 | D-6 | A | C | A | B | A | A | B | B | C | B | B | −40 | B |
| Ex.52 | S-5 | D-7 | A | C | A | B | A | A | A | B | C | B | B | −35 | B |
| Ex.53 | S-5 | D-8 | B | C | B | C | B | B | B | C | C | B | C | −60 | C |
| Ex.54 | S-5 | D-9 | A | C | A | B | A | A | B | B | C | B | B | −35 | B |
| Ex.55 | S-5 | D-10 | B | C | C | B | A | B | B | C | C | C | C | −75 | C |
| Ex.56 | S-5 | D-11 | A | C | B | B | A | A | A | B | C | B | C | −45 | B |
| Ex.57 | S-5 | D-12 | A | C | A | B | A | A | B | B | C | B | C | −35 | B |
| Ex.58 | S-5 | D-13 | A | B | A | B | A | A | A | B | C | A | B | −35 | B |
| Ex.59 | S-5 | D-14 | A | C | A | A | A | A | A | A | C | A | B | −40 | C |
| Ex.60 | S-5 | D-15 | C | C | B | B | A | A | A | B | C | B | B | −40 | C |
| Ex.61 | S-5 | D-16 | B | C | B | C | B | B | B | C | C | C | C | −55 | C |
| Comp. Ex.4 | S-5 | D-17 | B | D | A | D | A | C | B | C | C | B | D | −110 | D |
| Ex.62 | S-6 | D-5 | B | B | B | C | B | C | B | C | A | C | C | −55 | C |
| Ex.63 | S-6 | D-8 | A | A | B | B | A | B | A | B | A | A | B | −35 | B |
| Ex.64 | S-6 | D-8 | A | C | B | C | B | C | B | C | A | B | C | −60 | B |
| Ex.65 | S-6 | D-12 | A | A | B | B | B | C | A | B | A | B | B | −40 | B |
| Ex.66 | S-6 | D-14 | A | A | B | B | A | B | A | B | A | A | B | −35 | B |
| Ex.67 | S-6 | D-15 | C | B | C | B | A | B | A | B | A | B | B | −40 | B |

TABLE 8

| | Devel-oper-carrying member | Devel-oper | Image density | | Fog | | Ghost | | Fading | | Change in devel-oper-carrying member surface roughness Ra | Transfer efficiency | | Charging perfor-mance ΔV | Faulty pattern recovery |
|---|---|---|---|---|---|---|---|---|---|---|---|---|---|---|---|
| | | | Initial stage | After 30,000 sheets | Initial stage | After 30,000 sheets | Initial stage | After 30,000 sheets | Initial stage | After 30,000 sheets | | Initial stage | After 30,000 sheets | After 30,000 sheets | After 30,000 sheets |
| Ex.68 | S-6 | D-16 | B | B | C | C | A | C | B | C | A | C | C | −50 | C |
| Ex.69 | S-7 | D-4 | B | C | C | B | B | C | B | C | C | B | C | −55 | C |
| Ex.70 | S-7 | D-5 | B | C | B | C | C | C | C | C | C | C | C | −60 | C |
| Ex.71 | S-7 | D-15 | B | C | C | B | B | C | B | C | C | C | C | −50 | C |
| Ex.72 | S-7 | D-16 | B | C | B | C | C | C | C | C | C | C | C | −70 | C |
| Ex.73 | S-8 | D-4 | C | B | C | C | B | C | C | C | A | C | C | −60 | C |
| Ex.74 | S-8 | D-5 | B | B | C | C | B | C | C | C | A | C | C | −60 | C |
| Ex.75 | S-8 | D-15 | C | B | C | C | B | C | C | C | A | C | C | −55 | C |
| Ex.76 | S-8 | D-16 | B | B | C | C | C | C | C | C | A | C | C | −70 | C |
| Ex.77 | S-9 | D-4 | A | B | B | C | C | C | C | B | C | B | C | −45 | B |
| Ex.78 | S-9 | D-5 | A | C | C | C | C | C | C | C | C | B | C | −50 | C |
| Ex.79 | S-9 | D-15 | B | B | C | C | C | C | C | B | C | B | B | −50 | C |
| Ex.80 | S-9 | D-16 | B | C | C | C | C | C | C | C | C | C | C | −65 | C |
| Ex.81 | S-11 | D-4 | B | C | A | B | A | C | A | C | A | A | C | −50 | B |
| Ex.82 | S-11 | D-5 | B | C | A | B | C | C | C | C | A | B | C | −60 | C |
| Ex.83 | S-11 | D-15 | B | C | A | B | B | C | B | C | A | C | C | −55 | C |
| Ex.84 | S-11 | D-16 | B | C | B | C | C | C | C | C | A | C | C | −65 | C |
| Ex.85 | S-12 | D-4 | B | B | C | B | C | C | C | C | A | B | C | −55 | C |
| Ex.86 | S-12 | D-5 | B | C | C | C | C | C | C | C | A | C | C | −60 | C |
| Ex.87 | S-12 | D-15 | C | B | C | B | C | C | C | C | A | C | C | −55 | C |
| Ex.88 | S-12 | D-16 | B | B | C | C | C | C | C | C | A | B | B | −35 | B |
| Ex.89 | S-1 | D-1 | C | A | B | A | B | B | B | B | A | B | B | −35 | B |
| Ex.90 | S-1 | D-1 | A | A | A | A | A | A | A | A | A | A | A | −10 | A |

What is claimed is:

1. A developing assembly comprising:

a developing container holding a developer therein;

a developer-carrying member for holding thereon said developer held in said developing container and transporting said developer to a developing zone; and a developer layer thickness regulation member for regulating a layer thickness of said developer to be held on said developer-carrying member, said developer including toner particles containing at least a binder resin and a colorant, and conductive fine particles; and said developer-carrying member including a substrate and a surface layer formed on said substrate, said surface layer being formed of a material selected from a group consisting of electroless Ni—P plating, electroless Ni—B plating, electroless Pd plating, electroless Pd—P plating, and electroless Cr plating, wherein said surface layer has a thickness in a range of 3 μm to 15 μm, wherein said developer has a weight-average particle diameter in a range of 4 μm to 10 μm, and contains from 10% by number to 50% by number of particles having a particle diameter in a range of 1.00 μm to less than 2.00 μm, and from 20% by number to 65% by number of particles having a particle diameter in a range of 3.00 μm to less than 8.96 μm, in a number-based particle size distribution concerning particles having a particle diameter in a range from 0.60 μm to less than 159.21 μm, wherein said conductive fine particles have a volume-average particle diameter in a range of 0.5 μm to 2.1 μm, a volume resistivity ranging in a range of $10^1$ Ω·cm to $10^6$ Ω·cm, and are contained in said developer in an amount in a range of 0.5% by weight to 10% by weight, and;

wherein said developer layer thickness regulation member includes an elastic blade.

2. The developing assembly according to claim 1, wherein said surface layer is formed by a material selected from a group consisting of electroless Ni—P plating, electroless Ni—B plating, electroless Pd plating, electroless Pd—P plating, electroless Cr plating, electrolytic Mo plating, and electroless Mo plating or the like.

3. The developing assembly according to claim 1, wherein said developer-carrying member is a member obtained by subjecting a substrate surface to surface-roughing treatment with spherical particles to form an uneven surface and thereafter forming thereon said surface layer.

4. The developing assembly according to claim 1, wherein said substrate is formed of a metallic material having Vickers hardness Hv in a range of 50 to 200.

5. The developing assembly according to claim 1, wherein said developer-carrying member has a surface roughness in a range of 0.1 μm to 3.5 μm as an arithmetic mean roughness Ra value of the unevenness of a surface of said surface layer after said surface layer has been formed on said substrate.

6. The developing assembly according to claim 1, wherein said developer-carrying member has a Vickers hardness Hv in a range of 200 to 1,000 after said surface layer has been formed.

7. The developing assembly according to claim 1, wherein said developer is a magnetic developer including magnetic toner particles as the toner particles.

8. The developing assembly according to claim 1, wherein said conductive fine particles are non-magnetic conductive fine particles.

9. The developing assembly according to claim 1, wherein said conductive fine particles contain at least fine particles of an oxide selected from a group consisting of zinc oxide, tin oxide, and titanium oxide.

10. A process cartridge comprising:

a latent-image-bearing member on which an electrostatic latent image is formed;

a charging means for charging said latent-image-bearing member; and a developing assembly for developing the electrostatic latent image with a developer to form a developer image, said developing assembly and said latent-image-bearing member being integrally set as one unit detachably mountable on a main body of an image-forming apparatus, said developer including toner particles containing at least a binder resin and a colorant, and conductive fine particles, said developing assembly including a developing container for holding a developer therein, a developer-carrying member for holding thereon said developer and transporting said developer to a developing zone, and a developer layer thickness regulation member for regulating a layer thickness of the developer held on said developer-carrying member;

said developer-carrying member including a substrate and a surface layer formed on said substrate, said surface layer being formed of a material selected from a group consisting of electroless Ni—P plating, electroless Ni—B plating, electroless Pd plating, electroless Pd—P plating, and electroless Cr plating, wherein said surface layer has a thickness in a range of 3 μm to 15 μm;

wherein said developer has a weight-average particle diameter in a range of 4 μm to 10 μm, contains from 20% by number to 50% by number of particles ranging in particle diameter from 1.00 μm to less than 2.00 μm and from 20% by number to 65% by number of particles having a particle diameter in a range of 3.00 μm to less than 8.96 μm, in its number-based particle size distribution concerning particles having a particle diameter in a range of 0.60 μm to less than 159.21 μm;

wherein said conductive fine particles have a volume-average particle diameter in a range of 0.5 μm to 2.1 μm, have a volume resistivity in a range of $10^1$ Ω·cm to $10^6$ Ω·cm, and said conductive fine particles are contained in the developer in an amount in a range of 0.5% by weight to 10% by weight, wherein said developer layer thickness regulation member includes an elastic blade.

11. The process cartridge according to claim 10, wherein said charging means comprises a charging means maintained in contact with said latent-image-bearing member, and charges said latent-image-bearing member by applying a voltage to a contact zone between said charging means and said latent-image-bearing member.

12. The process cartridge according to claim 11, wherein said latent-image-bearing member is charged by applying a voltage in a state that said conductive fine particles stand interposed at least at the contact zone between said charging means and said latent-image-bearing member.

13. A process cartridge comprising:

a latent-image-bearing member on which an electrostatic latent image is formed;

a charging means for charging said latent-image-bearing member; and a developing assembly for developing the electrostatic latent image with a developer to form a developer image, said developing assembly and said latent-image-bearing member being integrally set as one unit detachably mountable on a main body of an image-forming apparatus;

said developing assembly including a developing container for holding said developer therein, a developer-carrying member for holding thereon said developer and transporting said developer to a developing zone, and a developer layer thickness regulation member for regulating a layer thickness of said developer held on said developer-carrying member;

said developer-carrying member including a substrate and a surface layer formed on said substrate, said surface layer being formed of a material selected from a group consisting of electroless Ni—P plating, electroless Ni—B plating, electroless Pd plating, electroless Pd—P plating, and electroless Cr plating, wherein said surface layer has a thickness in a range of 3 μm to 15 μm, said developer layer thickness regulation member including an elastic blade, and said developer including toner particles containing at least a binder resin and a colorant, and conductive fine particles, wherein said developer has a weight-average particle diameter in a range of 4 μm to 10 μm, and contains from 20% by number to 50% by number of particles ranging in particle diameter from 1.00 μm to less than 2.00 μm, and from 20% by number to 65% by number of particles having a particle diameter in a range of 3.00 μm to less than 8.96 μm, in a number-based particle size distribution concerning particles having a particle diameter in a range of 0.60 μm to less than 159.21 μm, wherein said conductive fine particles have a volume-average particle diameter in a range of 0.5 μm to 2.1 μm, a volume resistivity in a range of $10^1$ Ω·cm to $10^6$ Ω·cm, and are contained in said developer in an amount in a range of 0.5% by weight to 10% by weight, and wherein said developing assembly is said developing assembly according to any one of claims 2 to 9.

14. An image-forming method comprising:

a charging step of charging a latent-image-bearing member;

a latent-image-forming step of forming an electrostatic latent image on a charged surface of the latent-image-bearing member having been charged in said charging step;

a developing step of developing the electrostatic latent image to render it visible as a developer image by means of a developing assembly having a developer-carrying member which holds and transports a developer to a developing zone facing the latent-image-bearing member;

a transfer step of transferring the developer image to a transfer medium; and a fixing step of fixing the developer image transferred to the transfer medium by the use of a fixing means;

said steps being sequentially repeated to form images;

the developer comprising toner particles containing at least a binder resin and a colorant, and conductive fine particles, the developer-carrying member including a substrate and a surface layer formed on the substrate, the surface layer being formed of a material selected from a group consisting of electroless Ni—P plating, electroless Ni—B plating, electroless Pd plating, electroless Pd—P plating, and electroless Cr plating, wherein the surface layer has a thickness in a range of 3 μm to 15 μm, wherein the developer has a weight-average particle diameter in a range of 4 μm to 10 μm, and contains from 20% by number to 50% by number of particles having a particle diameter in a range of 1.00 μm to less than 2.00 μm, and from 20% by number to 65% by number of particles having a particle diameter in a range of 3.00 μm to less than 8.96 μm, in a number-based particle size distribution concerning particles having a particle diameter in a range of 0.60 μm to less than 159.21 μm, wherein the conductive fine particles have a volume-average particle diameter in a range of 0.5 μm to 2.1 μm, a volume resistivity in a range of $10^1$ Ω·cm to $10^6$ Ω·cm, and are contained in the developer in an amount in a range of 0.5% by weight to 10% by weight, and wherein the developer layer thickness regulation member includes an elastic blade.

15. The image-forming method according to claim 14, wherein said developing step is a step of rendering the electrostatic latent image visible and at the same time collecting the developer remaining on the latent-image-bearing member after the developer image has been transferred to the transfer medium.

16. The image-forming method according to claim 14, wherein, in said charging step, a charging means is maintained in contact with the latent-image-bearing member, and the latent-image-bearing member is charged by applying a voltage to a contact zone between the charging means and the latent-image-bearing member.

17. The image-forming method according to claim 16, wherein said charging step is a step of charging the latent-image-bearing member by applying a voltage in a state that the conductive fine particles stand interposed at least at the contact zone between the charging means and the latent-image-bearing member.

18. The image-forming method according to claim 14, wherein the electrostatic latent image is developed by means of the developing assembly according to any one of claims 2 to 9.

* * * * *

UNITED STATES PATENT AND TRADEMARK OFFICE

CERTIFICATE OF CORRECTION

PATENT NO. : 6,873,816 B2 
DATED : March 29, 2005
INVENTOR(S) : Yasutaka Akashi et al.

It is certified that error appears in the above-identified patent and that said Letters Patent is hereby corrected as shown below:

Title page,
Item [56], References Cited, FOREIGN PATENT DOCUMENTS,

| | | | | | |
|---|---|---|---|---|---|
| "JP | 36-10231 | 7/1936 | -- JP | 36-10231 | 7/1961 |
| JP | 42-23910 | 11/1942 should read | JP | 42-23910 | 11/1967 |
| JP | 43-24748 | 10/1943" | JP | 43-24748 | 10/1968 --. |

Column 7,
Line 10, "an" should read -- a --; and
Line 57, "fog." should read -- fog to --.

Column 9,
Line 4, "can not" should read -- cannot --.

Column 10,
Lines 4 and 11, "can not" should read -- cannot --.

Column 13,
Line 12, "enlarge" should read -- enlarged --.

Column 14,
Line 9, "come" should read -- comes --.

Column 19,
Line 28, "crayter-" should read -- crater- --; and
Lines 30, 36, 46, 51, 57, 62 and 64, "crayter-shaped" should read -- crater-shaped --.

Column 20,
Line 52, "come" should read -- become --.

Column 24,
Lines 23, 27, 34, 35 and 40, "can not" should read -- cannot --; and
Line 52, "become" should read -- becomes --; and "comes" should read -- becomes --.

Column 25,
Line 3, "can not" should read -- cannot --; and
Line 61, "has" should read -- has, --.

Column 26,
Line 2, "has" should read -- has, --.

UNITED STATES PATENT AND TRADEMARK OFFICE

CERTIFICATE OF CORRECTION

PATENT NO. : 6,873,816 B2
DATED : March 29, 2005
INVENTOR(S) : Yasutaka Akashi et al.

It is certified that error appears in the above-identified patent and that said Letters Patent is hereby corrected as shown below:

Column 27,
Lines 13 and 16, “can not” should read -- cannot --.

Column 28,
Line 10, “have” should read -- have, --; and
Line 21, “in” should read -- have --.

Column 29,
Line 64, “can not well be improved,” should read -- cannot be improved well, --; and
Line 66, “can not” should read -- cannot --.

Column 35,
Line 33, “usable”should read -- and usable --.

Column 37,
Line 13, “usable” should read -- and usable --; and
Line 51, “can not” should read -- cannot --.

Column 41,
Line 1, “Y″” should read -- $Y^+$ --; and
Line 20, “can not” should read -- cannot --.

Column 51,
Line 51, “can not” should read -- cannot --.

Column 52,
Line 58, “can not” should read -- cannot --.

Column 53,
Line 2, “can not” should read -- cannot --.

Column 54,
Line 14, “can not” should read -- cannot --.

Column 56,
Lines 44 and 56, “can not” should read -- cannot --.

UNITED STATES PATENT AND TRADEMARK OFFICE

CERTIFICATE OF CORRECTION

PATENT NO. : 6,873,816 B2
DATED : March 29, 2005
INVENTOR(S) : Yasutaka Akashi et al.

It is certified that error appears in the above-identified patent and that said Letters Patent is hereby corrected as shown below:

Column 57,
Lines 10 and 52, “can not” should read -- cannot --.

Column 58,
Line 4, “less occur” should read -- occur less --; and “better be” should read -- be better --; and
Line 49, “can not” should read -- cannot --.

Column 62,
Line 42, “be” should read -- may be --.

Signed and Sealed this

Eighteenth Day of October, 2005

JON W. DUDAS
*Director of the United States Patent and Trademark Office*